US008741400B2

(12) United States Patent
Furuie et al.

(10) Patent No.: US 8,741,400 B2
(45) Date of Patent: Jun. 3, 2014

(54) LATENT IMAGE PATTERN FORMED BODY

(75) Inventors: Makoto Furuie, Odawara (JP); Shinichi Kitagawa, Tokyo-To (JP); Shigeru Morinaga, Kanagawa-Ken (JP)

(73) Assignee: National Printing Bureau, Incorporated Administrative Agency, Tokyo (JP)

( * ) Notice: Subject to any disclaimer, the term of this patent is extended or adjusted under 35 U.S.C. 154(b) by 137 days.

(21) Appl. No.: 13/387,986

(22) PCT Filed: Jul. 30, 2010

(86) PCT No.: PCT/JP2010/062877

§ 371 (c)(1), (2), (4) Date: Jan. 30, 2012

(87) PCT Pub. No.: WO2011/013788

PCT Pub. Date: Feb. 3, 2011

(65) Prior Publication Data

US 2012/0128900 A1 May 24, 2012

(30) Foreign Application Priority Data

Jul. 31, 2009 (JP) ..... 2009-179836

(51) Int. Cl.

| | |
|---|---|
| ***B44F 1/10*** | (2006.01) |
| ***B41M 5/00*** | (2006.01) |
| ***B42D 15/10*** | (2006.01) |

(52) U.S. Cl.

USPC ..... 428/29; 428/195.1; 428/915; 428/916; 283/72

(58) Field of Classification Search

CPC ..... B42D 15/0013; B42D 15/10; B42D 2031/14; B42D 2031/16; B42D 2035/16; B42D 2035/18

USPC ..... 428/29, 195.1, 915, 916; 283/72

See application file for complete search history.

(56) References Cited

U.S. PATENT DOCUMENTS

| | | | |
|---|---|---|---|
| 5,476,830 | A | 12/1995 | Gundjian |
| 2004/0254074 | A1 | 12/2004 | Awano et al. |

FOREIGN PATENT DOCUMENTS

| | | | |
|---|---|---|---|
| CN | 1110872 | A | 10/1995 |

(Continued)

*Primary Examiner* — Mark Ruthkosky
*Assistant Examiner* — Laura C Powers
(74) *Attorney, Agent, or Firm* — Birch, Stewart, Kolasch & Birch, LLP

(57) ABSTRACT

This invention provides a latent image pattern formed body that allows to observe a latent image having excellent visibility and authenticity discrimination and design properties than those of related arts when observed from the oblique direction. The latent image pattern formed body includes, in at least part of one surface of a substrate, a latent image region, an outline region arranged on an outline of at least part of the latent image region, and a background region arranged on a background of the latent image region and the outline region. In the latent image region, a plurality of first elements having a concave or convex shape are arranged at a first pitch in a first direction. In the background region, the plurality of first elements are arranged at the first pitch in the first direction in a phase different from that of the first elements in the latent image region. In the outline region, the plurality of first elements are arranged at the first pitch in the first direction in a phase different from that of the first elements in the latent image region or background region adjacent to the outline region. In the latent image region, the background region, and the outline region, a plurality of second elements having a color different from that of the substrate are arranged at a second pitch in a second direction.

20 Claims, 53 Drawing Sheets

(56) References Cited

FOREIGN PATENT DOCUMENTS

| | | | |
|---|---|---|---|
| CN | 1124940 | A | 6/1996 |
| CN | 1205276 | A | 1/1999 |
| CN | 1571734 | A | 1/2005 |
| JP | 2600094 | B2 | 1/1997 |
| JP | 2615401 | B2 | 3/1997 |
| JP | 2004-174997 | A | 6/2004 |
| JP | 2006-123355 | A | 5/2006 |
| JP | 2008-265189 | A | 11/2008 |
| JP | 2009-90531 | A | 4/2009 |

LATENT IMAGE PATTERN FORMED BODY

TECHNICAL FIELD

The present invention relates to a latent image pattern formed body applied to valuable printed matters such as banknotes, stock certificates, securities, passes, passports, gift certificates, and cards that require anti-counterfeit.

BACKGROUND ART

Valuable printed matters including securities such as banknotes, stock certificates, and bonds, cards, various kinds of certificates, and important documents require not to be forged or altered as their properties. Examples of preventive measures are printing using special ink, hologram, thread, and printing of microletters.

The present applicant has proposed, as one of such preventive measures as described above, an invention of a latent image pattern formed body in which at least one of various kinds of parallel line patterns or relief patterns, which express a motif by partially changing the angle, is printed using raised print image lines, and at least one of various kinds of parallel image lines or halftone dot image lines having a predetermined interval is printed on the print image lines parallelly or obliquely with respect to the print image lines (for example, see patent reference 1).

The present applicant has also proposed another invention of a latent image pattern formed body in which at least one of various kinds of parallel line patterns or relief patterns, which express a motif by partially changing the angle, is printed by embossing to form an uneven material, and at least one of various kinds of parallel image lines or halftone dot image lines having a predetermined interval is printed on the uneven material parallelly or obliquely with respect to a portion that forms a portion other than the uneven motif (for example, see patent reference 2).

PRIOR ART REFERENCES

Patent References

Patent reference 1: Japanese Patent No. 2600094
Patent reference 2: Japanese Patent No. 2615401

SUMMARY OF THE INVENTION

In the inventions of patent references 1 and 2, when observing the printed matter from the oblique direction, the latent image portion and the background portion are observed in different colors. For example, when the latent image portion is observed in the color of the parallel lines, the background portion is observed in the color of the substrate. Alternatively, when the background portion is observed in the color of the parallel lines, the latent image portion is observed in the color of the substrate. However, the latent image can be observed only in one of the above-described patterns. Hence, there arises a demand for a printed matter that allows to observe a latent image having more excellent authenticity discrimination and design properties.

That is, the above-described latent image pattern formed body applied to a valuable printed matter preferably allows not only to observe a latent image for authenticity determination when being tilted but also to observe, for example, a latent image with a luxurious or elaborate design suitable for the value of the valuable printed matter. In addition, to facilitate authenticity determination by observing the latent image, the visibility of the latent image pattern needs to be improved.

The present invention has been made to solve the above-described problem, and has as its object to provide a latent image pattern formed body that allows to observe a latent image having more excellent visibility and authenticity discrimination and design properties than those of the related arts.

To solve the above-captioned problem, the latent image pattern formed body of the present invention comprising, in at least part of one surface of a substrate, a latent image region, an outline region arranged on an outline of at least part of said latent image region, and a background region arranged on a background of said latent image region and said outline region, wherein in said latent image region, a plurality of first elements having a concave shape or a convex shape are arranged at a first pitch in a first direction, in said background region, the plurality of first elements are arranged at the first pitch in the first direction in a phase different from that of the first elements in said latent image region, in said outline region, the plurality of first elements are arranged at the first pitch in the first direction in a phase different from that of the first elements in said latent image region or said background region which is adjacent to said outline region, and in said latent image region, said background region, and said outline region, a plurality of second elements having a color different from that of the substrate are arranged at a second pitch in a second direction.

Further, according to the latent image pattern formed body of the present invention, the first elements arranged in said outline region are arranged substantially parallel to the first elements arranged in each of said latent image region and said background region, each first element is divided into at least one region and another region at a line that connects bottom points of the concave shape or vertices of the convex shape in a full range of the first element along a longitudinal direction so as to define said one region as an observation portion and said other region as a non-observation portion, the second element is arranged such that i) the second element overlaps at least part of the observation portion of the first element arranged in said latent image region and at least part of the observation portion of the first element arranged in said background region but not the observation portion of the first element arranged in said outline region, and an area ratio of the second element overlapping the observation portion of the first element arranged in said latent image region is different from the area ratio of the second element overlapping the observation portion of the first element arranged in said background region, ii) the second element overlaps at least part of the observation portion of the first element arranged in said latent image region and at least part of the observation portion of the first element arranged in said outline region but not the observation portion of the first element arranged in said background region, and the area ratio of the second element overlapping the observation portion of the first element arranged in said latent image region is different from the area ratio of the second element overlapping the observation portion of the first element arranged in said outline region, iii) the second element overlaps at least part of the observation portion of the first element arranged in said background region and at least part of the observation portion of the first element arranged in said outline region but not the observation portion of the first element arranged in said latent image region, and the area ratio of the second element overlapping the observation portion of the first element arranged in said background region is different from the area ratio of the second element overlapping the observation portion of the first element arranged in said outline region, or iv) the second element overlaps at least part of the observation portion of the first element arranged in said latent image region, at least part of the observation portion of the first element arranged in said background region, and at least part of the observation portion of the first element arranged in said outline region, and the area ratio of the second element overlapping the observation portion of the first element arranged in said latent image region and the area ratio of the second element overlapping the observation portion of the first element arranged in said background region are different from the area ratio of the second element overlapping the observation portion of the first element arranged in said outline region, and the latent image pattern is formed by one of i) to iv).

Further, according to the latent image pattern formed body of the present invention, the first element arranged in said outline region includes an outline element and an outline auxiliary element in phases shifted from each other, at least part of the outline element is arranged in the same phase as that of the first element arranged in said latent image region or the first element arranged in said background region, and the outline auxiliary element is arranged in a phase different from that of the outline element between the outline element and the first element arranged in said latent image region in the same phase as that of said at least part of the outline element or between the outline element and the first element arranged in said background region in the same phase as that of said at least part of the outline element.

Further, according to the latent image pattern formed body of the present invention, each first element, the outline element, or the outline auxiliary element is divided into at least one region and another region at a line that connects bottom points of the concave shape or vertices of the convex shape in a full range of the first element, the outline element, or the outline auxiliary element along a longitudinal direction so as to define said one region as an observation portion and said other region as a non-observation portion, the second element is arranged such that i) the second element overlaps not the observation portion of the first element arranged in said background region in the phase different from that of the outline element and the observation portion of the outline auxiliary element but at least part of the observation portion of the outline element and at least part of the observation portion of the first element arranged in said latent image region in the same phase as that of the outline element, or the second element overlaps not the observation portion of the first element arranged in said latent image region in the phase different from that of the outline element and the observation portion of the outline auxiliary element but at least part of the observation portion of the outline element and at least part of the observation portion of the first element arranged in said background region in the same phase as that of the outline element, ii) the second element overlaps not the observation portion of the first element arranged in said background region in the same phase as that of the outline element and the observation portion of the outline element but at least part of the observation portion of the outline auxiliary element and at least part of the observation portion of the first element arranged in said latent image region in the phase different from that of the outline element, or the second element overlaps not the observation portion of the first element arranged in said latent image region in the same phase as that of the outline element and the observation portion of the outline element but at least part of the observation portion of the outline auxiliary element and at least part of the observation portion of the first element arranged in said background region in the phase different from as that of the outline element, iii) the second element overlaps not the observation portion of the first element arranged in said background region in the phase different from that of the outline element but at least part of the observation portion of the outline element, at least part of the observation portion of the outline auxiliary element, and at least part of the observation portion of the first element arranged in said latent image region in the same phase as that of the outline element, and area ratios of the second element overlapping the observation portion of the outline element and the observation portion of the first element arranged in said latent image region in the same phase as that of the outline element are different from the area ratio of the second element overlapping the observation portion of the outline auxiliary element, or the second element overlaps not the observation portion of the first element arranged in said latent image region in the phase different from that of the outline element but at least part of the observation portion of the outline element, at least part of the observation portion of the outline auxiliary element, and at least part of the observation portion of the first element arranged in said background region in the same phase as that of the outline element, and the area ratios of the second element overlapping the observation portion of the outline element and the observation portion of the first element arranged in said background region in the same phase as that of the outline element are different from the area ratio of the second element overlapping the observation portion of the outline auxiliary element, iv) the second element overlaps not the observation portion of the outline auxiliary element but at least part of the observation portion of the outline element, at least part of the observation portion of the first element arranged in said latent image region, and the area ratios of the second element overlapping the observation portion of the outline element and the observation portion of the first element arranged in said latent image region or said background region in the same phase as that of the outline element are different from the area ratio of the second element overlapping the observation portion of the first element arranged in said latent image region or said background region in the phase different from that of the outline element, or v) the second element overlaps at least part of the observation portion of the outline element, at least part of the observation portion of the outline auxiliary element, at least part of the observation portion of the first element arranged in said latent image region, and at least part of the observation portion of the first element arranged in said background region, and the area ratios of the second element overlapping the observation portion of the outline element and the observation portion of the first element arranged in said latent image region or said background region in the same phase as that of the outline element are different from the area ratios of the second element overlapping the observation portion of the outline auxiliary element and the observation portion of the first element arranged in said latent image region or said background region in the phase different from that of the outline element, and the latent image pattern is formed by one of i) to v).

According to the latent image pattern formed body of the present invention, said outline region includes a latent image adjacent outline element that is arranged on a side opposite to the first elements arranged in said latent image region with respect to the first element located at an outermost position out of the first elements arranged in said latent image region, and is arranged by partially changing the phase in the first element adjacent to the first element located at the outermost position out of the first elements arranged in said latent image region, and the latent image adjacent outline element is arranged at a pitch different from the first pitch with respect to the first element located at the outermost position out of the first elements arranged in said latent image region.

Further, according to the latent image pattern formed body of the present invention, the second element is arranged such that i) the second element overlaps not the observation portion of the first element arranged in said background region but at least part of the observation portion of the first element arranged in said latent image region and at least part of the observation portion of the latent image adjacent outline element, and an area ratio of the second element overlapping the observation portion of the first element arranged in said latent image region is different from the area ratio of the second element overlapping the observation portion of the latent image adjacent outline element, ii) the second element overlaps not the observation portion of the first element arranged in said latent image region but at least part of the observation portion of the first element arranged in said background region and at least part of the observation portion of the latent image adjacent outline element, and the area ratio of the second element overlapping the observation portion of the first element arranged in said background region is different from the area ratio of the second element overlapping the observation portion of the latent image adjacent outline element, iii) the second element overlaps not the observation portion of the latent image adjacent outline element but at least part of the observation portion of the first element arranged in said latent image region and at least part of the observation portion of the first element arranged in said background region, and the area ratio of the second element overlapping the observation portion of the first element arranged in said latent image region is different from the area ratio of the second element overlapping the observation portion of the first element arranged in said background region, or iv) the second element overlaps at least part of the observation portion of the first element arranged in said latent image region, at least part of the observation portion of the first element arranged in said background region, and at least part of the observation portion of the latent image adjacent outline element, and the area ratio of the second element overlapping the observation portion of the first element arranged in said latent image region, the area ratio of the second element overlapping the observation portion of the first element arranged in said background region, and the area ratio of the second element overlapping the observation portion of the latent image adjacent outline element are different, and the latent image pattern is formed by one of i) to iv).

Further, according to the latent image pattern formed body of the present invention, said outline region includes a background adjacent outline element that is arranged on a side opposite to the first elements arranged in said latent image region with respect to the latent image adjacent outline element and partially changes the phase in at least one of the first elements continuously adjacent to the latent image adjacent outline element, and the second element overlaps at least two of the observation portion of the first element arranged in said background region, the observation portion of the first element arranged in said latent image region, the observation portion of the latent image adjacent outline element, and the observation portion of the background adjacent outline element.

Further, according to the latent image pattern formed body of the present invention, the background adjacent outline element is arranged on the side opposite to the first elements arranged in said latent image region with respect to the latent image adjacent outline element and partially changes the phase in at least second and subsequent first elements continuously adjacent to the latent image adjacent outline element, and the outline element is formed between the latent image adjacent outline element and the background adjacent outline element in the same phase as that of the first element arranged in said background region, and the second element overlaps at least three of the observation portion of the first element arranged in said background region, the observation portion of the first element arranged in said latent image region, the observation portion of the outline element, the observation portion of the latent image adjacent outline element, and the observation portion of the background adjacent outline element.

Further, according to the latent image pattern formed body of the present invention, said outline region includes a background adjacent outline element that is arranged on a side opposite to the first elements arranged in said latent image region with respect to the first element arranged at an outermost position out of the first elements arranged in said latent image region and is arranged by partially changing the phase in at least one of at least second and subsequent first elements out of the first elements continuously adjacent to the first element at the outermost position out of the first elements arranged in said latent image region, and the outline element is formed between the background adjacent outline element and the first element arranged at the outermost position in the same phase as that of the first element arranged in said background region, and the second element overlaps at least two of the observation portion of the first element arranged in said background region, the observation portion of the first element arranged in said latent image region, the observation portion of the outline element, and the observation portion of the background adjacent outline element.

Further, according to the latent image pattern formed body of the present invention comprising, in at least part of one surface of a substrate, a latent image region, an outline region arranged on an outline of at least part of said latent image region, and a background region arranged on a background of said latent image region and said outline region, wherein in said latent image region, a plurality of first elements having a concave shape or a convex shape are arranged at a first pitch in a first direction, in said background region, the plurality of first elements are arranged at the first pitch in the first direction in a phase different from that of the first elements in said latent image region, in said outline region, the plurality of first elements are arranged at the first pitch in the first direction in a phase different from that of the first elements in said latent image region or said background region which is adjacent to said outline region, in said latent image region, said background region, and said outline region, a plurality of second elements having a color different from that of the substrate are arranged at a second pitch in a second direction, in said latent image region, said background region, and said outline region, a plurality of third elements having a color different from those of the substrate and the second elements are arranged at a third pitch in a third direction, each first element is divided into at least one region and another region at a line that connects bottom points of the concave shape or vertices of the convex shape in a full range of the first element along a longitudinal direction so as to define said one region as an observation portion and said other region as a non-observation portion, the second element overlaps not the third element but at least one of the observation portion of the first element arranged in said latent image region, the observation portion of the first element arranged in said background region, and the observation portion of the first element arranged in said outline region, and the third element overlaps not the second element but at least one of the observation portion of the first element arranged in said latent image region, the observation portion of the first element arranged in said background region, and the observation portion of the first element arranged in said outline region, thereby forming a latent image pattern.

Further, according to the latent image pattern formed body of the present invention, wherein the first elements arranged in said outline region are arranged substantially parallel to the first elements arranged in said latent image region and said background region, the second element is arranged such that i) the second element overlaps at least part of one of the observation portion of the first element arranged in said latent image region, the observation portion of the first element arranged in said background region, and the observation portion of the first element arranged in said outline region, and the third element overlaps at least part of one of the observation portions the second element does not overlap, or ii) the second element overlaps at least part of two of the observation portion of the first element arranged in said latent image region, the observation portion of the first element arranged in said background region, and the observation portion of the first element arranged in said outline region, the third element overlaps at least part of one of the observation portions the second element does not overlap, and when the second element overlaps not the observation portion of the first element arranged in said background region but the observation portion of the first element arranged in said latent image region and the observation portion of the first element arranged in said outline region, an area ratio of the second element overlapping the observation portion of the first element arranged in said latent image region is different from the area ratio of the second element overlapping the observation portion of the first element arranged in said outline region, or when the second element overlaps not the observation portion of the first element arranged in said latent image region but the observation portion of the first element arranged in said background region and the observation portion of the first element arranged in said outline region, the area ratio of the second element overlapping the observation portion of the first element arranged in said background region is different from the area ratio of the second element overlapping the observation portion of the first element arranged in said outline region, and the latent image pattern is formed by one of i) and ii).

Further, according to the latent image pattern formed body of the present invention, the first element arranged in said outline region includes an outline element and an outline auxiliary element in phases shifted from each other, at least part of the outline element is arranged in the same phase as that of the first element arranged in said latent image region or the first element arranged in said background region, the outline auxiliary element is arranged in a phase different from that of the outline element between the outline element and the first element arranged in said latent image region or between the outline element and the first element arranged in said background region, the second element overlaps at least one of the observation portion of the first element arranged in said background region, the observation portion of the first element arranged in said latent image region, the observation portion of the outline element, and the observation portion of the outline auxiliary element, and the third element overlaps at least one of the observation portion of the first element arranged in said background region, the observation portion of the first element arranged in said latent image region, the observation portion of the outline element, and the observation portion of the outline auxiliary element the second element does not overlap.

Further, according to the latent image pattern formed body of the present invention, said outline region includes a latent image adjacent outline element that is arranged on a side opposite to the first elements arranged in said latent image region with respect to the first element located at an outermost position out of the first elements arranged in said latent image region, and is arranged by partially changing the phase in the first element adjacent to the first element located at the outermost position out of the first elements arranged in said latent image region, and the latent image adjacent outline element is arranged at a pitch different from the first pitch from the first element located at the outermost position out of the first elements arranged in said latent image region.

Further, according to the latent image pattern formed body of the present invention, the second element is arranged such that i) the second element overlaps at least part of one of the observation portion of the first element arranged in said latent image region, the observation portion of the first element arranged in said background region, and the observation portion of the latent image adjacent outline element, and the third element overlaps at least part of one of the observation portion of the first element arranged in said latent image region, the observation portion of the first element arranged in said background region, and the observation portion of the latent image adjacent outline element the second element does not overlap, or ii) the second element overlaps, with different area ratios, at least part of two of the observation portion of the first element arranged in said latent image region, the observation portion of the first element arranged in said background region, and the observation portion of the latent image adjacent outline element, and the third element overlaps at least part of one of the observation portion of the first element arranged in said latent image region, the observation portion of the first element arranged in said background region, and the observation portion of the latent image adjacent outline element the second element does not overlap.

Further, according to the latent image pattern formed body of the present invention, said outline region includes a background adjacent outline element that is arranged on a side opposite to the first elements arranged in said latent image region with respect to the latent image adjacent outline element and partially changes the phase in at least one of the first elements continuously adjacent to the latent image adjacent outline element, the second element overlaps at least one of the observation portion of the first element arranged in said background region, the observation portion of the first element arranged in said latent image region, the observation portion of the latent image adjacent outline element, and the observation portion of the background adjacent outline element, and the third element overlaps at least part of one of the observation portion of the first element arranged in said background region, the observation portion of the first element arranged in said latent image region, the observation portion of the latent image adjacent outline element, and the observation portion of the background adjacent outline element the second element does not overlap.

Further, according to the latent image pattern formed body of the present invention, the background adjacent outline element is arranged on the side opposite to the first elements arranged in said latent image region with respect to the latent image adjacent outline element and partially changes the phase in at least second and subsequent first elements continuously adjacent to the latent image adjacent outline element, and the outline element is formed between the latent image adjacent outline element and the background adjacent outline element in the same phase as that of the first element arranged in said background region, and the second element and the third element overlap at least three of the observation portion of the first element arranged in said background region, the observation portion of the first element arranged in said latent image region, the observation portion of the outline element, the observation portion of the latent image adjacent outline element, and the observation portion of the background adjacent outline element, the second element overlaps at least one of the observation portion of the first element arranged in said background region, the observation portion of the first element arranged in said latent image region, the observation portion of the outline element, the observation portion of the latent image adjacent outline element, and the observation portion of the background adjacent outline element, and the third element overlaps at least one of the observation portion of the first element arranged in said background region, the observation portion of the first element arranged in said latent image region, the observation portion of the outline element, the observation portion of the latent image adjacent outline element, and the observation portion of the background adjacent outline element the second element does not overlap.

Further, according to the latent image pattern formed body of the present invention, said outline region includes a background adjacent outline element that is arranged on a side opposite to the first elements arranged in said latent image region with respect to the first element at an outermost position out of the first elements arranged in said latent image region and is arranged by partially changing the phase in at least one of at least second and subsequent first elements out of the first elements continuously adjacent to the first element at the outermost position out of the first elements arranged in said latent image region, and the outline element is formed between the background adjacent outline element and the first element at the outermost position in the same phase as that of the first element arranged in said background region, the second element overlaps at least one of the observation portion of the first element arranged in said background region, the observation portion of the first element arranged in said latent image region, the observation portion of the outline element, and the observation portion of the background adjacent outline element, and the third element overlaps at least one of the observation portion of the first element arranged in said background region, the observation portion of the first element arranged in said latent image region, the observation portion of the outline element, and the observation portion of the background adjacent outline element the second element does not overlap.

Further, according to the latent image pattern formed body of the present invention, the first elements and the second elements are formed based such that i) the first direction and the second direction are and the first pitch and the second pitch are equal or different, or ii) the first direction and the second direction are different, and the first pitch and the second pitch are equal or different.

Further, according to the latent image pattern formed body of the present invention, the first elements, the second elements, and the third elements are formed such that i) the first direction, the second direction, and the third direction are equal, and the first pitch, the second pitch, and the third pitch are equal, or at least one pitch is different from at least one of the remaining pitches, or ii) at least one of the first direction, the second direction, and the third direction is different from at least one of the remaining directions, and the first pitch, the second pitch, and the third pitch are equal, or at least one pitch is different from at least one of the remaining pitches.

The latent image pattern formed body of the present invention allows to observe the latent image portion, the background portion, and the outline portion as a latent image when observed from the oblique direction based on reflected light, and is also excellent in the design property and visibility for authenticity discrimination. It is therefore possible to grasp the authenticity of the printed matter.

DETAILED DESCRIPTION OF THE EMBODIMENTS

The embodiments of the invention will be described with reference to the accompanying drawings. However, the present invention is not limited to the best mode for carrying out to be described below and incorporates various other embodiments within the technical scope defined in the appended claims.

First Embodiment

Figure 1:
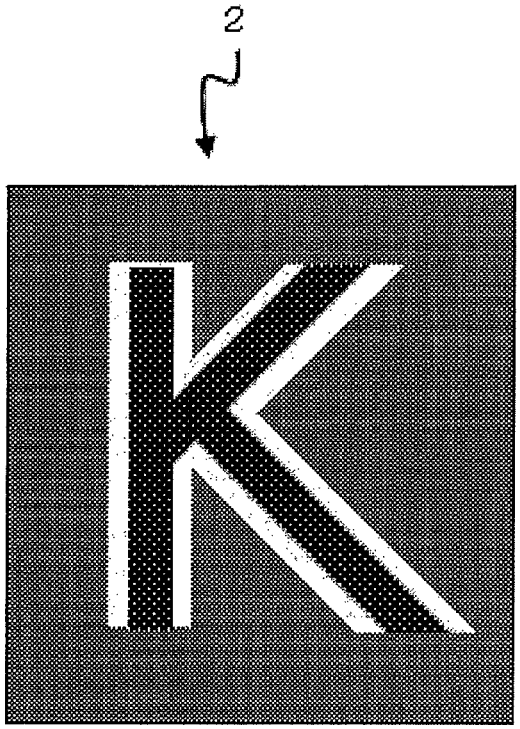
FIG. 1 is a view showing a latent image pattern according to the first embodiment.

The present invention provides a latent image pattern formed body in which a second pattern having a color different from that of a substrate is formed on a first pattern having a concave shape or a convex shape and formed on the substrate. Upon observation from the oblique direction, portions where the color of the second pattern is observed and portions where the color of the second pattern is not observed appear because of the arrangement of the first pattern and the second pattern so that a latent image can be observed. The first embodiment provides a latent image pattern formed body (2) in which the outlines on the left and right sides of the motif of the latent image shown in FIG. 1 can be observed in a color different from those of the latent image and the background.

The latent image pattern formed body (2) of the first embodiment will be described with reference to FIGS. 1 to 24.

Figure 2:
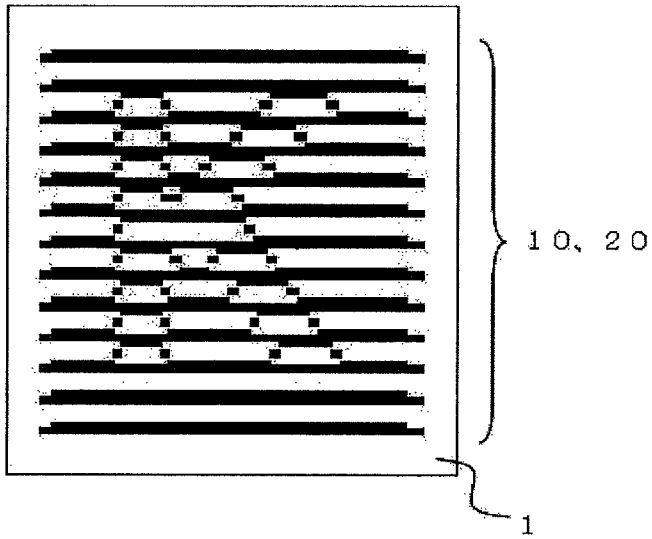
FIG. 2 is a view showing a first pattern and a second pattern that form a latent image pattern formed body.

The latent image pattern formed body (2) of the present invention is formed by forming a first pattern (10) and a second pattern (20) on a substrate (1), as shown in FIG. 2. The substrate (1) is not particularly limited, and paper, a film, a plastic, a composite material thereof, or the like is used. The first pattern (10) and the second pattern (20) that form the latent image pattern formed body (2) will be described next.

(First Pattern)

Figure 3:
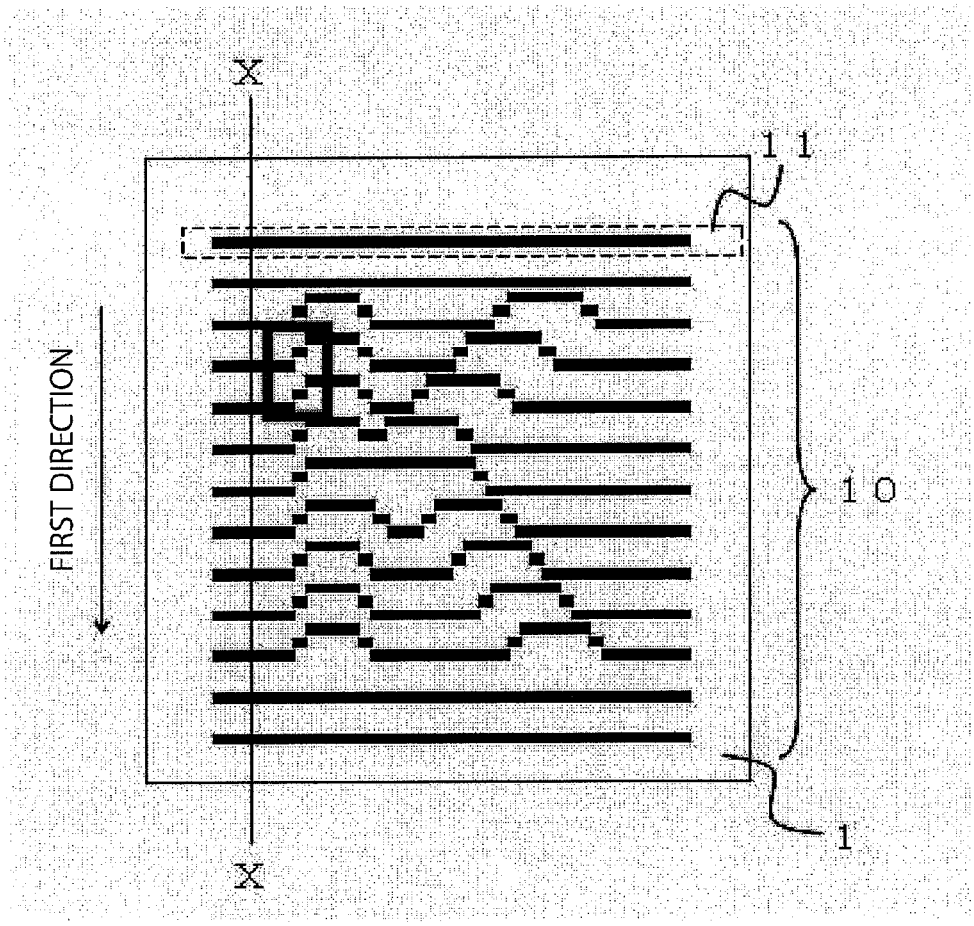
FIG. 3 is a view showing the first pattern.

As shown in FIG. 3, the first pattern (10) is formed by arranging a plurality of first elements (11) on the substrate (1) in the first direction. Note that the "first direction" is the direction in which the first elements (11) are arranged on the substrate (1).

Figure 4:
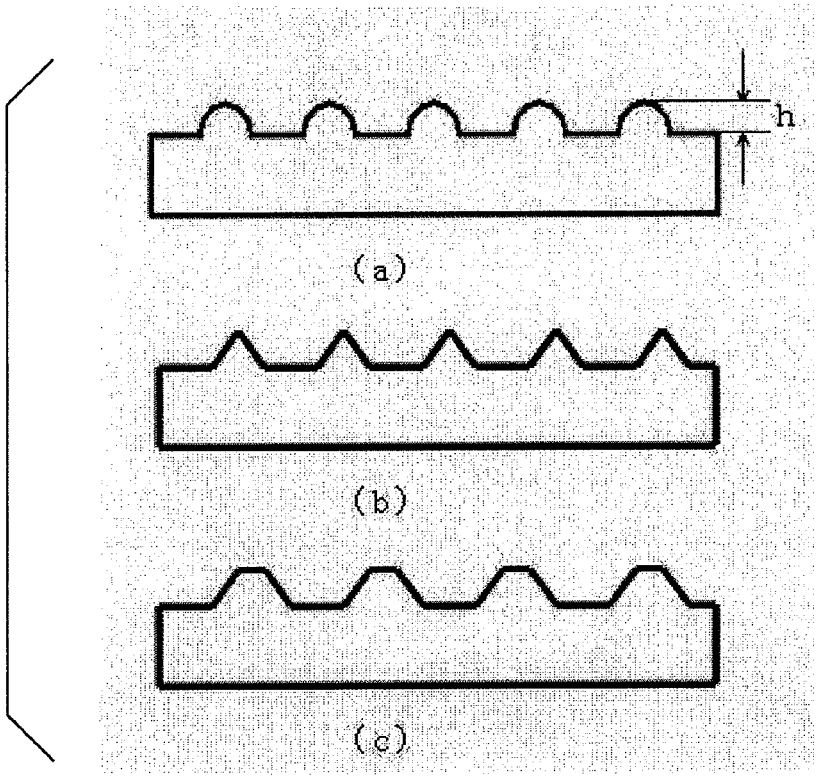
FIG. 4 shows sectional views of a first element having a convex shape.
Figure 5:
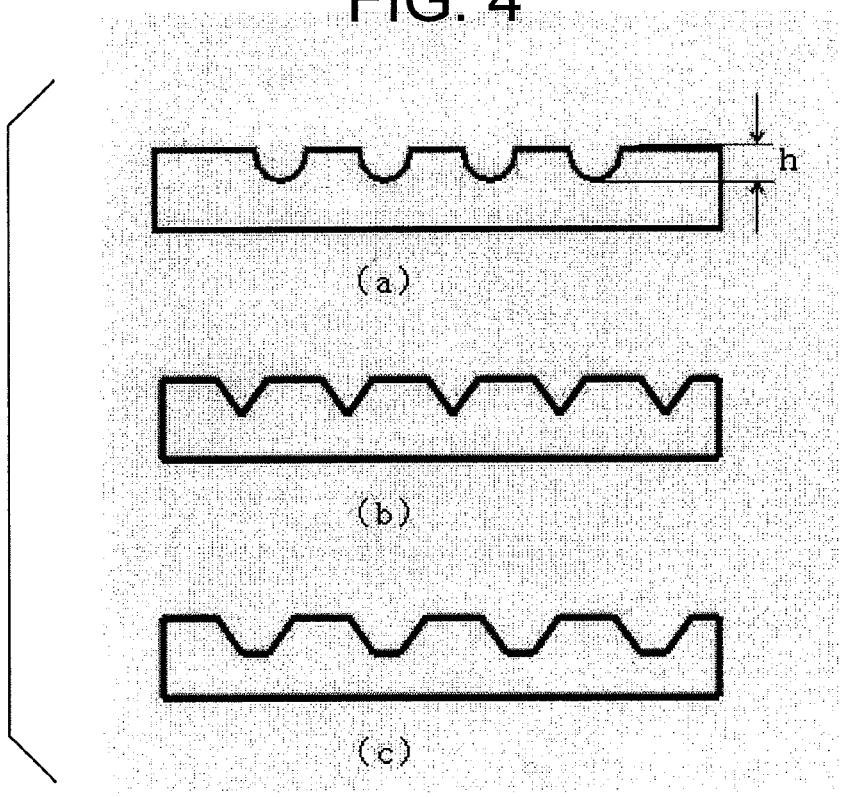
FIG. 5 shows sectional views of the first element having a concave shape.

Each first element (11) is formed into a convex shape as shown in FIGS. 4(*a*) to 4(*c*) that are sectional views taken along a line X-X in FIG. 3 or a concave shape as shown in FIGS. 5(*a*) to 5(*c*). To form the convex shapes shown in FIG. 4, for example, the first elements are printed on the substrate (1) using an ink. To form the concave shapes, for example, the substrate (1) is partially removed by laser machining. Note that the methods of forming the convex shapes and the concave shapes will be described later.

The convex shapes and the concave shapes are not limited to those shown in FIGS. 4 and 5. It is necessary only to observe almost the entire surface of the convex shape or the concave shape upon observation from right above. When observed from the oblique direction, the convex shape need only allow to observe the near-side surface and prohibit observation of the far-side surface, whereas the concave shape need only allow to observe the far-side surface and prohibit observation of the near-side surface. Note that how the surface of the convex shape or the concave shape looks upon observation from the oblique direction will be described later.

The first element (11) is formed from an image line or a plurality of pixels. In the present invention, an "image line" means a straight line, a broken line, a wavy line, or the like. In this explanation, a "pixel" means a character, a numeral, a symbol, a graphic, a mark, or the like having a predetermined shape. The shape of the pixel is not particularly limited.

Figure 6:
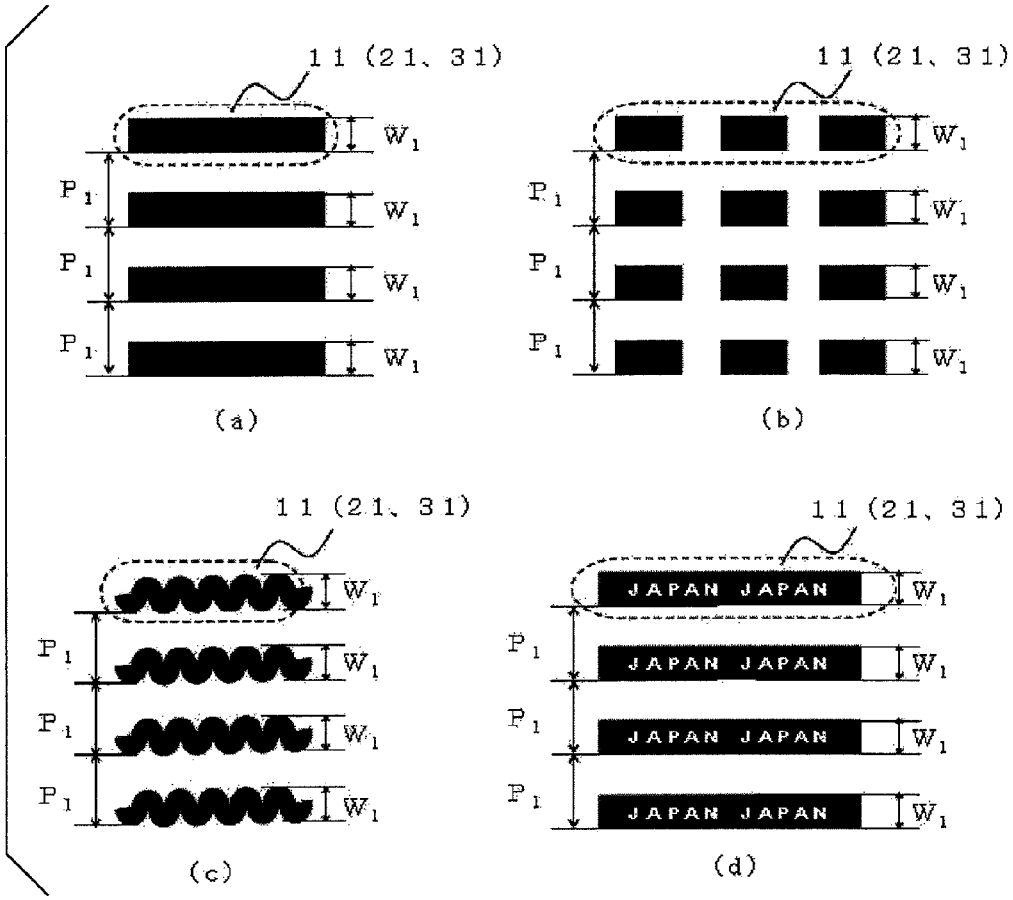
FIG. 6 shows views of examples of the first element formed by an image line.

FIG. 6(*a*) shows an example in which a plurality of first elements (11) each formed from a straight line are arranged. FIG. 6(*b*) shows an example in which a plurality of first elements (11) each formed from a broken line are arranged. FIG. 6(*c*) shows an example in which a plurality of first elements (11) each formed from a wavy line are arranged. FIG. 6(*d*) shows an example in which a plurality of first elements (11) each formed from an image line with a motif are arranged.

A first pitch ($P_1$) shown in FIG. 6 is not limited. However, when the latent image pattern formed body of the present invention is formed on a valuable printed matter as described above and observed from the oblique direction to observe the latent image, the first pitch ($P_1$) preferably ranges from 80 μm to 1,000 μm. The first elements (11) are periodically arranged at a predetermined pitch within this range.

The latent image can be observed even if the first pitch ($P_1$) is larger than 1,000 μm. However, this is not preferable because the first pattern (10) for forming the motif of the latent image becomes large and subject to constraints by the design, for example, other print motifs of the valuable printed matter. In addition, the first pitch ($P_1$) may be smaller than 80 μm. However, this is not preferable because of the work accuracy of the first elements (11) or the requirement of high registration accuracy for arranging the first elements (11) and second elements (21) to be described later.

An image line width ($W_1$) is adjusted based on the first pitch ($P_1$) so as to separate a latent image portion, a background portion, and an outline portion to be described later and also observe a latent image with excellent visibility. To separate the latent image portion, the background portion, and the outline portion, the image line width ($W_1$) is preferably smaller than ½ the first pitch ($P_1$). To observe a latent image with excellent visibility, the image line width ($W_1$) is preferably larger than ⅕ the first pitch ($P_1$). Hence, the image line width ($W_1$) preferably falls within the range of ⅕ to ½ the image line width ($W_1$). The image line width ($W_1$) is adjusted based on the first pitch ($P_1$) so that, for example, when the first pitch ($P_1$) is 80 μm, the image line width ($W_1$) is 16 to 40 μm, and when the first pitch ($P_1$) is 1,000 μm, the image line width ($W_1$) is 200 to 500 μm.

A height (h) of the first element shown in FIG. 4 or the depth (h) of the first element shown in FIG. 5 ranges from 10 to 100 μm. The latent image can be observed even if the height (h) of the first element is smaller than 10 μm. However, this is not preferable because the viewpoint range where the latent image can be observed becomes narrower. The depth (h) of the first element may be larger than 100 μm. However, this is not preferable because the thickness of the substrate (1) is limited, and the work efficiency lowers.

Figure 7:
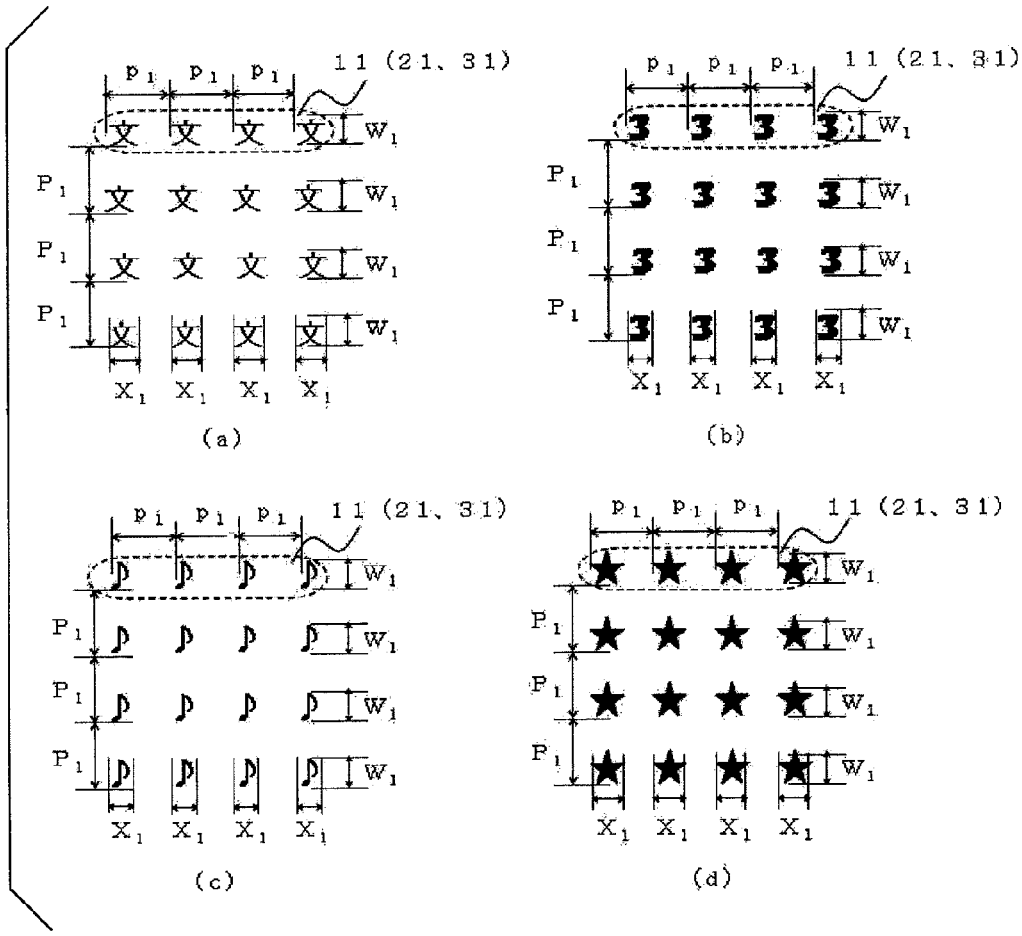
FIG. 7 shows views of examples of the first element formed by pixels.

When the first element (11) is formed from pixels, the image line that forms the first element (11) shown in FIG. 6 is replaced with the pixels, as shown in FIG. 7. The differences between the first element (11) formed from pixels and the first element (11) formed from an image line will be described.

FIG. 7(*a*) shows an example in which a plurality of first elements (11) each formed from pixels using a character are arranged. FIG. 7(*b*) shows an example in which a plurality of first elements (11) each formed from pixels using a numeral are arranged. FIG. 7(*c*) shows an example in which a plurality of first elements (11) each formed from pixels using a symbol are arranged. FIG. 7(*d*) shows an example in which a plurality of first elements (11) each formed from pixels using a graphic are arranged.

The range of the first pitch ($P_1$) shown in FIG. 7 is the same as that of the first pitch ($P_1$) of the first element (11) formed from an image line. The range of the pixel height ($W_1$) shown in FIG. 7 is the same as that of the image line width ($W_1$) of the first element (11) formed from an image line.

A pixel width ($X_1$) falls within the range of 1,000 μm or less. This is because in the first element (11) formed from pixels, the pixel shape is hardly observed by the naked eye when the pixel size is 1,000 μm or less.

A pixel pitch ($p_1$) is adjusted based on the pixel width ($X_1$) as needed such that the first element (11) is observed as an image line by the naked eye. In addition, the pixels are arranged by making at least the pixel pitch ($p_1$) larger than the pixel width ($X_1$) so that the pixels do not overlap each other.

Each first element (11) may be formed by compositing the image line structure and pixel structure described above. Alternatively, the plurality of first elements (11) may separately include the image line, the pixels, or the composite thereof.

An example in which the first element (11) is formed from a straight line will be described below.

The first pattern (10) formed from the above-described first elements (11) is separated into a latent image portion (12), a background portion (13), and an outline portion (14) because the periodically arranged first elements (11) partially change the phase. The outline portion (14) is formed between the latent image portion (12) and the background portion (13). This is explained in FIG. 8 that shows enlarged views of the portion surrounded by a rectangle in FIG. 3.

Figure 9:
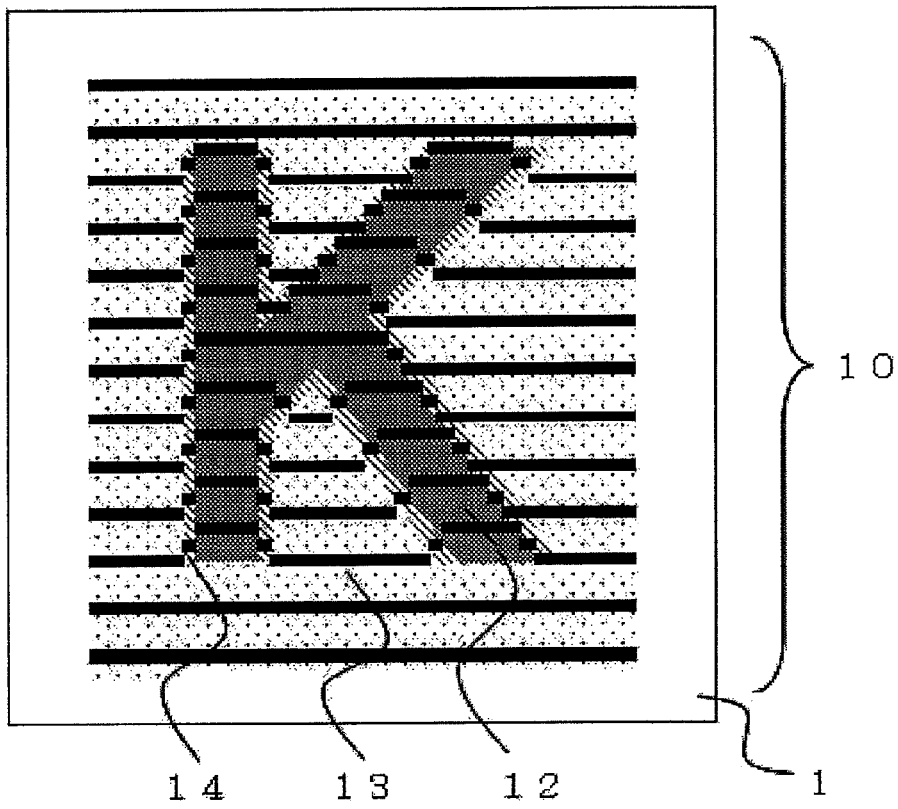
FIG. 9 is a view showing the latent image portion, the background portion, and the outline portion of the first pattern.

In the present invention, the "latent image portion (12)" is the portion of the motif of the latent image that is made visible by partially changing the phase of the periodically arranged first elements (11). The "background portion (13)" is the portion serving as the background of the motif of the latent image. The "outline portion (14)" is the portion serving as the outline of the motif of the latent image. That is, the latent image portion (12), the background portion (13), and the outline portion (14) of the first pattern (10) are separated as shown in FIG. 9. Note that the motif of the latent image is not limited to the character "K" shown in FIG. 1 and may be a numeral, a symbol, a graphic, a mark, or the like.

The first element that forms the latent image portion (12) will be referred to as a "latent image element (12A)", the first element that forms the background portion (13) as a "background element (13A)", and the first element that forms the outline portion (14) as an "outline element (14A)" hereinafter.

Figure 8:
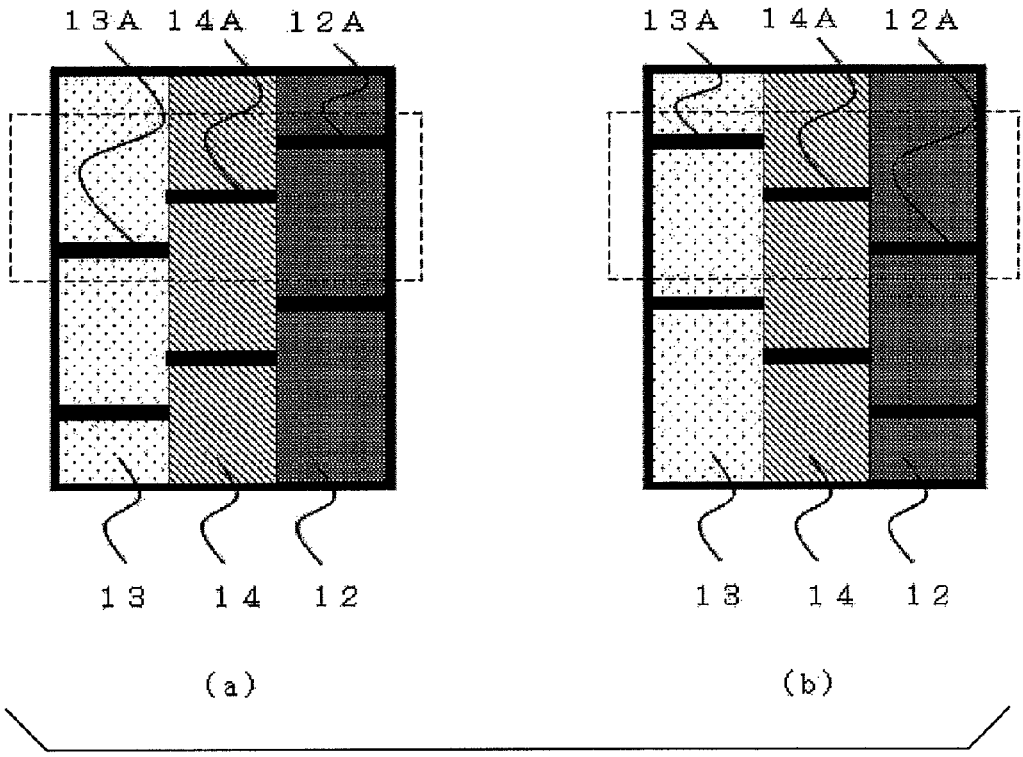
FIG. 8 shows enlarged views of a portion of the first pattern.

The latent image element (12A), the background element (13A), and the outline element (14A) that form the first pattern (10) are arranged in different phases. The elements surrounded by a dotted line frame shown in FIG. 8 are arranged in correspondence with each other. Note that arranging the elements in correspondence with each other means that the elements surrounded by the dotted line frame partially change the phase in the first element (11) formed from one image line, the elements are formed within a range smaller than the first pitch ($P_1$), and each element surrounded by the dotted line frame is arranged not to overlap the adjacent elements.

(Latent Image Portion)

The latent image element (12A) is arranged within the range smaller than the first pitch ($P_1$) in a different phase with respect to the background element (13A). That is, the latent image element (12A) and the background element (13A) are arranged in correspondence with each other. Note that the latent image element (12A) may change the phase to the upper side of the background element (13A), as shown in FIG. 8(*a*). Alternatively, the latent image element (12A) may change the phase to the lower side of the background element (13A), as shown in FIG. 8(*b*).

(Outline Portion)

Figure 10:
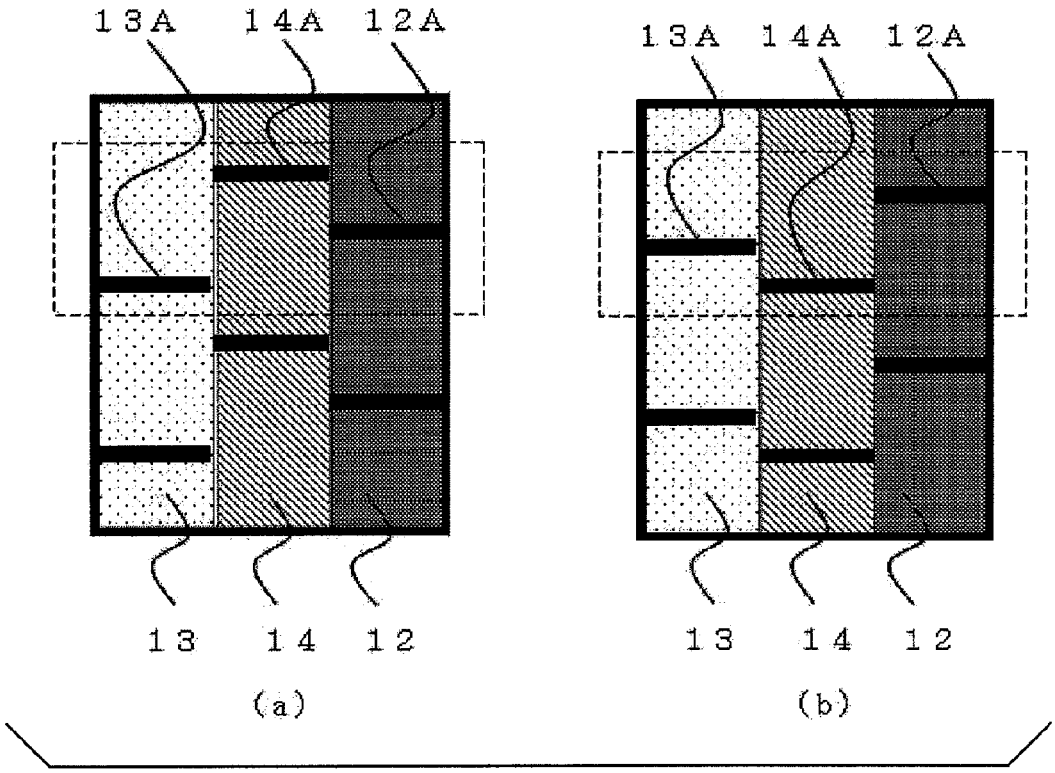
FIG. 10 shows views of the structures of the outline portion.

The outline element (14A) is arranged substantially parallel to the background element (13A) and the latent image element (12A) in a phase different from those of the background element (13A) and the latent image element (12A). An angle of 5° or less with respect to the background element (13A) and the latent image element (12A) is the range for "substantially parallel". An angle of 5° or less can ensure the tolerance for registration of the second elements (21) to be described later without affecting the visibility of the outline portion (14). Note that the outline element (14A) can be arranged either in a phase between the phase of the background element (13A) and that of the latent image element (12A), as shown in FIG. 8, or in a phase on the upper side of the latent image element (12A), as shown in FIG. 10(*a*), or in a phase on the lower side of the background element (13A), as shown in FIG. 10(*b*). However, when the outline element (14A) is arranged as shown in FIG. 10, it is arranged within the range of the dotted line frame not to overlap the adjacent elements. Note that the phase in which the outline element (14A) is arranged is the same as described above even when the latent image element (12A) changes the phase to the lower side of the background element (13A).

Figure 11:
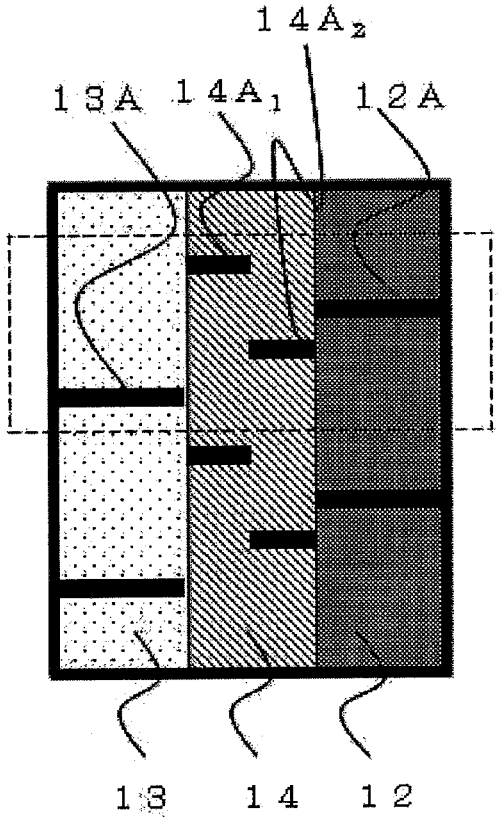
FIG. 11 is a view showing the structure of the outline portion formed from a plurality of outline elements.
Figure 12:
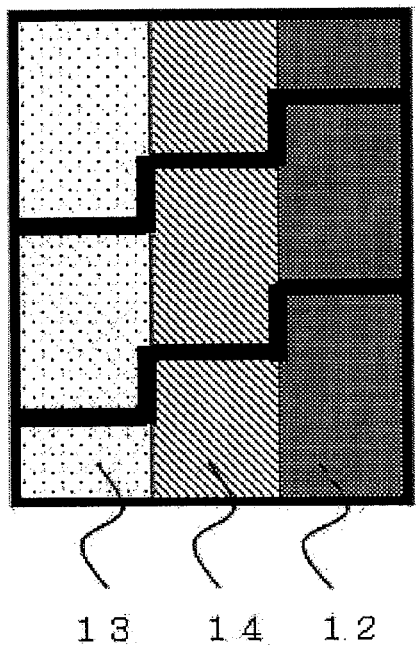
FIG. 12 is a view showing an example in which the first pattern is formed by connecting the elements.

Each outline element (14A) may be divided into a plurality of parts, as shown in FIG. 11. FIG. 11 shows an example in which two outline elements (14A) are arranged. In this case, a plurality of outline elements (14$A_1$) and (14$A_2$) are arranged in phases different from those of the latent image element (12A) and the background element (13A). In addition, the outline element (14$A_1$) and the outline element (14$A_2$) are arranged in different phases.

The latent image element (12A), the background element (13A), and the outline element (14A) described above may be connected, as shown in FIG. 12.

(Method of Working First Elements)

To form the first elements (11) having a concave shape or the convex shape, embossing, watermarking, laser machining, printing by ink, or the like is usable. Note that when using watermarking, laser machining, or ink, the first elements (11) need to be formed before formation of the second elements (21). If the first elements (11) are formed after formation of the second elements (21), the second elements (21) cannot be formed on the surface with a concave shape or a convex shape.

(Second Pattern)

Figure 13:
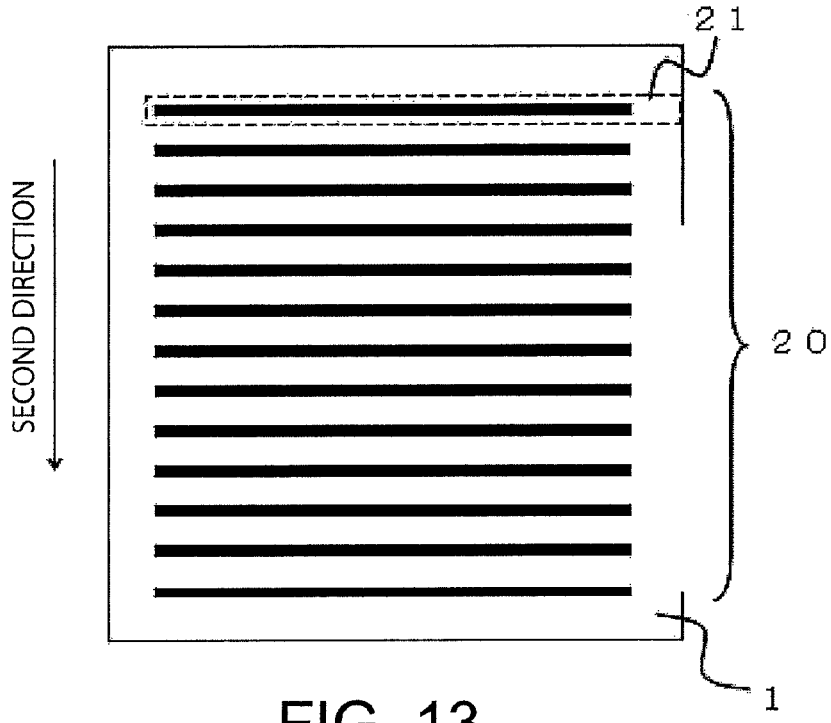
FIG. 13 is a view showing the second pattern.

As shown in FIG. 13, the second pattern (20) is formed by arranging a plurality of second elements (21) on the substrate (1) in the second direction. Note that the second element (21) is formed from an image line or a plurality of pixels, like the first element (11) shown in FIG. 6 or 7. Hence, a description of the same structure as that of the first element (11) will be omitted. The second element (21) has a second pitch ($P_2$), an image line width ($W_2$), a pixel height ($W_2$), a pixel width ($X_2$), and a pixel pitch ($p_2$). Note that the second element (21) may be formed from an image line or pixels different from those of the first element (11). An image line structure of Japanese Patent No. 3368327 may be adopted so as to make the second element (21) have a portion formed from one image line and a portion formed from three image lines, which have the same percent image line area per unit length.

The second pitch ($P_2$) is substantially the same as the first pitch ($P_1$). A pitch in a range of 4/5 to 6/5 the first pitch ($P_1$) is defined as the substantially same. The second pitch ($P_2$) is preferably the same as the first pitch ($P_1$). If the first pitch ($P_1$) equals the second pitch ($P_2$), the first elements (11) and the second elements (21) always overlap at a predetermined interval. For this reason, the motif of the latent image formed from the latent image portion, the background portion, and the outline portion (to be described later) is easy to visually recognize.

Each of the image line width ($W_2$) and the pixel height ($W_2$) of the second element (21) is larger than at least 10 μm, and the upper limit is 9/10 the first pitch ($P_1$). If the image line width ($W_2$) and the pixel height ($W_2$) of the second element (21) are larger than 9/10 the first pitch ($P_1$), the second element (21) overlaps the latent image element (12A), the background element (13A), and the outline element (14A). Since no contract is obtained, the latent image cannot be observed. In addition, if the image line width ($W_2$) and the pixel height ($W_2$) of the second element (21) are smaller than 10 μm, the overlap area between the first element (11) and the second element (21) is small, and the visibility of the latent image lowers.

The pixel width ($X_2$) of the second element (21) falls within the range of 1,000 μm or less, like the pixel width ($X_1$) of the first element (11) formed from pixels. Note that the pixel width ($X_2$) of the second element (21) can be either equal to or different from the pixel width ($X_1$) of the first element (10).

The pixel pitch ($p_2$) of the second element (21) is adjusted based on the pixel width ($X_2$) as needed such that the second element (21) is observed as an image line, like the pixel pitch ($p_1$) of the first element (11) formed from pixels.

Each second element (21) may be formed by compositing the image line structure and pixel structure described above. Alternatively, the plurality of second elements (21) may separately include the image line, the pixels, or the composite thereof.

An example in which the second element (21) is formed from a straight line will be described below.

Figure 14:
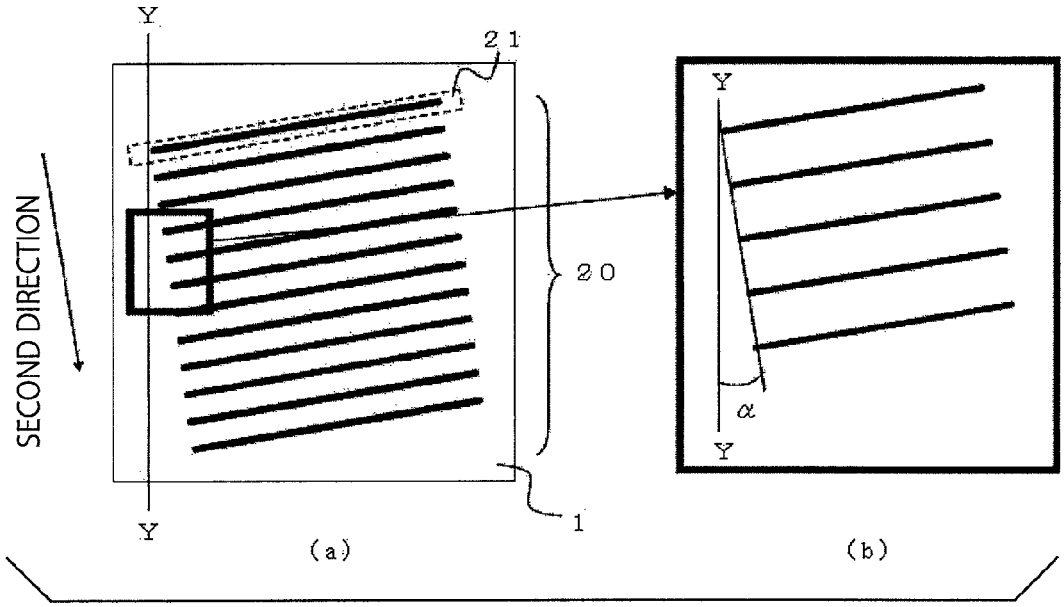
FIG. 14 shows views of the second pattern that tilts with respect to the first pattern.

Note that in this explanation, the "second direction" is the direction in which the second elements (21) are arranged. In the latent image pattern formed body (2) of the present invention, the first direction and the second direction can be the same, or the second direction may be different from the first direction. FIG. 14(*a*) shows an example of the second pattern (20) formed from the plurality of second elements (21) arranged in the second direction that is different from the first direction.

In this case, the second elements (21) tilt with respect to a line Y-Y representing the direction in which the first elements (11) are arranged, as shown in the enlarged view of FIG. 14(*b*). A tilt angle (α) of the second elements (21) with respect to the first elements (11) ranges from ±0.5° to ±3°. The tilt angle (α) of the second elements (21) with respect to the first elements (11) preferably ranges from ±0.5° to ±1.5°. This is because the motif of the latent image can easily be visually recognized when the tilt angle (α) of the second elements (21) with respect to the first elements (11) is small.

To observe the motif of the latent image, the second pattern (20) needs to overlap the latent image portion (12) and the outline portion (14) of the first pattern (10). Preferably, the second pattern (20) overlap the entire first pattern (10).

The color of the second pattern (20) need only be different from that of the substrate (1), and is not particularly limited.

To form the second pattern (20), a known printing method such as offset printing, gravure printing, or inkjet printing, laser machining, or the like is usable. Note that when using printing, the second elements (21) are formed by ink. When using laser machining, the second elements (21) are formed by changing the color of the substrate (1) by a laser beam.

(Arrangement of First Pattern and Second Pattern)

An arrangement of the first pattern (10) and the second pattern (20) and a latent image to be observed will be described below. The latent image observation principle of the present invention will be explained first.

The state of the second elements (21) visually recognized by observing the substrate (1) on which the first elements (11) having a convex shape and the second elements (21) having a color different from that of the substrate (1) are formed will be described with reference to FIGS. 15 to 19.

Figure 15:
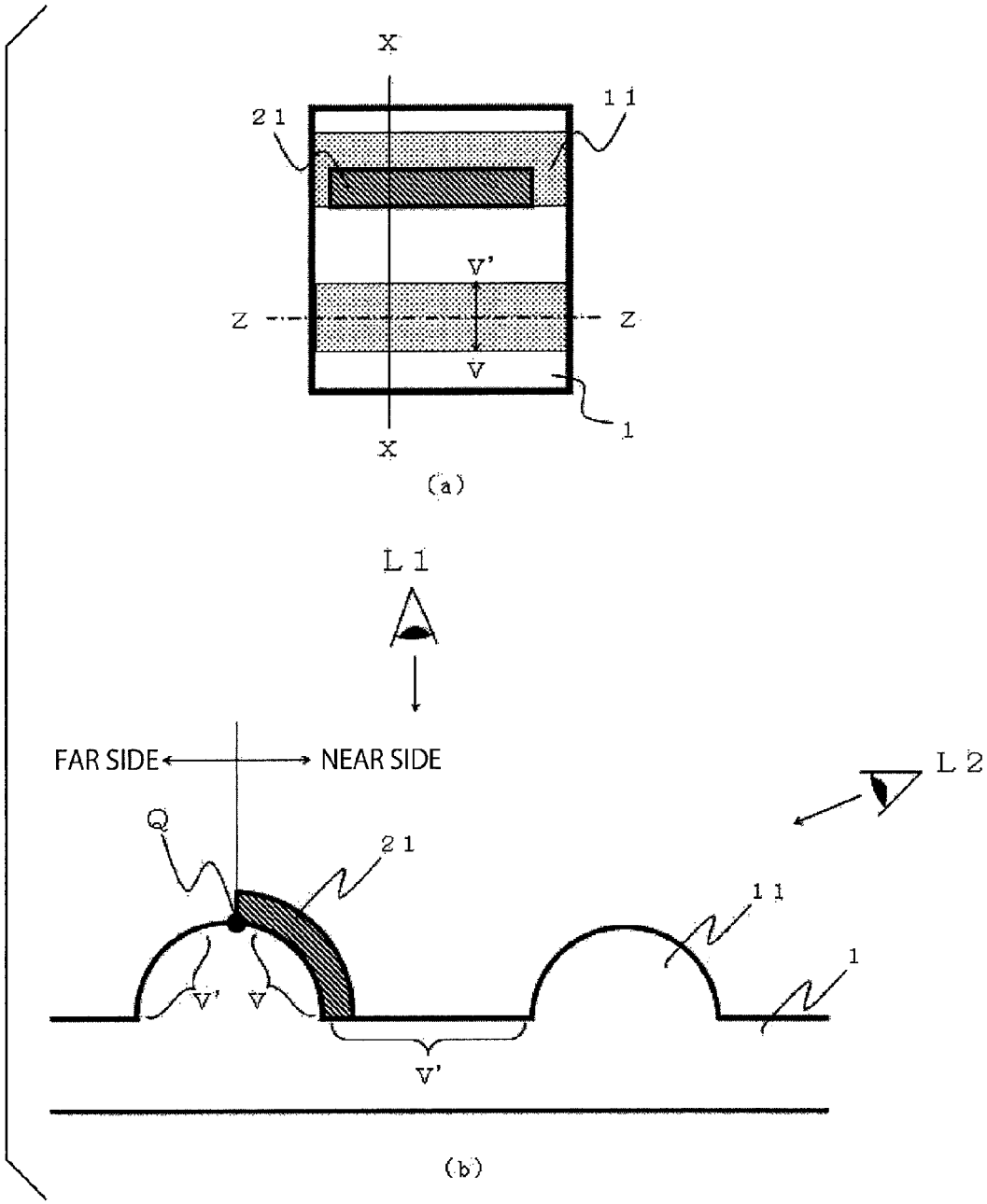
FIG. 15 shows views of an example of the arrangement of the first element and the second element.

FIG. 15(*a*) is a partially enlarged plan view showing an example of a state in which the first element (11) having a semicircular convex shape shown in FIG. 4(*a*) and the second element (21) are arranged while overlapping each other. Note that a line Z-Z indicates the position of the vertex of the convex shape. In the present invention, the "vertex of the convex shape" means the highest point of the near-side surface of the convex shape when the substrate (1) is observed from the oblique direction.

In the arrangement shown in FIG. 15(*a*), the second element (21) overlaps the half of the surface of the convex shape from the vertex of the convex shape.

FIG. 15(*b*) is a sectional view taken along a line X-X in FIG. 15(*a*). Referring to FIG. 15(*b*), an observation point (L1) represents the position of the viewpoint to observe the substrate (1) from right above. An observation point (L2) represents the position of the viewpoint for observation from a direction perpendicular to the first elements (11) parallelly arranged in FIG. 15(*a*) and from the oblique direction with respect to the substrate (1). The vertex of the convex shape represented by the line Z-Z is indicated by (Q). As shown in FIG. 15(*a*), the second element (21) overlaps the half of the first element (11) having the convex shape.

In this case, when observed from right above the substrate (1) at the observation point (L1), the second element (21) can visually be recognized, and its color can be observed.

On the other hand, when the substrate (1) is observed from the oblique direction at the observation point (L2), the surface of the convex shape on the near side of its vertex (Q) can be observed. However, the far-side surface that is on the back side of the convex shape cannot be observed because it exists in the blind spot. The flat portion of the substrate (1) cannot be observed in principle because it is in the blind spot behind the convex shape. However, especially the portion close to the surface of the convex shape on the near side of its vertex (Q) may be observed depending on the shape, the first pitch ($P_1$), and the image line width ($W_1$) of the first element (11). The observable range of the surface of the convex shape on the near side of its vertex (Q) also slightly changes depending on the shape, the first pitch ($P_1$), and the image line width ($W_1$) of the first element (11). In the following explanation, assume that only the surface of the convex shape on the near side of its vertex (Q) is observed. The description will be made while defining the surface of the convex shape on the near side of its vertex (Q) when the substrate (1) is observed from the oblique direction as an "observation portion (V)", and the surface of the convex shape on the far side of its vertex (Q) and the flat portion of the substrate (1) when the substrate (1) is observed from the oblique direction as "non-observation portions (V')". FIG. 15(*b*) is a sectional view taken along the line X-X in FIG. 15(*a*). The observation portion (V) and the non-observation portions (V') shown in FIG. 15(*b*) are on the line X-X in FIG. 15(*a*). Actually, the observation portion (V) and the non-observation portions (V') are separated at a line that connects the vertices (Q) of the convex shape at predetermined positions of one first element (11) in the full range, that is, the line Z-Z.

When the first elements (11) have the structure shown in FIG. 4(*c*), the ranges of the observation portion (V) and the non-observation portion (V') change. This will be described next.

Figure 16:
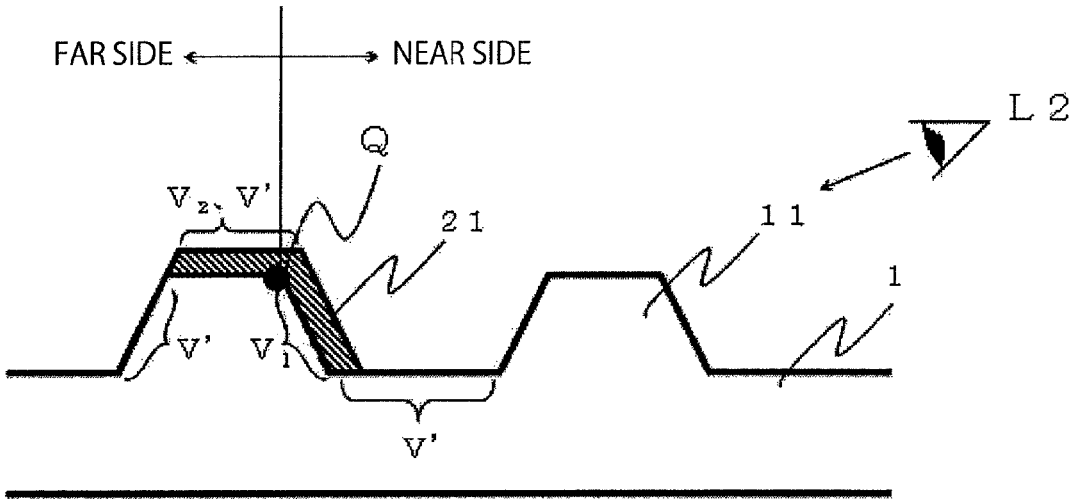
FIG. 16 is a view showing the observation portions and the non-observation portions of the first element formed into a convex shape.

FIG. 16 is a sectional view showing an arrangement in which the second elements (21) overlap the substrate (1) on which the first elements (11) shown in FIG. 4(*c*) are formed. At this time, when the substrate (1) is observed from the oblique direction, the second element (21) formed on a near-side surface ($V_1$) of the convex shape and an upper surface ($V_2$) of the convex shape can be observed. However, the second element (21) formed on the upper surface ($V_2$) of the convex shape is less visible and less affects the visibility of the motif of the latent image than the second element (21) formed on the near-side surface ($V_1$) of the convex shape. For this reason, the latent image is actually observed based on the second element (21) overlapping the near-side surface ($V_1$) of the convex shape. Hence, the observation portion (V) of the first element (11) shown in FIG. 4(*c*) is the near-side surface ($V_1$) of the convex shape when observed from the oblique direction. As shown in FIG. 16, the vertex (Q) is located at the highest portion of the surface observed when the substrate (1) is observed from the oblique direction, as described above. The range of the non-observation portion (V') of the first element (11) shown in FIG. 4(*c*) includes the surface of the convex shape on the far side of the vertex (Q), the upper surface ($V_2$) of the convex shape, and the flat portion of the substrate (1).

In the first element (11) separated into the observation portion (V) and the non-observation portion (V'), when the second element (21) overlaps the observation portion (V) of the first element (11), as shown in FIG. 15, the color of the second element (21) can be observed upon observation from the oblique direction. When the second element (21) does not overlap the observation portion (V) of the first element (11), that is, when the second element (21) overlaps the far-side surface of the convex shape (not shown), or the second element (21) overlaps the flat portion of the substrate (1) (not shown), the color of the second element (21) cannot be observed.

Figure 17:
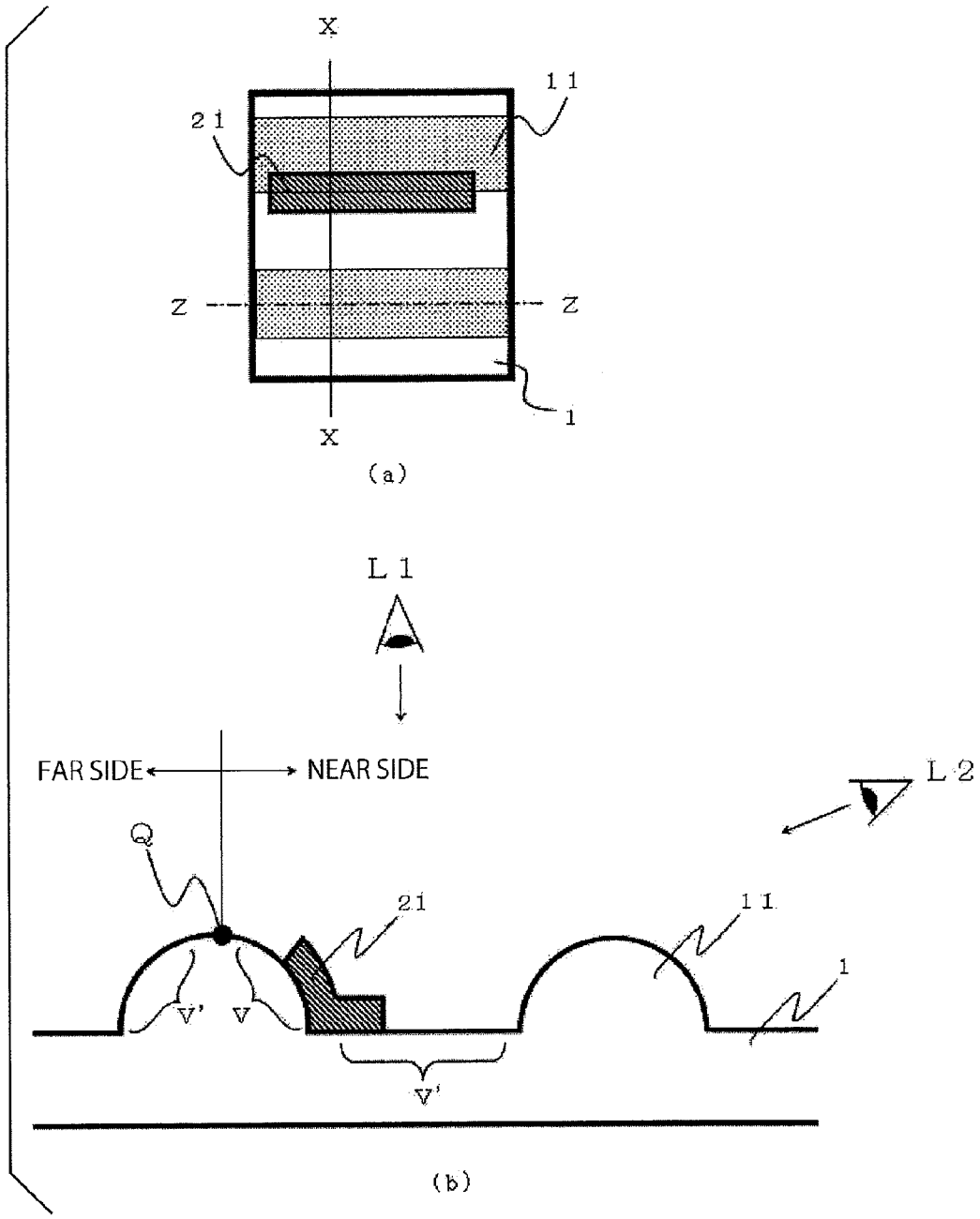
FIG. 17 shows views of an example of the arrangement of the first element and the second element.

An arrangement of the first element (11) and the second element (21) which is different from that shown in FIG. 15 will be described next. FIG. 17 shows views of an example of the arrangement of the first element (11) and the second element (21) which is different from that shown in FIG. 15.

In the arrangement shown in FIG. 17(*a*), the second element (21) overlaps substantially ½ the observation portion (V) of the convex shape and the flat portion of the substrate (1).

FIG. 17(*b*) is a sectional view taken along a line X-X in FIG. 17(*a*). In this case, the color of the second element (21) can be observed only at the portion where the second element (21) overlaps the observation portion (V) of the convex shape. However, that portion is observed in a light color because the overlap area of the second element (21) on the observation portion (V) of the convex shape is smaller than that in the arrangement of FIG. 15. In addition, the second element (21) overlapping the flat portion of the substrate (1) cannot be observed because it is in the blind spot behind the convex shape.

The present invention uses the above-described observation principle. Since the latent image element (12A), the background element (13A), and the outline element (14A) of the first pattern (10) are arranged in different phases, the elements of the first element (11) overlap the second element (21) in different ways. As a result, the visibility of the second element (21) changes upon observation from the oblique direction so that the latent image can be observed.

Figure 18:
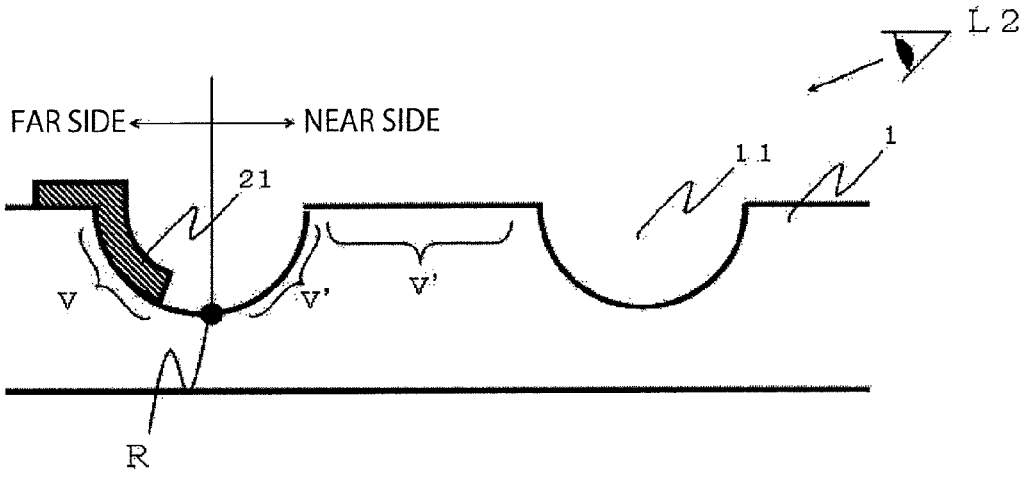
FIG. 18 is a view showing the observation portions and the non-observation portions of the first element formed into a concave shape.

An example in which the first element (11) has a convex shape has been described above. A case in which the first element (11) has a semicircular concave shape shown in FIG. 5(*a*) will be described next. In this case, when the substrate (1) is observed from the oblique direction at the observation point (L2), as shown in FIG. 18, the surface of the concave shape on the far side of a bottom point (R) can be observed. However, the near-side surface of the concave shape cannot be observed because it exists in the blind spot. Note that in the present invention, the "bottom point (R) of the concave shape" means the lowest point of the surface observed when the substrate (1) is observed from the oblique direction. When the substrate (1) is observed from the oblique direction, the flat portion of the substrate (1) can also be observed. However, the second element (21) formed on the flat portion of the substrate (1) is less visible and less affects the visibility of the motif of the latent image than the second element (21) formed on the surface of the concave shape on the far side of its bottom point (R). For this reason, the latent image is actually observed based on the second element (21) overlapping the surface of the concave shape on the far side of its bottom point (R). Hence, the following explanation will be made while defining the surface of the concave shape on the far side of its bottom point (R) as the "observation portion (V)", and the surface of the concave shape on the near side of its bottom point (R) and the flat portion of the substrate (1) when the substrate (1) is observed from the oblique direction as the "non-observation portions (V')". FIG. 18 is a sectional view of the first element (11) at a predetermined position, and illustrates the observation portion (V) and the non-observation portions (V') at that position. Actually, the observation portion (V) and the non-observation portions (V') are separated at a line that connects the bottom points (R) of the concave shape at predetermined positions of one first element (11) in the full range. Even when the first element (11) has the concave shape, the ranges of the observation portion (V) and the non-observation portion (V') slightly change depending on the shape, the first pitch ($P_1$), and the image line width ($W_1$) of the first element (11). As described above, even when the first element (11) has the concave shape, the observation portion (V) and the non-observation portion (V') can be provided. Since the observation portions (V) of the latent image element (12A), the background element (13A), and the outline element (14A) overlap the second element (21) in different ways. It is therefore possible to observe the motif of the latent image.

When the first elements (11) have the structure shown in FIG. 5(*c*), the ranges of the observation portion (V) and the non-observation portion (V') change. This will be described next.

Figure 19:
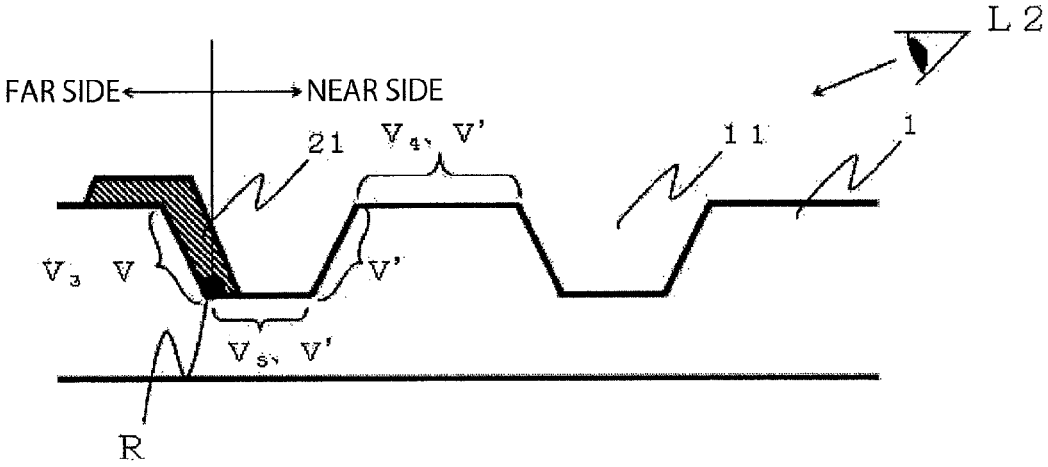
FIG. 19 is a view showing the observation portions and the non-observation portions of the first element formed into a concave shape.

FIG. 19 is a sectional view of the substrate (1) in which the first elements (11) shown in FIG. 5(*c*) are formed. At this time, when the substrate (1) is observed from the oblique direction, a far-side surface ($V_3$) of the concave shape and a flat portion ($V_4$) of the substrate can be observed. However, the second element (21) formed on the flat portion ($V_4$) of the substrate is less visible and less affects the visibility of the motif of the latent image than the second element (21) formed on the far-side surface ($V_3$) of the concave shape. For this reason, the latent image is actually observed based on the second element (21) overlapping the far-side surface ($V_3$) of the concave shape. In addition, the near-side surface of the concave shape and a bottom surface ($V_5$) of the concave shape cannot be observed because they are in the blind spot of the substrate (1). Hence, the observation portion (V) of the first element (11) shown in FIG. 5(*c*) is the far-side surface ($V_3$) of the concave shape when the substrate (1) is observed from the oblique direction. As shown in FIG. 19, the bottom point (R) is located at the lowest portion of the surface observed when the substrate (1) is observed from the oblique direction, as described above. The range of the non-observation portion (V') of the first element (11) shown in FIG. 19 includes the surface of the concave shape on the near side of the bottom point (R), the bottom surface ($V_5$) of the concave shape, and the flat portion ($V_4$) of the substrate.

The latent image observation principle and the ranges of the observation portion (V) and the non-observation portion (V') according to the present invention have been described above. Examples will be explained below in which the first element (11) has a semicircular convex shape shown in FIG. 4(*a*).

A detailed arrangement of the first element (11) and the second element (21) and a motif to be observed will be described next. Note that the arrangement of the first pattern (10) and the second pattern (20) in which the first pitch ($P_1$) equals the second pitch ($P_2$), and a motif to be observed will be described. In any arrangement, the second element (21) can be observed when observed from right above at the observation point (L1), and a description thereof will be omitted. The motif of the latent image to be observed upon observation from the lower side of the drawings with respect to the substrate (1) and from the oblique direction with respect to the substrate (1) will be explained. In each drawing showing the arrangement of the first element (11) and the second element (21) to be described below, the observation portion (V) corresponds to the lower half of each illustrated element, and the non-observation portion (V') corresponds to the upper half of each illustrated element.

Figure 20:
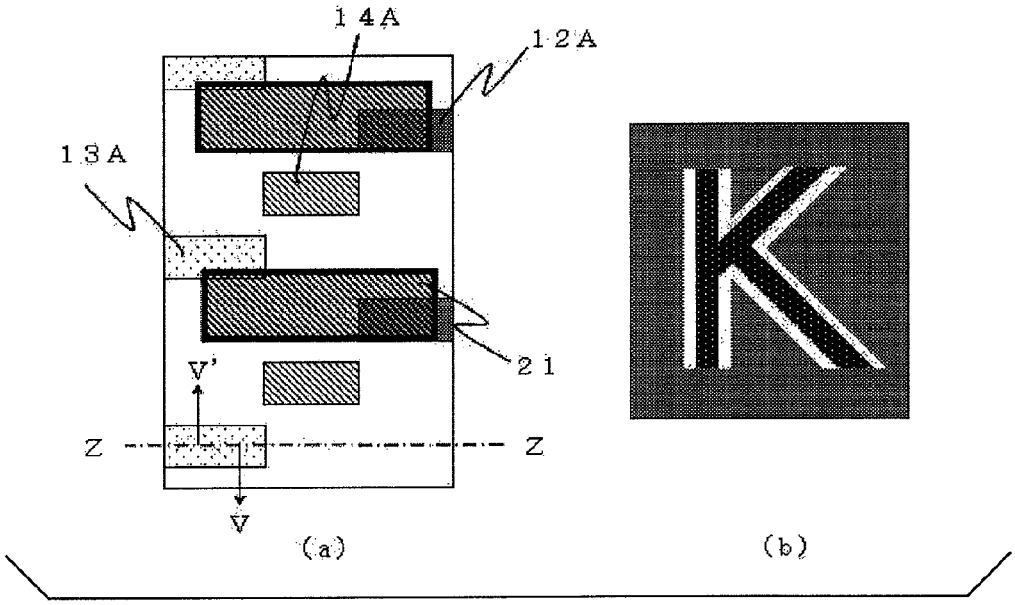
FIG. 20 shows views of a first arrangement and a latent image upon observation from an oblique direction.

In the first arrangement, the second element (21) overlaps at least part of the observation portion (V) of the latent image element (12A) and at least part of the observation portion (V) of the background element (13A) but not the observation portion (V) of the outline element (14A). In this case, the elements are arranged such that the area ratio of the second element (21) overlapping the observation portion (V) of the latent image element (12A) is different from that of the second element (21) overlapping the observation portion (V) of the background element (13A). FIG. 20(*a*) shows an example of this arrangement.

FIG. 20(*a*) illustrates a state in which the second element (21) overlaps the entire latent image element (12A) and part of the observation portion (V) of the background element (13A) but not the outline element (14A). FIG. 20(*a*) also illustrates a state in which the area ratio of the second element (21) overlapping the observation portion (V) of the background element (13A) is smaller than that of the second element (21) overlapping the observation portion (V) of the latent image element (12A).

The latent image pattern formed body (2) of the first arrangement shown in FIG. 20(*a*) is observed from the oblique direction. Since the second element (21) overlaps the observation portion (V) of the latent image element (12A) and the observation portion (V) of the background element (13A), the latent image portion (12) and the background portion (13) are observed in the color of the second element (21). At this time, since the area ratio of the second element (21) overlapping the observation portion (V) of the background element (13A) is smaller than that of the second element (21) overlapping the observation portion (V) of the latent image element (12A), the background portion (13) is observed at a density lower than that of the latent image portion (12). As a result, the latent image shown in FIG. 20(*b*) is observed, and the outline portion (14) is observed as hollow.

Figure 21:
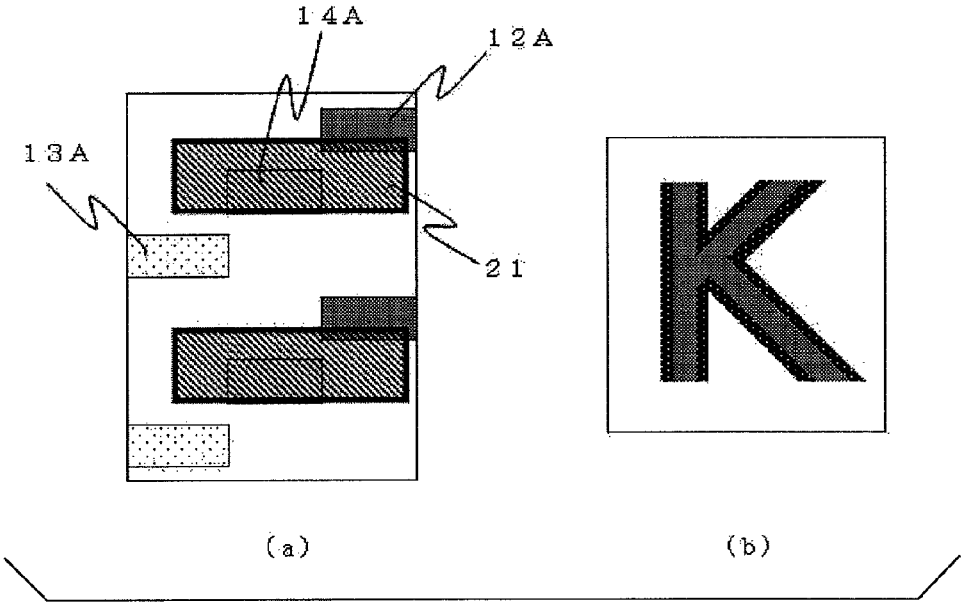
FIG. 21 shows views of a second arrangement and a latent image upon observation from an oblique direction.

In the second arrangement, the second element (21) overlaps at least part of the observation portion (V) of the outline element (14A) and at least part of the observation portion (V) of the latent image element (12A) but not the observation portion (V) of the background element (13A). In this case, the elements are arranged such that the area ratio of the second element (21) overlapping the observation portion (V) of the outline element (14A) is different from that of the second element (21) overlapping the observation portion (V) of the latent image element (12A). FIG. 21(*a*) shows an example of this arrangement.

FIG. 21(*a*) illustrates a state in which the second element (21) overlaps the entire outline element (14A) and part of the observation portion (V) of the latent image element (12A) but not the background element (13A). FIG. 21(*a*) also illustrates a state in which the area ratio of the second element (21) overlapping the observation portion (V) of the latent image element (12A) is smaller than that of the second element (21) overlapping the observation portion (V) of the outline element (14A).

The latent image pattern formed body (2) of the second arrangement shown in FIG. 21(*a*) is observed from the oblique direction. Since the second element (21) overlaps the observation portion (V) of the latent image element (12A) and the observation portion (V) of the outline element (14A), the latent image portion (12) and the outline portion (14) are observed in the color of the second element (21). At this time, since the area ratio of the second element (21) overlapping the observation portion (V) of the latent image element (12A) is smaller than that of the second element (21) overlapping the observation portion (V) of the outline element (14A), the latent image portion (12) is observed at a density lower than that of the outline portion (14). As a result, the motif and outline of the latent image shown in FIG. 21(*b*) are observed.

Figure 22:
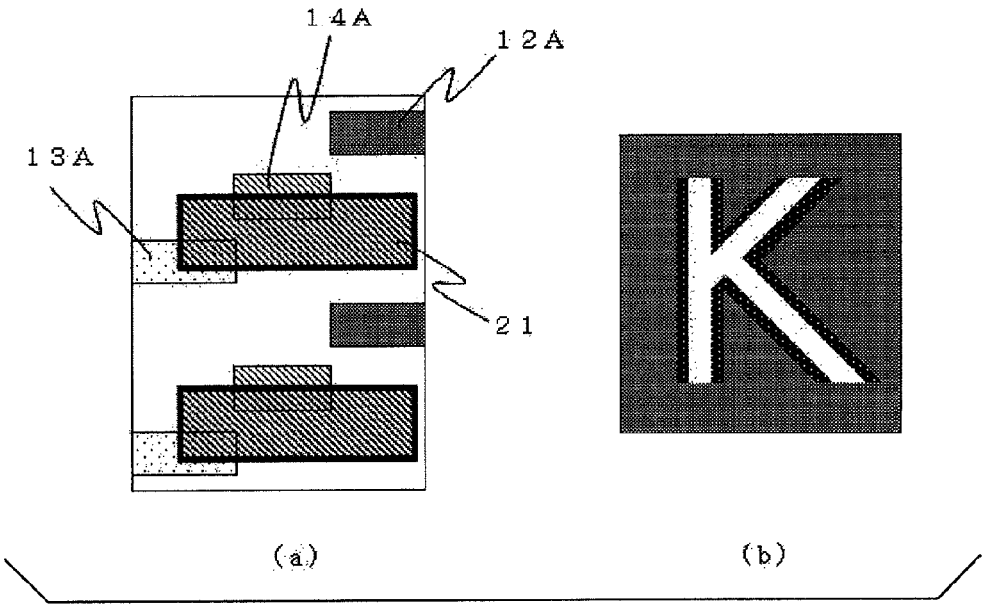
FIG. 22 shows views of a third arrangement and a latent image upon observation from an oblique direction.

In the third arrangement, the second element (21) overlaps at least part of the observation portion (V) of the outline element (14A) and at least part of the observation portion (V) of the background element (13A) but not the observation portion (V) of the latent image element (12A). In this case, the elements are arranged such that the area ratio of the second element (21) overlapping the observation portion (V) of the outline element (14A) is different from that of the second element (21) overlapping the observation portion (V) of the background element (13A). FIG. 22(*a*) shows an example of this arrangement.

FIG. 22(*a*) illustrates a state in which the second element (21) overlaps the entire observation portion (V) of the outline element (14A) and part of the observation portion (V) and the entire non-observation portion (V') of the background element (13A) but not the latent image element (12A). FIG. 22(*a*) also illustrates a state in which the area ratio of the second element (21) overlapping the observation portion (V) of the background element (13A) is smaller than that of the second element (21) overlapping the observation portion (V) of the outline element (14A).

The latent image pattern formed body (2) of the third arrangement shown in FIG. 22(*a*) is observed from the oblique direction. Since the second element (21) overlaps the observation portion (V) of the background element (13A) and the observation portion (V) of the outline element (14A), the background portion (13) and the outline portion (14) are observed in the color of the second element (21). At this time, since the area ratio of the second element (21) overlapping the observation portion (V) of the background element (13A) is smaller than that of the second element (21) overlapping the observation portion (V) of the outline element (14A), the background portion (13) is observed at a density lower than that of the outline portion (14). As a result, the motif and outline of the latent image shown in FIG. 22(*b*) are observed.

Figure 23:
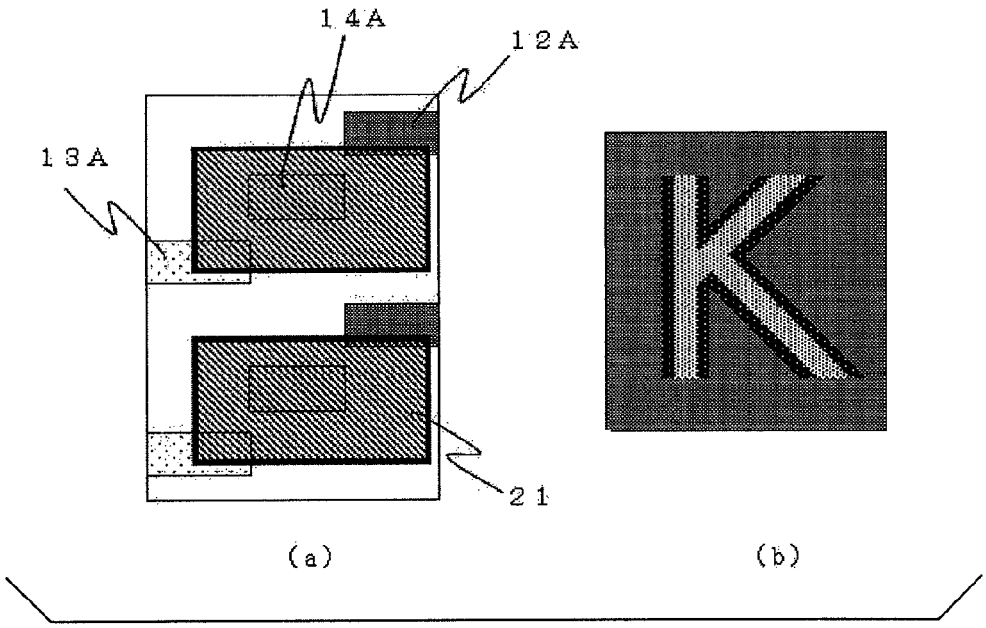
FIG. 23 shows views of a fourth arrangement and a latent image upon observation from an oblique direction.

In the fourth arrangement, the second element (21) overlaps at least part of the observation portion (V) of the latent image element (12A), at least part of the observation portion (V) of the background element (13A), and at least part of the observation portion (V) of the outline element (14A). In this case, the elements are arranged such that the area ratio of the second element (21) overlapping the observation portion (V) of the latent image element (12A) and the area ratio of the second element (21) overlapping the observation portion (V) of the background element (13A) are different from that of the second element (21) overlapping the observation portion (V) of the outline element (14A). Note that the area ratio of the second element (21) overlapping the observation portion (V) of the latent image element (12A) may be equal to or different from that of the second element (21) overlapping the observation portion (V) of the background element (13A). FIG. 23(*a*) shows an example of this arrangement.

FIG. 23(*a*) illustrates a state in which the second element (21) overlaps part of the observation portion (V) of the latent image element (12A), part of the observation portion (V) and the entire non-observation portion (V') of the background element (13A), and the entire outline element (14A).

FIG. 23(*a*) also illustrates a state in which the area ratio of the second element (21) overlapping the observation portion (V) of the latent image element (12A) is smaller than that of the second element (21) overlapping the observation portion (V) of the background element (13A).

The latent image pattern formed body (2) of the fourth arrangement shown in FIG. 23(*a*) is observed from the oblique direction. Since the second element (21) overlaps the observation portion (V) of the latent image element (12A), the observation portion (V) of the background element (13A), and the observation portion (V) of the outline element (14A), the latent image portion (12), the background portion (13), and the outline portion (14) are observed in the color of the second element (21). At this time, since the overlap area ratio of the second element (21) becomes smaller in the order of the outline element (14A), the background element (13A), and the latent image element (12A), the density lowers in the order of the outline portion (14), the background portion (13), and the latent image portion (12), and the latent image portion is observed, as shown in FIG. 23(*b*).

In the first embodiment, as described concerning the first to fourth arrangements, the elements are arranged such that the second element (21) overlaps the observation portions (V) of the outline element (14A), the latent image element (12A), and the background element (13A) in different ways to change the color at the time of visual recognition. This allows to observe a latent image having the outline portion (13).

Figure 24:
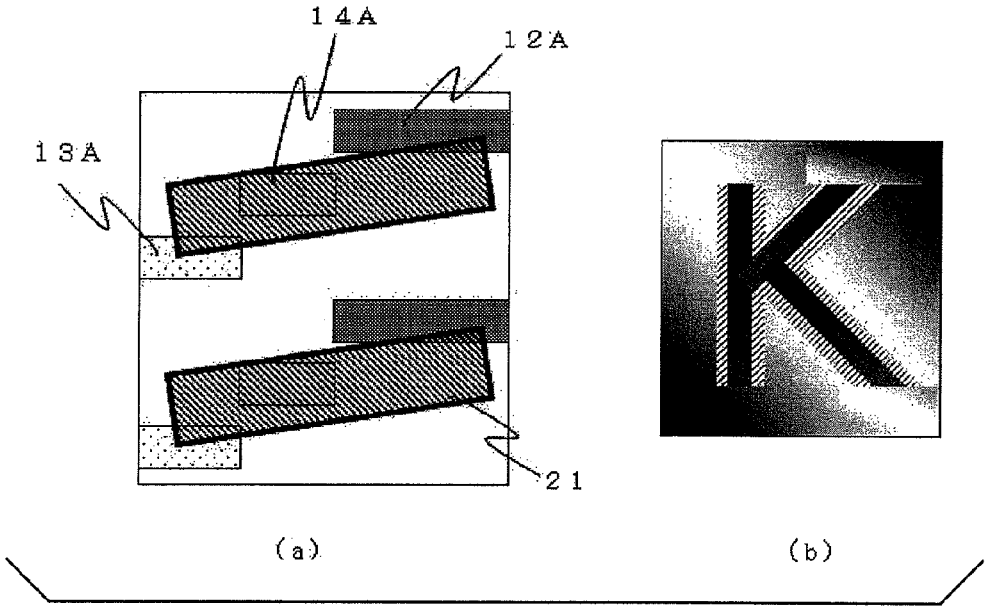
FIG. 24 shows views of a state in which the second element is tilted and a latent image observed upon observation from the oblique direction.

Note that when the second pattern (20) tilts with respect to the first pattern (10), the overlap area ratio of the second element (21) changes even between the identical latent image elements (12A), between the identical background elements (13A), and between the identical outline elements (14A), as shown in FIG. 24(*a*) to change the color at the time of visual recognition. This allows to observe a latent image having a gradation pattern shown in FIG. 24(*b*). When the second pattern (20) tilts with respect to the first pattern (10), a latent image having a gradation pattern is observed even in the second and third embodiments to be described later.

When the first pitch ($P_1$) and the second pitch ($P_2$) are different (not shown), the overlap area ratio of the second element (21) partially changes even between the identical latent image elements (12A), between the identical background elements (13A), and between the identical outline elements (14A) to change the color at the time of visual recognition. This allows to observe a latent image having a moiré pattern (not shown). When the first pitch ($P_1$) and the second pitch ($P_2$) are different, a latent image having a moiré pattern is observed even in the second and third embodiments to be described later.

As described above, in the first embodiment, the outline portions (14) are observed, on the left and right sides of the latent image pattern, in a color different from that of the background portion (13) or the latent image portion (12).

Second Embodiment

Figure 25:
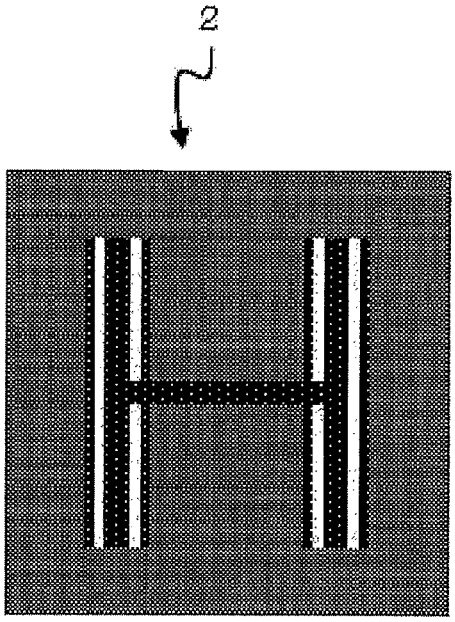
FIG. 25 is a view showing a latent image pattern according to the second embodiment.

The second embodiment provides a latent image pattern formed body (2) in which the outlines on the left and right sides of the motif of the latent image can be observed as double outlines having the same density as that of the latent image portion or the background portion. FIG. 25 shows the latent image pattern formed body (2) in which double outlines having the same density as that of the latent image portion can be observed. Points different from the first embodiment will be described with reference to FIGS. 25 to 38 for the latent image pattern formed body (2) of the second embodiment.

Figure 26:
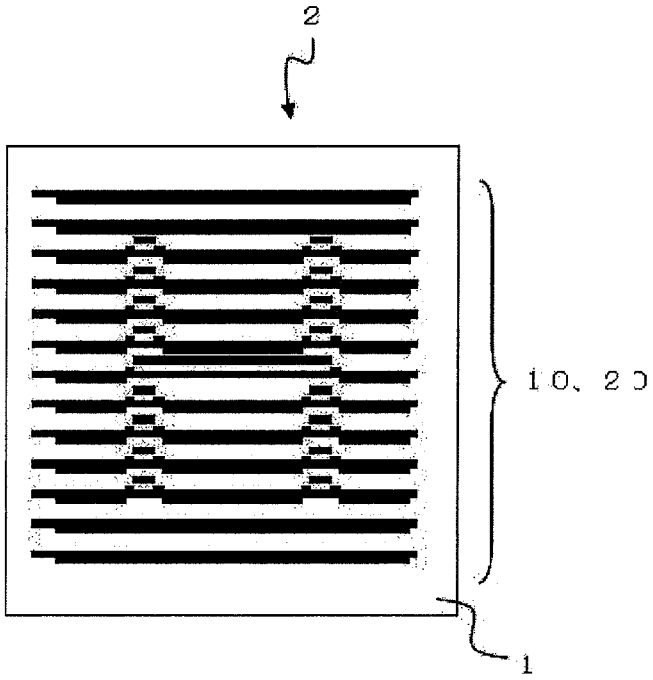
FIG. 26 is a view showing a first pattern and a second pattern that form a latent image pattern formed body.

The latent image pattern formed body (2) of the second embodiment is formed by forming a first pattern (10) and a second pattern (20) on a substrate (1), as shown in FIG. 26.

(First Pattern)

Figure 27:
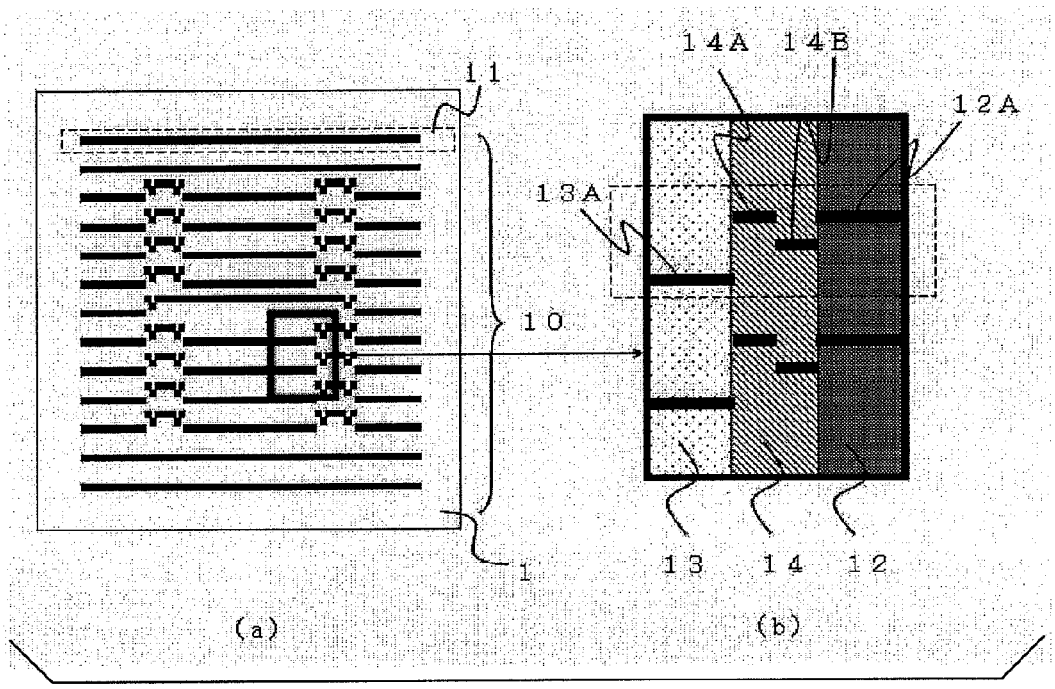
FIG. 27 is a view showing the first pattern.

FIG. 27 shows the first pattern (10) according to the second embodiment. In the second embodiment, the structures of a latent image portion (12) and a background portion (13) of the first pattern (10) are the same as those of the first embodiment, and the structure of an outline portion (14) is different from that of the first embodiment. The structure of the outline portion (14) will be described below.

(Outline Portion)

As shown in the enlarged view of FIG. 27(*b*), the outline portion (14) is formed from an outline element (14A) arranged in the same phase as that of a latent image element (12A), and a first element (to be referred to as an "outline auxiliary element (14B)" hereinafter) arranged between the latent image element (12A) and the outline element (14A) in a phase different from that of the latent image element (12A) and the outline element (14A).

In the second embodiment, double outlines are observed. For this purpose, the outline that appears as a latent image needs to be visually recognized in the same color as that of the latent image portion (12). Hence, the outline element (14A) is arranged in the same phase as that of the latent image element (12A).

To observe the double outlines, the portion between the outline and the latent image needs to be observed in a color different from those of the portions where the latent image element (12A) and the outline element (14A) are formed. For this purpose, the outline auxiliary element (14B) is arranged between the latent image element (12A) and the outline element (14A) in a phase different from that of the latent image element (12A) and the outline element (14A).

Note that in the portion surrounded by a dotted line frame shown in FIG. 27(*b*), the latent image element (12A), a background element (13A), the outline element (14A), and the outline auxiliary element (14B) correspond to each other, as in the first embodiment. Arranging the elements in correspondence with each other means that the elements surrounded by the dotted line frame partially change the phase in a first element (11) formed from one image line, the elements are formed within a range smaller than a first pitch ($P_1$), and each element surrounded by the dotted line frame is arranged not to overlap the adjacent elements.

Figure 28:
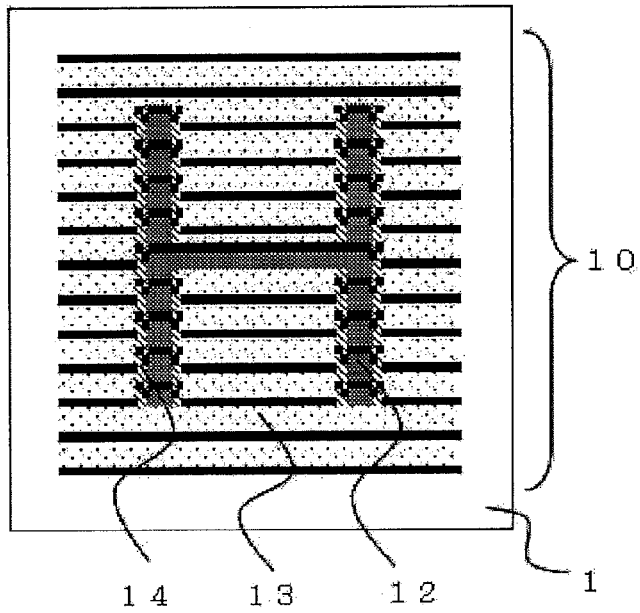
FIG. 28 is a view showing the latent image portion, the background portion, and the outline portion of the first pattern.

With this arrangement, the outline portion (14) formed from the outline element (14A) and the outline auxiliary element (14B) is formed between the latent image portion (12) and the background portion (13). The first pattern (10) separated into the latent image portion (12), the background portion (13), and the outline portion (14) is as shown in FIG. 28. The structure of the outline portion (14) will be explained below in detail.

Figure 29:
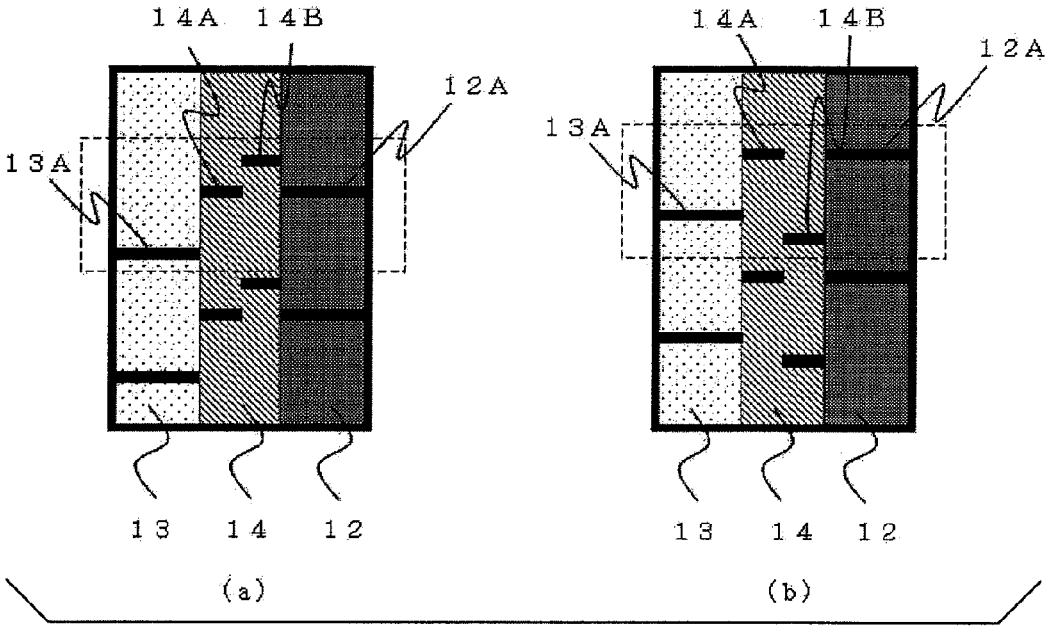
FIG. 29 shows views of the structures of the outline portion.

The outline auxiliary element (14B) need not always be arranged in the phase between the phase of the background element (13A) and that of the latent image element (12A). The outline auxiliary element (14B) may change the phase to the upper side of the latent image element (12A), as shown in FIG. 29(*a*), or the lower side of the background element (13A), as shown in FIG. 29(*b*). In this case, the outline auxiliary element (14B) is arranged within the range of the dotted line frame not to overlap the adjacent elements.

A case in which the outline element (14A) is arranged in the same phase as that of the latent image element (12A) has been described above. However, the outline element (14A) may be arranged in the same phase as that of the background element (13A).

Figure 30:
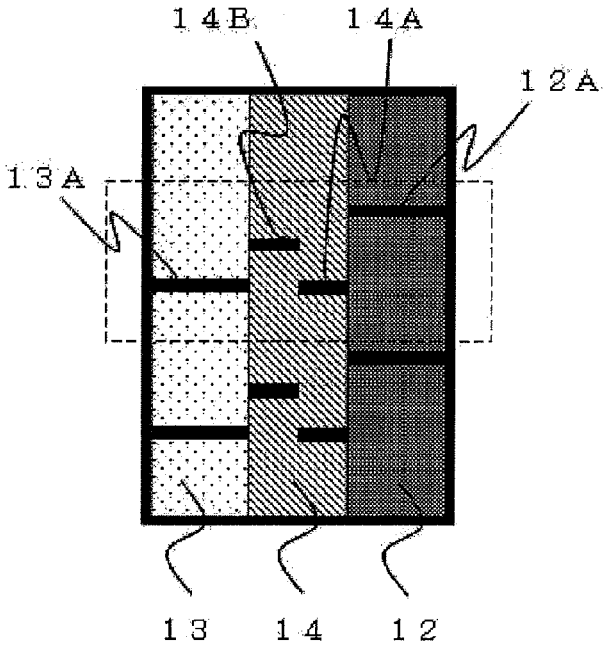
FIG. 30 shows views of the structures of the outline portion.

In this case, as shown in FIG. 30, the outline auxiliary element (14B) is arranged between the outline element (14A) and the background element (13A). The outline auxiliary element (14B) is arranged in a phase different from that of the outline element (14A). At this time, the outline auxiliary element (14B) may be arranged on the upper side of the latent image element (12A) or on the lower side of the background element (13A) (not shown). The elements are arranged in correspondence with each other.

Note that the phases in which the outline element (14A) and the outline auxiliary element (14B) are arranged are the same as described above even when the latent image element (12A) changes the phase to the lower side of the background element (13A). In the following description, the latent image element (12A) changes the phase to the upper side of the background element (13A), and the outline element (14A) is arranged in the same phase as that of the latent image element (12A).

Figure 31:
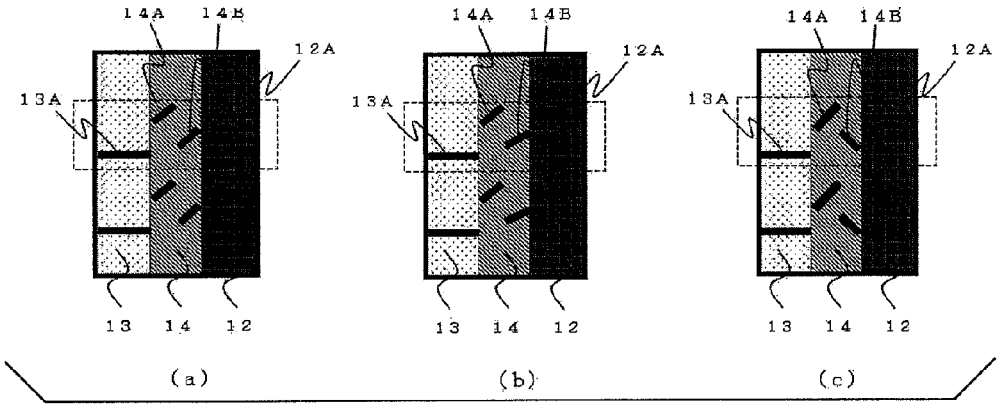
FIG. 31 shows views of the structures of the outline portion.

The outline element (14A) and the outline auxiliary element (14B) may be parallel to the background element (13A) and the latent image element (12A), as shown in FIG. 27(*b*), or tilt with respect to the background element (13A) and the latent image element (12A), as shown in FIG. 31. In this case, however, part of the outline element (14A) is always arranged in the same phase as that of the latent image element (12A). This is because the double outlines can be obtained by arranging the first element (11) in the same phase as that of the latent image element (12A), as described above. Even when the outline auxiliary element (14B) tilts, the outline auxiliary element (14B) is arranged in a phase different from that of the outline element (14A). As described above, the outline auxiliary element (14B) needs to be observed in a color different from those of the latent image element (12A) and the outline element (14A). The outline auxiliary element (14B) may tilt as long as it is arranged in a phase different from those of the latent image element (12A) and the outline element (14A) for that purpose.

When the outline element (14A) and the outline auxiliary element (14B) tilt, the tilt angles of the outline element (14A) and the outline auxiliary element (14B) may be different, as shown in FIG. 31(*b*). Alternatively, the directions of the outline element (14A) and the outline auxiliary element (14B) may be different, as shown in FIG. 31(*c*). Otherwise, one of the outline element (14A) and the outline auxiliary element (14*b*) may tilt.

Figure 32:
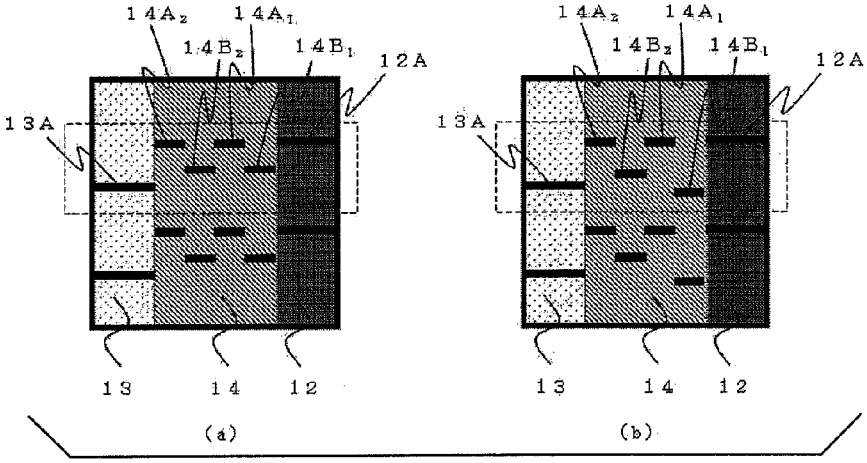
FIG. 32 shows views of the structure of the outline portion formed from a plurality of outline elements and outline auxiliary elements.

A plurality of outline elements (14A) and outline auxiliary elements (14B) may be arranged in each outline portion (14). In this case, the plurality of outline portions (14) are arranged in the same phase as that of the latent image element (12A). The plurality of outline auxiliary elements (14B) are arranged in a phase different from those of the latent image element (12A) and the outline elements (14A). FIG. 32 shows states in which two outline elements (14A) and two outline auxiliary elements (14B) are alternately arranged. To observe outline elements (14$A_1$) as one outline, an outline auxiliary element (14$B_1$) needs to be arranged between each outline element (14$A_1$) and a corresponding latent image element (12A), as described above. To observe outline elements (14$A_2$) as one outline, an outline auxiliary element (14$B_2$) needs to be arranged between each outline element (14$A_2$) and a corresponding outline element (14$A_1$). Note that when arranging a plurality of outline auxiliary elements (14B), the phase may be changed for each outline auxiliary element (14$B_1$, 14$B_2$), as shown in FIG. 32(*b*).

Figure 33:
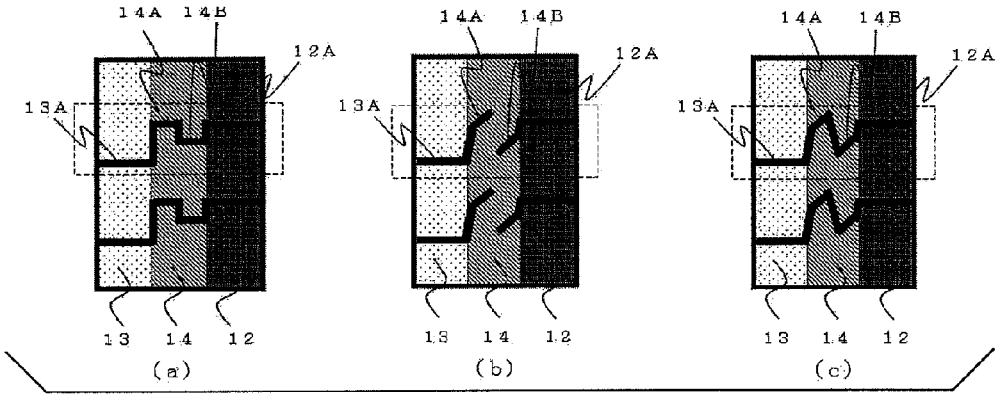
FIG. 33 shows views of an example in which the first pattern is formed by connecting the elements.

The latent image element (12A), the background element (13A), the outline element (14A), and the outline auxiliary element (14B) may be connected, as shown in FIG. 33(*a*). Even when the outline element (14A) and the outline auxiliary element (14B) tilt with respect to the background element (13A) and the latent image element (12A), the background element (13A) may be connected to the outline element (14A), and the outline auxiliary element (14B) may be connected to the latent image element (12A), as shown in FIG. 33(*b*). However, if part of the first element (11) is formed in the same phase as that of the latent image element (12A) by connecting the outline element (14A) and the outline auxiliary element (14B), as shown in FIG. 33(*c*), that portion also appears as the outline, that is, two outlines appear. If the desired number of outlines of the latent image is one, the outline element (14A) and the outline auxiliary element (14B) are not connected.

(Arrangement of First Pattern and Second Pattern and Image to be Observed)

An arrangement of the first pattern (10) and the second pattern (20) and an image to be observed will be described below. Note that arrangements of the first pattern (10) and the second pattern (20) in which the first pitch ($P_1$) equals a second pitch ($P_2$), and a motif to be observed will be described. In the second embodiment, the fifth arrangement will be described first.

Figure 34:
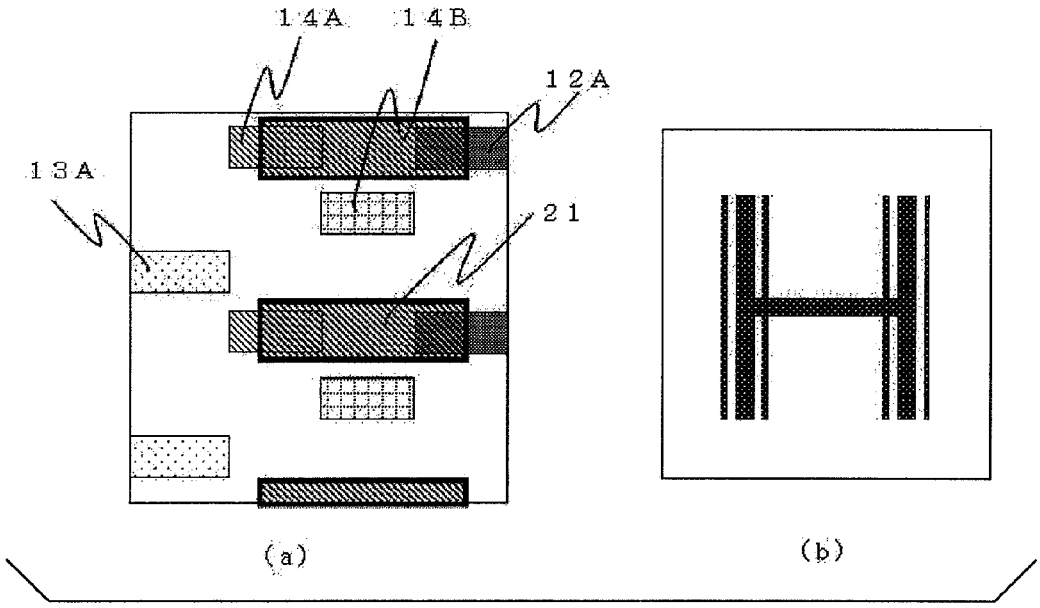
FIG. 34 shows views of a fifth arrangement and a latent image upon observation from an oblique direction.

In the fifth arrangement, a second element (21) overlaps at least part of an observation portion (V) of the outline element (14A), and at least part of the observation portion (V) of the latent image element (12A) arranged in the same phase as that of the outline element (14A) or at least part of the observation portion (V) of the background element (13A) arranged in the same phase as that of the outline element (14A) but not the observation portion (V) of the latent image element (12A) arranged in a phase different from that of the outline element (14A) or the observation portion (V) of the background element (13A) arranged in a phase different from that of the outline element (14A) and the observation portion (V) of the outline auxiliary element (14B). FIG. 34(*a*) shows an example of this arrangement.

FIG. 34(*a*) illustrates a state in which the second element (21) overlaps the entire latent image element (12A) and the entire outline element (14A) but not the background element (13A) and the outline auxiliary element (14B).

The latent image pattern formed body (2) of the fifth arrangement shown in FIG. 34(*a*) is observed from the oblique direction. Since the second element (21) overlaps the observation portions (V) of the latent image element (12A) and the outline element (14A), the latent image portion (12) and the outline portion (14) are observed in the color of the second element (21). As a result, a latent image having double outlines is observed, as shown in FIG. 34(*b*).

Figure 35:
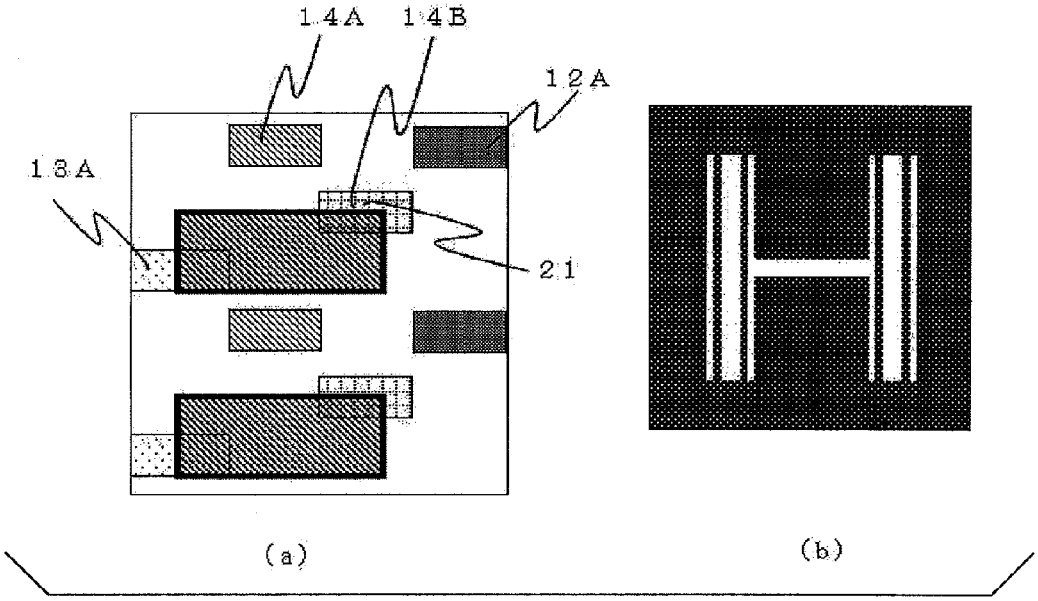
FIG. 35 shows views of a sixth arrangement and a latent image upon observation from an oblique direction.

In the sixth arrangement, the second element (21) overlaps at least part of the observation portion (V) of the outline auxiliary element (14B), and at least part of the observation portion (V) of the latent image element (12A) arranged in a phase different from that of the outline element (14A) or at least part of the observation portion (V) of the background element (13A) arranged in a phase different from that of the outline element (14A) but not the observation portion (V) of the latent image element (12A) arranged in the same phase as that of the outline element (14A) or the observation portion (V) of the background element (13A) arranged in the same phase as that of the outline element (14A) and the observation portion (V) of the outline element (14A). Note that the area ratio of the second element (21) overlapping the outline auxiliary element (14B) may be equal to or different from that of the second element (21) overlapping the observation portion (V) of the latent image element (12A) arranged in a phase different from that of the outline element (14A) or the observation portion (V) of the background element (13A) arranged in a phase different from that of the outline element (14A). FIG. 35(*a*) shows an example of this arrangement.

FIG. 35(*a*) illustrates a state in which the second element (21) overlaps the entire background element (13A) and the entire observation portion (V) of the outline auxiliary element (14B) but not the latent image element (12A) and the outline element (14A). FIG. 35(*a*) also illustrates a state in which the area ratio of the second element (21) overlapping the observation portion (V) of the background element (13A) equals that of the second element (21) overlapping the observation portion (V) of the outline auxiliary element (14B).

The latent image pattern formed body (2) of the sixth arrangement shown in FIG. 35(*a*) is observed from the oblique direction. In this case, a latent image having a negative/positive relationship reverse to that of the latent image of the fifth arrangement is observed, as shown in FIG. 35(*b*).

Figure 36:
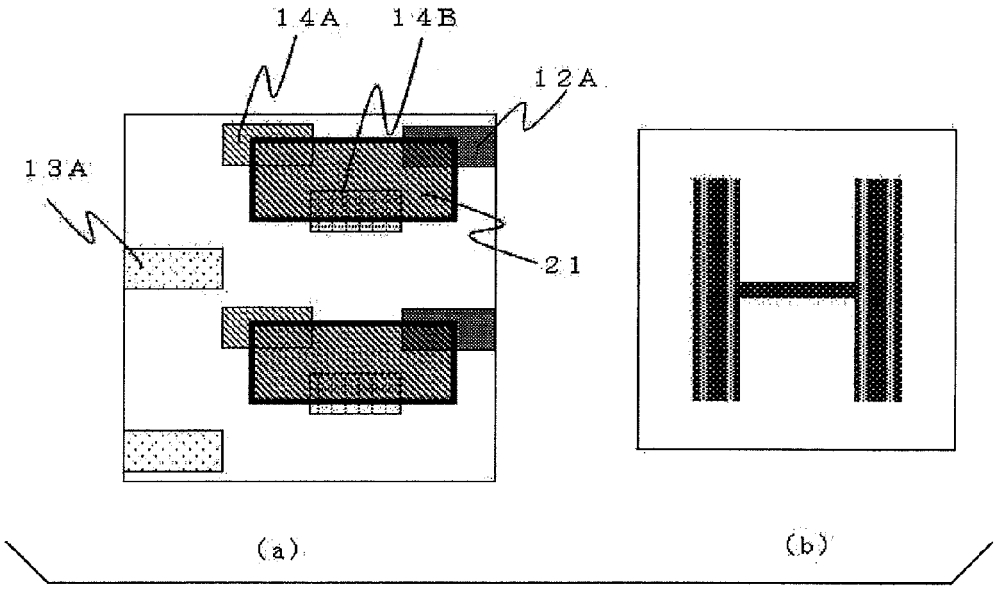
FIG. 36 shows views of a seventh arrangement and a latent image upon observation from an oblique direction.

In the seventh arrangement, the second element (21) overlaps at least part of the observation portion (V) of the outline element (14A), at least part of the observation portion (V) of the outline auxiliary element (14B), and at least part of the observation portion (V) of the latent image element (12A) arranged in the same phase as that of the outline element (14A) or the observation portion (V) of the background element (13A) arranged in the same phase as that of the outline element but not the observation portion (V) of the latent image element (12A) arranged in a phase different from that of the outline element (14A) or the observation portion (V) of the background element (13A) arranged in a phase different from that of the outline element (14A). In this case, the elements are arranged such that the area ratio of the second element (21) overlapping the observation portion (V) of the outline element (14A) and the observation portion (V) of the latent image element (12A) arranged in the same phase as that of the outline element (14A) or the background element (14A) arranged in the same phase as that of the outline element (14A) is different from that of the second element (21) overlapping the observation portion (V) of the outline auxiliary element (14B). FIG. 36(*a*) shows an example of this arrangement.

FIG. 36(*a*) illustrates a state in which the second element (21) overlaps the entire observation portion (V) of the latent image element (12A), the entire observation portion (V) of the outline element (14A), and part of the observation portion (V) and the entire non-observation portion (V') of the outline auxiliary element (14B) but not the background element (13A). FIG. 36(*a*) also illustrates a state in which the area ratio of the second element (21) overlapping the observation portion (V) of the latent image element (12A) and the observation portion (V) of the outline element (14A) is larger than that of the second element (21) overlapping the observation portion (V) of the outline auxiliary element (14B).

The latent image pattern formed body (2) of the seventh arrangement shown in FIG. 36(*a*) is observed from the oblique direction. In this case, the portions where the latent image element (12A), the outline element (14A), and the outline auxiliary element (14B) are formed are observed in the color of the second element (21). The portion where the outline auxiliary element (14B) is formed is visually recognized at a density lower than those of the portions where the latent image element (12A) and the outline element (14A) are formed. As a result, a latent image and outline shown in FIG. 36(*b*) are observed.

Figure 37:
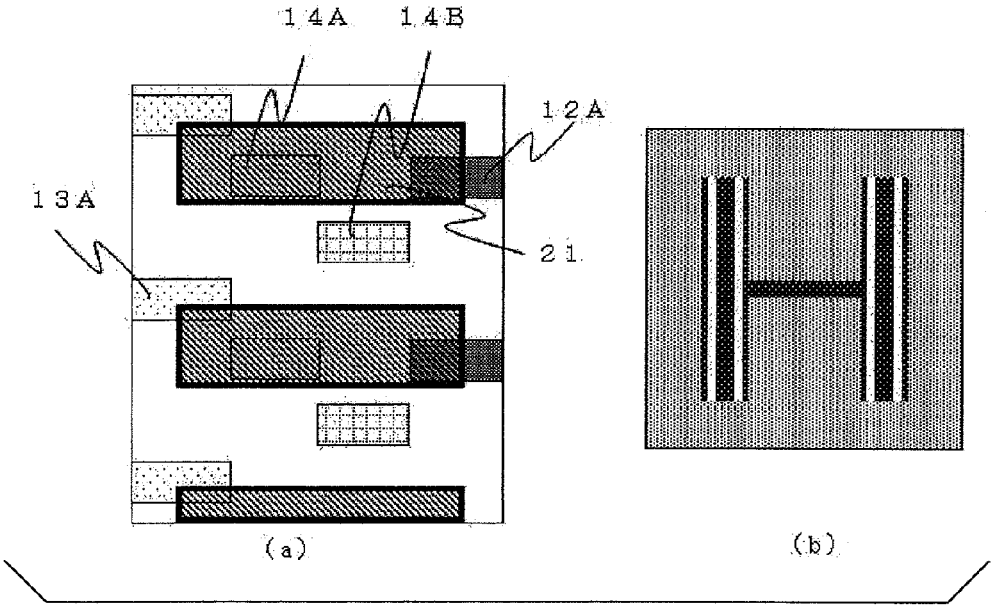
FIG. 37 shows views of an eighth arrangement and a latent image upon observation from an oblique direction.

In the eighth arrangement, the second element (21) overlaps at least part of the observation portion (V) of the outline element (14A), at least part of the observation portion (V) of the latent image element (12A), and at least part of the observation portion (V) of the background element (13A) but not the observation portion (V) of the outline auxiliary element (14B). In this case, the elements are arranged such that the area ratio of the second element (21) overlapping the observation portion (V) of the outline element (14A) and the observation portion (V) of the latent image element (12A) arranged in the same phase as that of the outline element (14A) or the observation portion (V) of the background element (13A) arranged in the same phase as that of the outline element (14A) is different from that of the second element (21) overlapping the observation portion (V) of the latent image element (12A) arranged in a phase different from that of the outline element (14A) or the observation portion (V) of the background element (13A) arranged in a phase different from that of the outline element (14A). FIG. 37(*a*) shows an example of this arrangement.

FIG. 37(*a*) illustrates a state in which the second element (21) overlaps the entire latent image element (12A), the entire outline element (14A), and part of the observation portion (V) of the background element (13A) but not the outline auxiliary element (14B). FIG. 37(*a*) also illustrates a state in which the area ratio of the second element (21) overlapping the observation portion (V) of the latent image element (12A) and the observation portion (V) of the outline element (14A) is larger than that of the second element (21) overlapping the observation portion (V) of the background element (13A).

The latent image pattern formed body (2) of the eighth arrangement shown in FIG. 37(*a*) is observed from the oblique direction. In this case, the portions where the latent image element (12A), the outline element (14A), and the background element (13A) are formed are observed in the color of the second element (21). The portion where the background element (13A) is formed is visually recognized at a density lower than those of the portions where the latent image element (12A) and the outline element (14A) are formed. As a result, a latent image and outline shown in FIG. 37(*b*) are observed.

Figure 38:
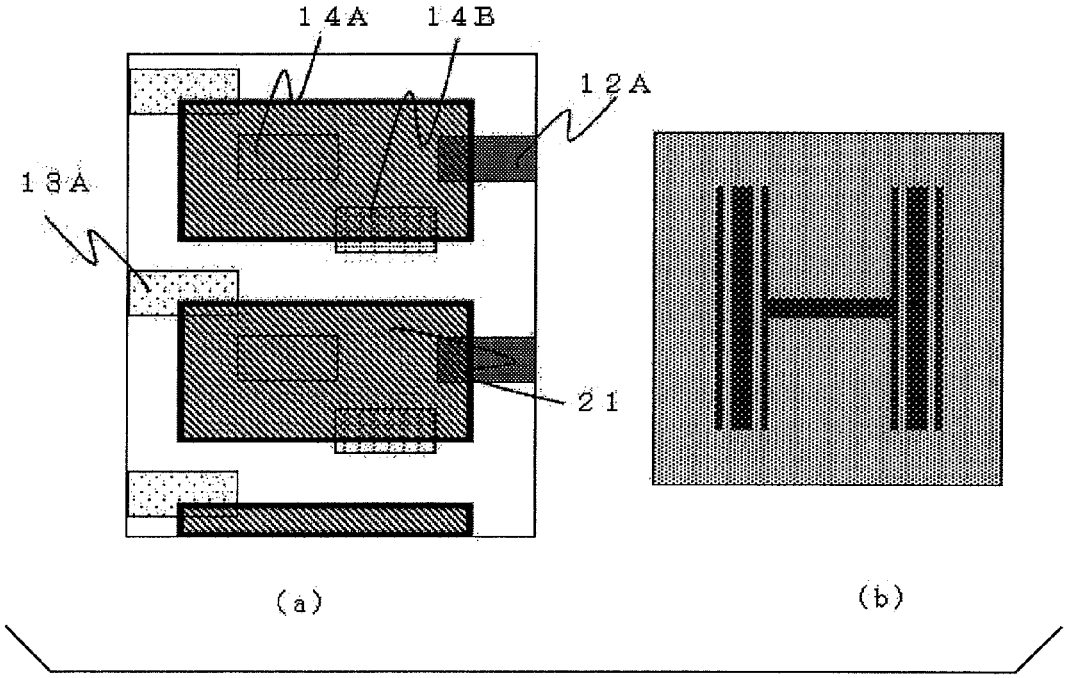
FIG. 38 shows views of a ninth arrangement and a latent image upon observation from an oblique direction.

In the ninth arrangement, the second element (21) overlaps at least part of the observation portion (V) of the outline element (14A), at least part of the observation portion (V) of the outline auxiliary element (14B), at least part of the observation portion (V) of the latent image element (12A), and at least part of the observation portion (V) of the background element (13A). In this case, the elements are arranged such that the area ratio of the second element (21) overlapping the observation portion (V) of the outline element (14A) and the observation portion (V) of the latent image element (12A) arranged in the same phase as that of the outline element (14A) or the observation portion (V) of the background element (13A) arranged in the same phase as that of the outline element (14A) is different from that of the second element (21) overlapping the observation portion (V) of the outline auxiliary element (14B) and the observation portion (V) of the latent image element (12A) arranged in a phase different from that of the outline element (14A) or the observation portion (V) of the background element (13A) arranged in a phase different from that of the outline element (14A). Note that the area ratio of the second element (21) overlapping the observation portion (V) of the outline auxiliary element (14B) may be equal to or different from that of the second element (21) overlapping the observation portion (V) of the latent image element (12A) arranged in a phase different from that of the outline element (14A) or the observation portion (V) of the background element (13A) arranged in a phase different from that of the outline element (14A). FIG. 38(*a*) shows an example of this arrangement.

FIG. 38(*a*) illustrates a state in which the second element (21) overlaps the entire latent image element (12A), the entire outline element (14A), part of the observation portion (V) of the background element (13A), and part of the observation portion (V) and the entire non-observation portion (V') of the outline auxiliary element (14B). FIG. 38(*a*) also illustrates a state in which the area ratio of the second element (21) overlapping the observation portion (V) of the background element (13A) equals that of the second element (21) overlapping the observation portion (V) of the outline auxiliary element (14B).

The latent image pattern formed body (2) of the ninth arrangement shown in FIG. 38(*a*) is observed from the oblique direction. In this case, the portions where the elements are formed are observed in the color of the second element (21). The portions where the background element (13A) and the outline auxiliary element (14B) are formed are visually recognized at a density lower than those of the portions where the latent image element (12A) and the outline element (14A) are formed. As a result, a latent image and outline shown in FIG. 38(*b*) are observed.

In the second embodiment, as described concerning the fifth to ninth arrangements, the elements are arranged such that the area ratio of the second element (21) overlapping the observation portions (V) of the latent image element (12A) and the outline element (14A) is different from that of the second element (21) overlapping the observation portions (V) of the background element (13A) and the outline auxiliary element (14B), thereby changing the color at the time of visual recognition. This allows to observe a latent image having the outline portion (14).

As described above, in the second embodiment, the outlines on the left and right sides of the motif of the latent image are observed as double outlines in the same color as that of the latent image portion or the background portion.

Third Embodiment

Figure 39:
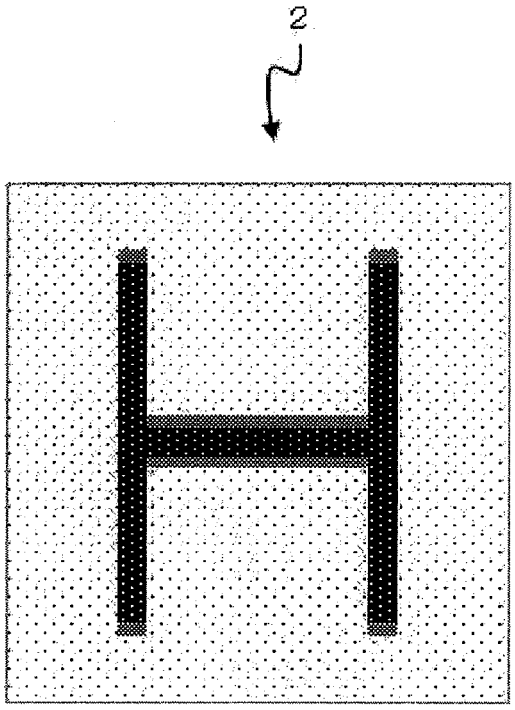
FIG. 39 is a view showing a latent image pattern according to the third embodiment.

The third embodiment provides a latent image pattern formed body (2) in which the outlines on the upper and lower sides of the motif of the latent image can be observed, as shown in FIG. 39, when observed from the oblique direction. Points different from the first and second embodiments will be described with reference to FIGS. 39 to 59 for the latent image pattern formed body (2) of the third embodiment.

Figure 40:
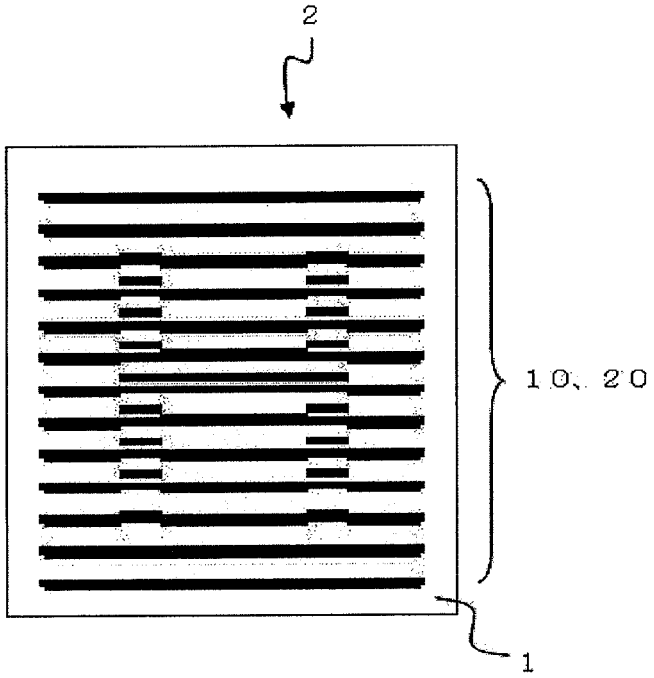
FIG. 40 is a view showing a first pattern and a second pattern that form a latent image pattern formed body.

The latent image pattern formed body (2) of the third embodiment is formed by forming a first pattern (10) and a second pattern (20) on a substrate (1), as shown in FIG. 40.

(First Pattern)

Figure 41:
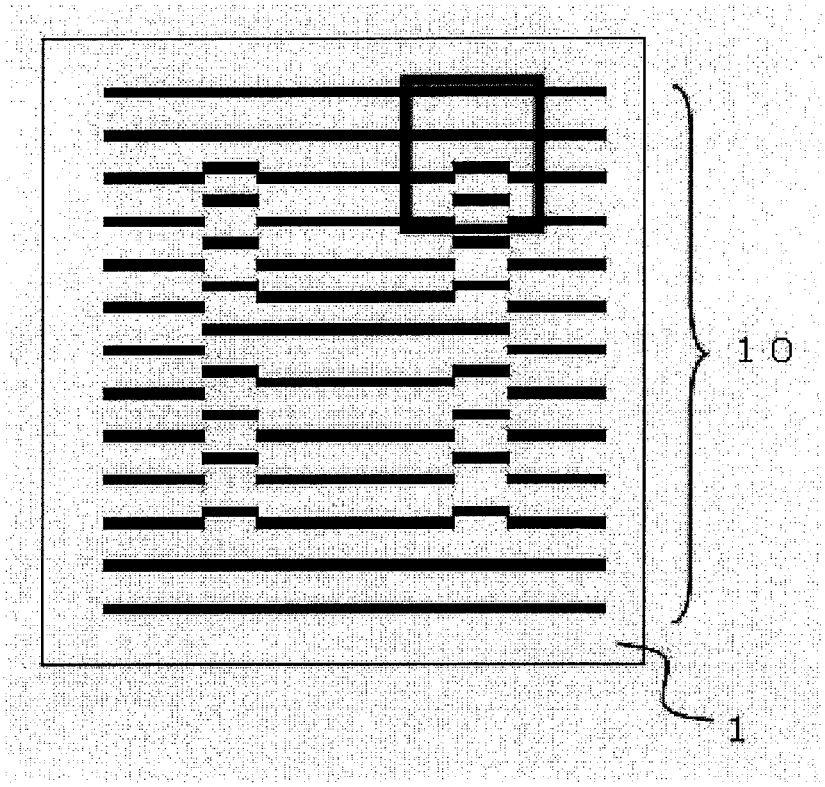
FIG. 41 is a view showing the first pattern.

FIG. 41 shows the first pattern (10) according to the third embodiment. In the third embodiment, the structures of a latent image portion (12) and a background portion (13) of the first pattern (10) are the same as those of the first embodiment. In the first and second embodiments, the outlines on the left and right sides of the motif of the latent image can be observed. In the third embodiment, however, the outlines on the upper and lower sides of the latent image can be observed, and the structure of an outline portion (14) of the first pattern (10) is different. The structure of the outline portion (14) will be described.

(Outline Portion)

In the present invention, the outline portion (14) in which the outlines on the upper and lower sides of the motif of the latent image are observed can have three different structures. Each structure will be described with reference to the accompanying drawings. Note that the drawings to be used to explain the structure of the outline portion (14) illustrate a portion corresponding to the portion surrounded by a thick line frame on the first pattern (10) shown in FIG. 41.

Figure 42:
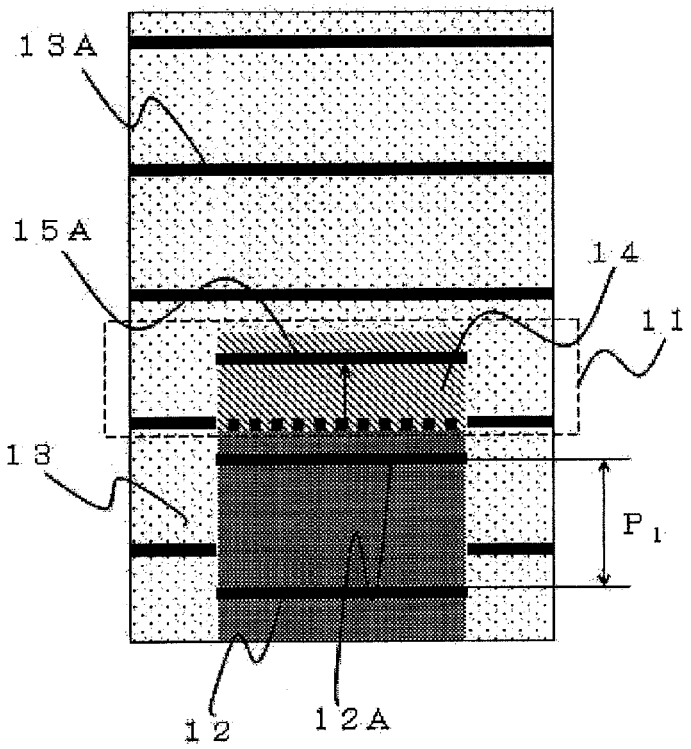
FIG. 42 is a view showing an outline portion having a first structure.
Figure 43:
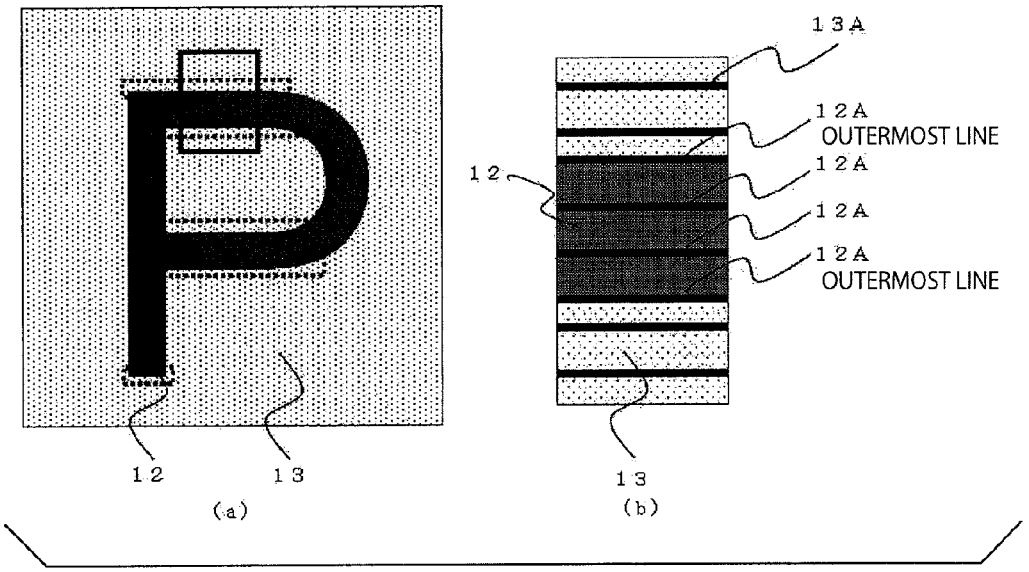
FIG. 43 shows views for explaining the outermost line of a latent image element.

The outline portion (14) having the first structure partially changes the phase of a first element (11) that is arranged on a side opposite to a latent image element (12A) with respect to the outermost line of the latent image element (12A) and is adjacent to the outermost line of the latent image element (12A), as shown in FIG. 42. Note that "the outermost line of the latent image element (12A)" means, for example, each latent image element (12A) surrounded by a dotted line in the character "P" shown in FIG. 43(*a*) that is the motif of the latent image separated into the latent image portion (12) and the background portion (13). FIG. 43(*b*) is an enlarged view of the portion surrounded by the thick line frame shown in FIG. 43(*a*). The "outermost line of the latent image element (12A)" means, out of the latent image elements (12A) that form the latent image portion (12), each latent image element (12A) adjacent to a background element (13A) that forms the background portion (13). The portion that partially changes the phase of the first element (11) that is arranged on the side opposite to the latent image element (12A) with respect to the outermost line of the latent image element (12A) and is adjacent to the outermost line of the latent image element (12A) will be referred to as a "latent image adjacent outline element (15A)" hereinafter. The latent image adjacent outline element (15A) is arranged at a pitch different from a first pitch ($P_1$) from the outermost line of the latent image element (12A). Thus arranging the latent image adjacent outline element (15A) makes it possible to arrange the elements such that the area ratio of a second element (71) overlapping an observation portion (V) of the latent image element (12A) is different from that of the second element (21) overlapping the observation portion (V) of the latent image adjacent outline element (15A). It is therefore possible to visually recognize the outline that appears as a latent image in a color different from that of the latent image portion (12).

Figure 44:
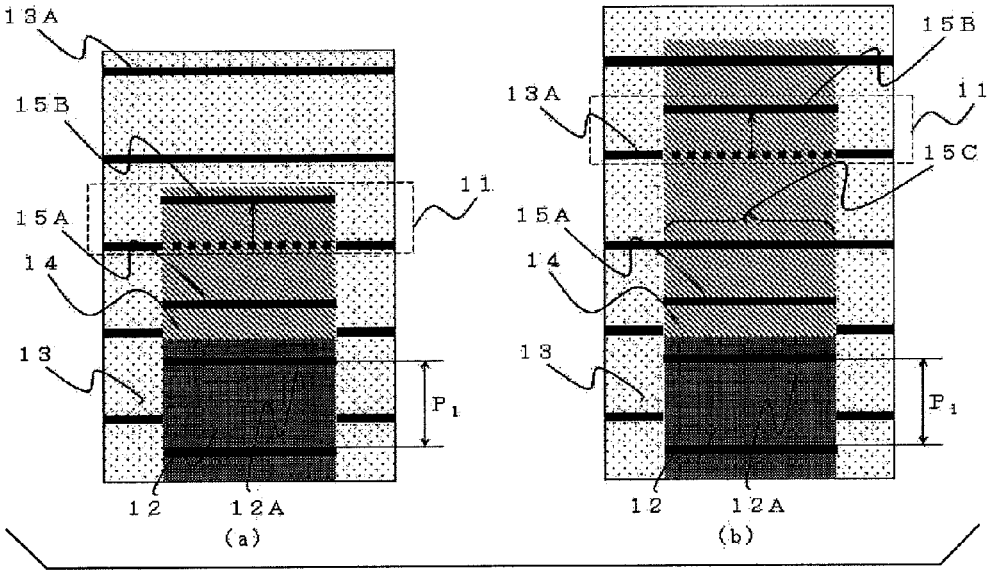
FIG. 44 is a view showing an outline portion having a second structure.

The outline portion (14) having the second structure partially changes the phase of at least one first element (11) out of n first elements (11) that are arranged on a side opposite to the latent image element (12A) with respect to the latent image adjacent outline element (15A) and are continuously adjacent to the latent image adjacent outline element (15A), as shown in FIG. 44, in the first structure of the outline portion (14). Note that the portion that partially changes the phase of the first elements (11) that are arranged on the side opposite to the latent image element (12A) with respect to the latent image adjacent outline element (15A) and are continuously adjacent to the latent image adjacent outline element (15A) will be referred to as a "background adjacent outline element (15B)" hereinafter. A detailed example of the arrangement of the background adjacent outline element (15B) will be described next.

FIG. 44(*a*) shows an example in which the phase of the first element (11) adjacent to the latent image adjacent outline element (15A) is partially changed to form the background adjacent outline element (15B). At this time, the outline portion (14) is formed from the latent image adjacent outline element (15A) and the background adjacent outline element (15B). In the structure shown in FIG. 44(*a*), when the second element (21) is arranged so as to have the same overlap area ratio for the observation portion (V) of the latent image adjacent outline element (15A) and that of the background adjacent outline element (15B), the latent image adjacent outline element (15A) and the background adjacent outline element (15B) are connected and observed as one outline that is thicker than the first outline. When the second element (21) is arranged so as to have different overlap area ratios for the observation portion (V) of the latent image adjacent outline element (15A) and that of the background adjacent outline element (15B), the outlines can be observed in different colors.

FIG. 44(*b*) shows an example in which the phase of the second first element (11) adjacent to the latent image adjacent outline element (15A) is partially changed to form the background adjacent outline element (15B). The first element (11) arranged between the latent image adjacent outline element (15A) and the background adjacent outline element (15B) shown in FIG. 44(*b*) does not partially change the phase. However, the portion adjacent to the latent image adjacent outline element (15A) and the background adjacent outline element (15B) is visually recognized as an outline when observing the latent image. This portion will be referred to as an "outline element (15C)" hereinafter. In the structure shown in FIG. 44(*b*), the outline portion (14) is formed from the latent image adjacent outline element (15A), the background adjacent outline element (15B), and the outline element (15C). Note that in the structure of the outline portion (14) shown in FIG. 44(*b*), one outline element (15C) is arranged between the latent image adjacent outline element (15A) and the background adjacent outline element (15B). However, when the latent image adjacent outline element (15A) and the background adjacent outline element (15B) are arranged at an interval, all first elements (11) arranged between the latent image adjacent outline element (15A) and the background adjacent outline element (15B) and are continuously adjacent to the latent image adjacent outline element (15A) serve as the outline elements (15C). As described above, the outline portion (14) having the second structure includes the latent image adjacent outline element (15A), the background adjacent outline element (15B), and the outline element (15C) arranged between the latent image adjacent outline element (15A) and the background adjacent outline element (15B). In the structure shown in FIG. 44(*b*), the background adjacent outline element (15B) is observed away from the latent image adjacent outline element (15A) while placing, between them, the outline element (15C) observed with the same visibility as that of the background portion (13).

The background adjacent outline element (15B) will be described next in detail.

Figure 45:
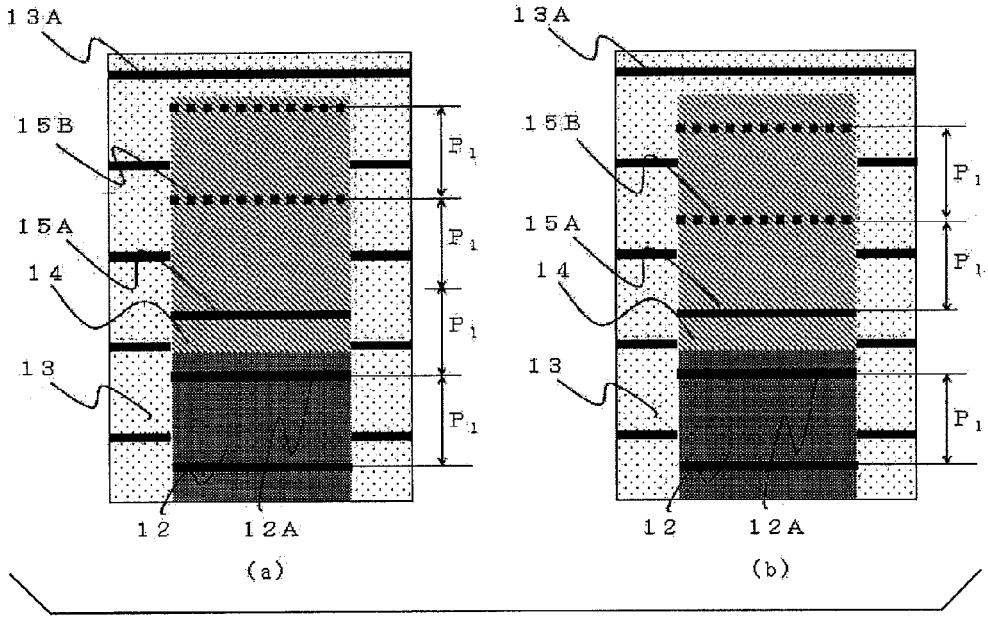
FIG. 45 shows views of the arrangement of background adjacent outline elements.

The background adjacent outline element (15B) is formed by partially changing the phase of at least one first element (11) out of n first elements (11) continuously adjacent to the latent image adjacent outline element (15A), as described above. When the background adjacent outline element (15B) is arranged at a distance m (m is an integer of 2 or more) times the first pitch ($P_1$) from the outermost line of the latent image element (12A), as shown in FIG. 45(*a*), the second element (21) can be arranged so as to have the same overlap area ratio for the latent image element (12A) and the background adjacent outline element (15B). In this case, the portions where the latent image element (12A) and the background adjacent outline element (15B) are formed are observed in the same color.

When the background adjacent outline element (15B) is arranged at a distance corresponding to an integer multiple of the first pitch ($P_1$) from the latent image adjacent outline element (15A), as shown in FIG. 45(*b*), the second element (21) can be arranged so as to have the same overlap area ratio for the latent image adjacent outline element (15A) and the background adjacent outline element (15B). In this case, the portions where the latent image adjacent outline element (15A) and the background adjacent outline element (15B) are formed are observed in the same color.

When the background adjacent outline element (15B) is arranged at a position other than those described in paragraphs [0149] and [0150], the elements can be arranged such that the area ratio of the second element (21) overlapping the observation portion (V) of the background adjacent outline element (15B) is different from those of the second element (21) overlapping the observation portion (V) of the latent image element (12A) and the observation portion (V) of the latent image adjacent outline element (15A). In this case, the background adjacent outline element (15B) is observed as an outline in a color different from those of the latent image element (12A) and the latent image adjacent outline element (15A).

The range where the background adjacent outline element (15B) is formed in the outline portion (14) is adjusted in accordance with the side of the motif of the latent image, although it is not particularly limited. When the latent image pattern formed body is formed on the above-described valuable printed matter, the background adjacent outline element (15B) is formed within the range of about five elements continuously adjacent to the latent image adjacent outline element (15A). If the range where the background adjacent outline element (15B) is formed is too far apart from the latent image adjacent outline element (15A), the element is hard to recognize as an outline. A plurality of background adjacent outline elements (15B) may be arranged. An example will be described next.

Figure 46:
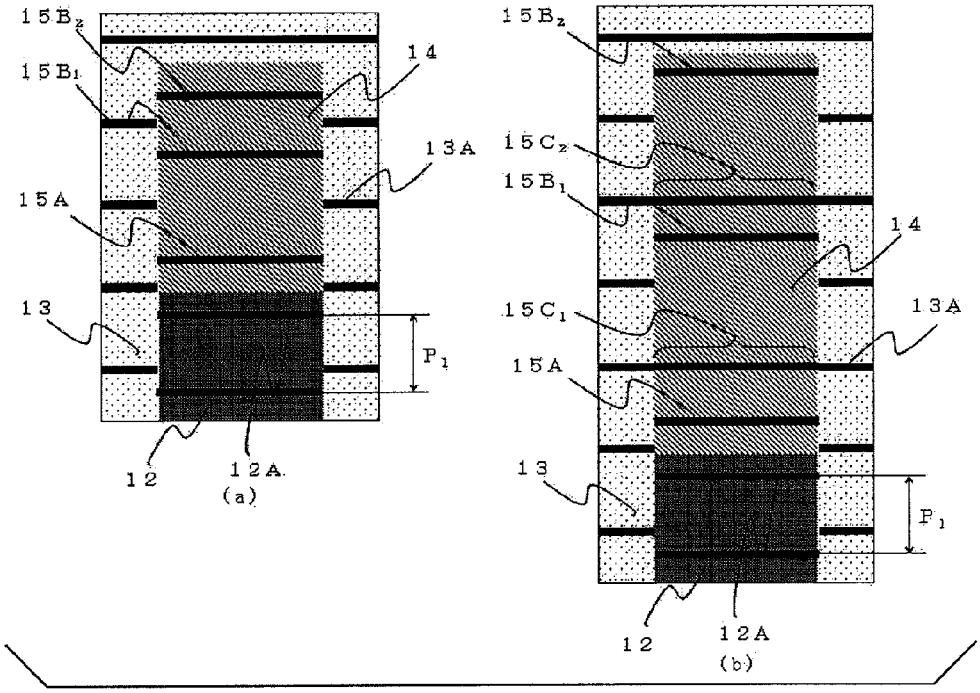
FIG. 46 shows views of an outline portion formed by arranging a plurality of background adjacent outline elements.

FIG. 46(*a*) shows an example in which the phases of the first and second first elements (11), out of the first elements (11) that are arranged on the side opposite to the latent image element (12A) with respect to the latent image adjacent outline element (15A) and are continuously adjacent to the latent image adjacent outline element (15A), are partially changed. At this time, the outline portion (14) is formed from the latent image adjacent outline element (15A), a background adjacent outline element ($15B_1$), and a background adjacent outline element ($15B_2$). FIG. 46(*a*) shows an example in which the two background adjacent outline elements ($15B_1$, $15B_2$) are arranged. When a plurality of background adjacent outline elements (15B) are continuously arranged from the latent image adjacent outline element (15A), the outline portion (14) is formed from the outermost line of the background adjacent outline element (15B), that is, the background adjacent outline element (15$B_2$), the latent image adjacent outline element (15A), and the background adjacent outline element (15$B_1$) arranged between them. Note that the arrangement of the second pattern (20) and the first pattern (10) including the outline portion (14) in which a plurality of background adjacent outline elements (15$B_1$, 15$B_2$) are arranged continuously from the latent image adjacent outline element (15A), as shown in FIG. 46(*a*), and a latent image to be observed will be described later.

FIG. 46(*b*) shows an example in which the phases of the first and fourth first elements (11), out of the first elements (11) that are arranged on the side opposite to the latent image element (12A) with respect to the latent image adjacent outline element (15A) and are continuously adjacent to the latent image adjacent outline element (15A), are partially changed. At this time, out of the first element (11) arranged between the background adjacent outline element (15$B_1$) and the background adjacent outline element (15$B_2$), a portion adjacent to the background adjacent outline element (15$B_1$) and the background adjacent outline element (15$B_2$) is also visually recognized as an outline when observing the latent image. This portion will also be referred to as the "outline element (15C)" hereinafter. FIG. 46(*b*) illustrates the outline element arranged between the latent image adjacent outline element (15A) and the background adjacent outline element (15$B_1$) as an "outline element (15$C_1$)", and the outline element arranged between the background adjacent outline element (15$B_1$) and the background adjacent outline element (15$B_2$) as an "outline element (15$C_2$)". In the structure shown in FIG. 46(*b*), the outline portion (14) is formed from the latent image adjacent outline element (15A), the background adjacent outline element (15$B_1$), the background adjacent outline element (15$B_2$), the outline element (15$C_1$), and the outline element (15$C_2$). Note that in the outline portion (14) shown in FIG. 46(*b*), one outline element (15$C_2$) is arranged between the background adjacent outline element (15$B_1$) and the background adjacent outline element (15$B_2$). However, when the background adjacent outline element (15$B_1$) and the background adjacent outline element (15$B_2$) are arranged at an interval, all first elements (11) arranged between the background adjacent outline element (15$B_1$) and the background adjacent outline element (15$B_2$) and are continuously adjacent to the background adjacent outline element (15$B_1$) serve as the outline elements (15C). At this time, the outline portion (14) includes all outline elements (15C) arranged between the background adjacent outline element (15$B_1$) and the background adjacent outline element (15$B_2$). Note that the arrangement of the second pattern (20) and the first pattern (10) including the outline portion (14) in which the outline element (15C) is arranged between the background adjacent outline element (15$B_1$) and the background adjacent outline element (15$B_2$), as shown in FIG. 46(*b*), and a latent image to be observed will be described later.

Figure 47:
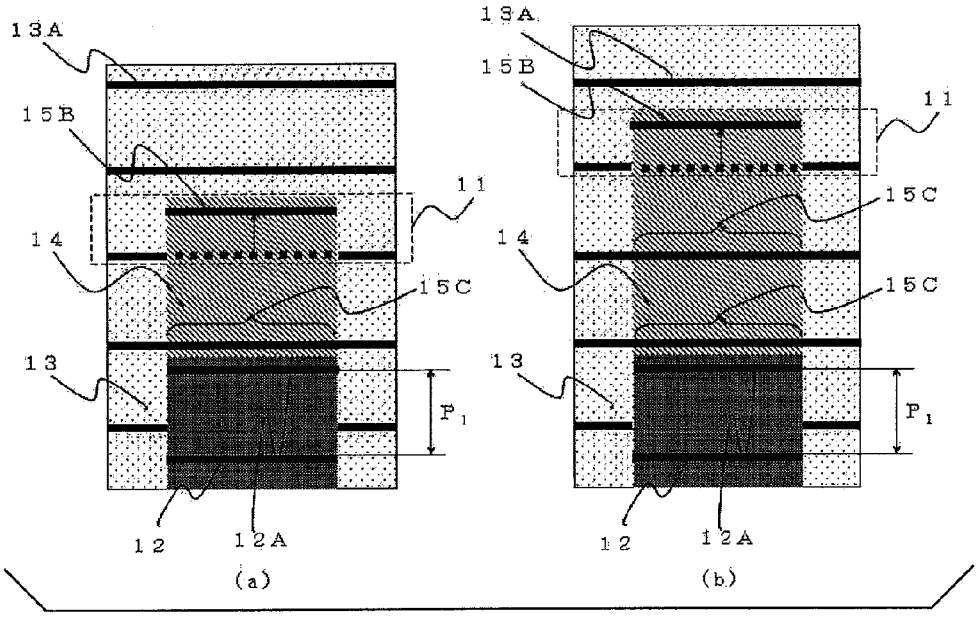
FIG. 47 is a view showing an outline portion having a third structure.

The outline portion (14) having the third structure partially changes the phase of at least one first element (11) out of the second and subsequent first elements (11) that are arranged on a side opposite to the latent image element (12A) with respect to the outermost line of the latent image element (12A) and are continuously adjacent to the outermost line of the latent image element (12A), as shown in FIG. 47. Note that in the third structure of the outline portion (14), the portion that partially changes the phase of one of the second and subsequent first elements (11) that are arranged on the side opposite to the latent image element (12A) with respect to the outermost line of the latent image element (12A) and are continuously adjacent to the outermost line of the latent image element (12A) will be referred to as the "background adjacent outline element (15B)" hereinafter. A detailed example of the arrangement of the background adjacent outline element (15B) will be described next.

FIG. 47(*a*) shows an example in which the phase of the second first element (11) adjacent to the outermost line of the latent image element (12A) is partially changed to form the background adjacent outline element (15B). The first element (11) arranged between the outermost line of the latent image element and the background adjacent outline element (15B) shown in FIG. 47(*a*) does not partially change the phase. However, the portion adjacent to the background adjacent outline element (15B) is visually recognized as an outline when observing the latent image. This portion will be referred to as the "outline element (15C)" hereinafter. In the structure shown in FIG. 47(*a*), the outline portion (14) is formed from the background adjacent outline element (15B) and the outline element (15C).

FIG. 47(*b*) shows an example in which the phase of the third first element (11) adjacent to the outermost line of the latent image element (12A) is partially changed to form the background adjacent outline element (15B). In this case, the portions of the two first elements (11) arranged between the outermost line of the latent image element (12A) and the background adjacent outline element (15B), which are continuously adjacent to the latent image element (12A), serve as the outline elements (15C). The outline portion (14) shown in FIG. 47(*b*) is formed from the background adjacent outline element (15B) and the two outline elements (15C). As described above, the outline portion (14) having the third structure is formed from the background adjacent outline element (15B) and the outline elements (15C) arranged between the outermost line of the latent image element (12A) and the background adjacent outline element (15B).

In the third structure of the outline portion (14), no outline by the latent image adjacent outline element (15A) appears, unlike the second structure of the outline portion (14). However, the outline can be made to appear by forming the background adjacent outline element (15B).

Figure 48:
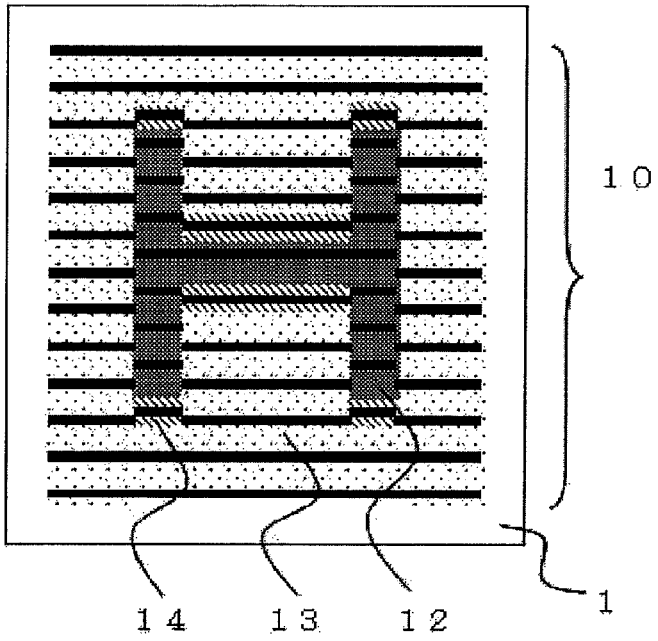
FIG. 48 is a view showing the latent image portion, the background portion, and the outline portion of the first pattern.

FIG. 48 shows the first pattern (10) separated into the latent image portion (12), the background portion (13), and the outline portion (14) formed between the latent image portion (12) and the background portion (13).

Figure 49:
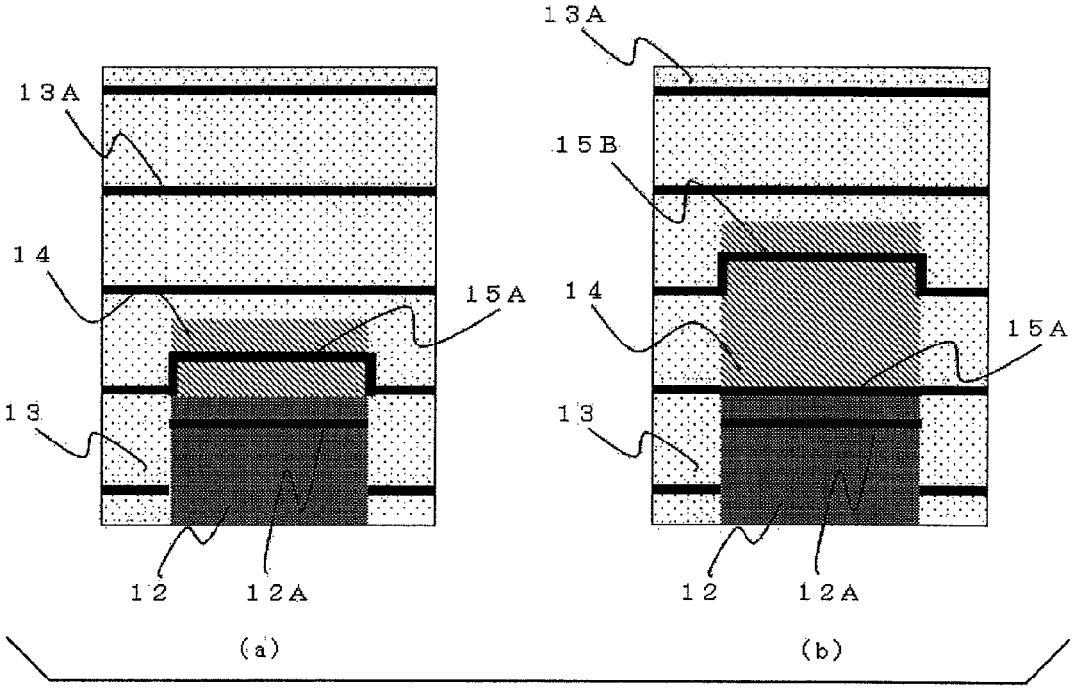
FIG. 49 shows views of an example in which the first pattern is formed by connecting the elements.

In the outline portions (14) having the above-described first to third structures, the background element (13A) and the latent image adjacent outline element (15A) may be connected, as shown in FIG. 49(*a*). The background element (13A) and the background adjacent outline element (15B) may be connected, as shown in FIG. 49(*b*).

(Arrangement of First Pattern and Second Pattern and Image to be Observed)

An arrangement of the first pattern (10) and the second pattern (20) and an image to be observed will be described below for each structure of the outline portion (14) according to the third embodiment. Note that arrangements of the first pattern (10) and the second pattern (20) in which the first pitch ($P_1$) equals the second pitch ($P_2$), and a motif to be observed will be described. In the third embodiment, arrangements from the 10th arrangement will be described.

There are four different arrangements in which the second pattern (20) overlaps the first pattern (10) having the first structure of the outline portion (14) according to the third embodiment. The arrangements will be described as the 10th to 13th arrangements.

Figure 50:
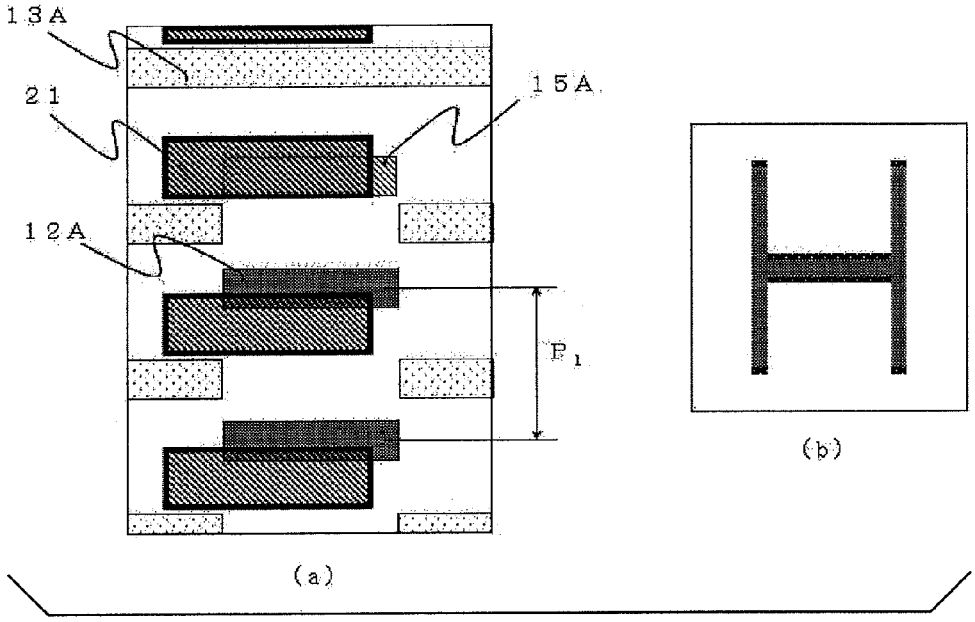
FIG. 50 shows views of a tenth arrangement and a latent image upon observation from an oblique direction.

In the 10th arrangement, the second element (21) overlaps at least part of the observation portion (V) of the latent image element (12A) and at least part of the observation portion of the latent image adjacent outline element (15A) but not the observation portion (V) of the background element (13A). In this case, the elements are arranged such that the area ratio of the second element (21) overlapping the observation portion (V) of the latent image element (12A) is different from that of the second element (21) overlapping the observation portion (V) of the latent image adjacent outline element (15A). FIG. 50(*a*) shows an example of this arrangement.

FIG. 50(*a*) illustrates a state in which the second element (21) overlaps part of the observation portion (V) of the latent image element (12A) and the entire latent image adjacent outline element (15A) but not the background element (13A). FIG. 50(*a*) also illustrates a state in which the area ratio of the second element (21) overlapping the observation portion (V) of the latent image adjacent outline element (15A) is larger than that of the second element (21) overlapping the observation portion (V) of the latent image element (12A).

The latent image pattern formed body (2) of the 10th arrangement shown in FIG. 50(*a*) is observed from the oblique direction. Since the second element (21) overlaps the observation portion (V) of the latent image portion (12) and the observation portion (V) of the latent image adjacent outline element (15A), the latent image portion (12) and the outline portion (14) are observed in the color of the second element (21). At this time, since the area ratio of the second element (21) overlapping the observation portion (V) of the latent image adjacent outline element (15A) is larger than that of the second element (21) overlapping the observation portion (V) of the latent image element (12A), the outline portion (14) is observed at a density higher than that of the latent image portion (12). As a result, the motif of the latent image and the outlines on the upper and lower sides of the motif of the latent image are observed, as shown in FIG. 50(*b*).

Figure 51:
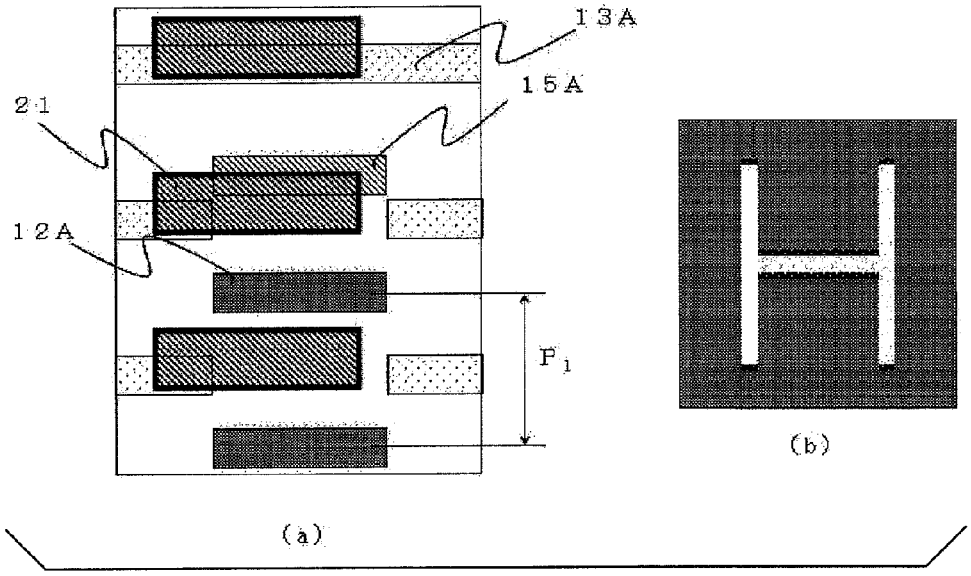
FIG. 51 shows views of a eleventh arrangement and a latent image upon observation from an oblique direction.

In the 11th arrangement, the second element (21) overlaps at least part of the observation portion (V) of the background element (13A) and at least part of the observation portion (V) of the latent image adjacent outline element (15A) but not the observation portion (V) of the latent image element (12A). In this case, the elements are arranged such that the area ratio of the second element (21) overlapping the observation portion (V) of the background element (13A) is different from that of the second element (21) overlapping the latent image adjacent outline element (15A). FIG. 51(*a*) shows an example of this arrangement.

FIG. 51(*a*) illustrates a state in which the second element (21) overlaps part of the observation portion (V) and the entire non-observation portion (V') of the background element (13A) and the entire observation portion (V) of the latent image adjacent outline element (15A) but not the latent image element (12A). FIG. 51(*a*) also illustrates a state in which the area ratio of the second element (21) overlapping the observation portion (V) of the background element (13A) is smaller than that of the second element (21) overlapping the observation portion (V) of the latent image adjacent outline element (15A).

The outline portion (14) having the first structure partially changes the phase of a first element (11) that is arranged on a side opposite to a latent image element (12A) with respect to the outermost line of the latent image element (12A) and is adjacent to the outermost line of the latent image element (12A), as shown in FIG. 42. Note that "the outermost line of the latent image element (12A)" means, for example, each latent image element (12A) surrounded by a dotted line in the character "P" shown in FIG. 43(*a*) that is the motif of the latent image separated into the latent image portion (12) and the background portion (13). FIG. 43(*b*) is an enlarged view of the portion surrounded by the thick line frame shown in FIG. 43(*a*). The "outermost line of the latent image element (12A)" means, out of the latent image elements (12A) that form the latent image portion (12), each latent image element (12A) adjacent to a background element (13A) that forms the background portion (13). The portion that partially changes the phase of the first element (11) that is arranged on the side opposite to the latent image element (12A) with respect to the outermost line of the latent image element (12A) and is adjacent to the outermost line of the latent image element (12A) will be referred to as a "latent image adjacent outline element (15A)" hereinafter. The latent image adjacent outline element (15A) is arranged at a pitch different from a first pitch (P1) from the outermost line of the latent image element (12A). Thus arranging the latent image adjacent outline element (15A) makes it possible to arrange the elements such that the area ratio of a second element (21) overlapping an observation portion (V) of the latent image element (12A) is different from that of the second element (21) overlapping the observation portion (V) of the latent image adjacent outline element (15A). It is therefore possible to visually recognize the outline that appears as a latent image in a color different from that of the latent image portion (12).

Figure 52:
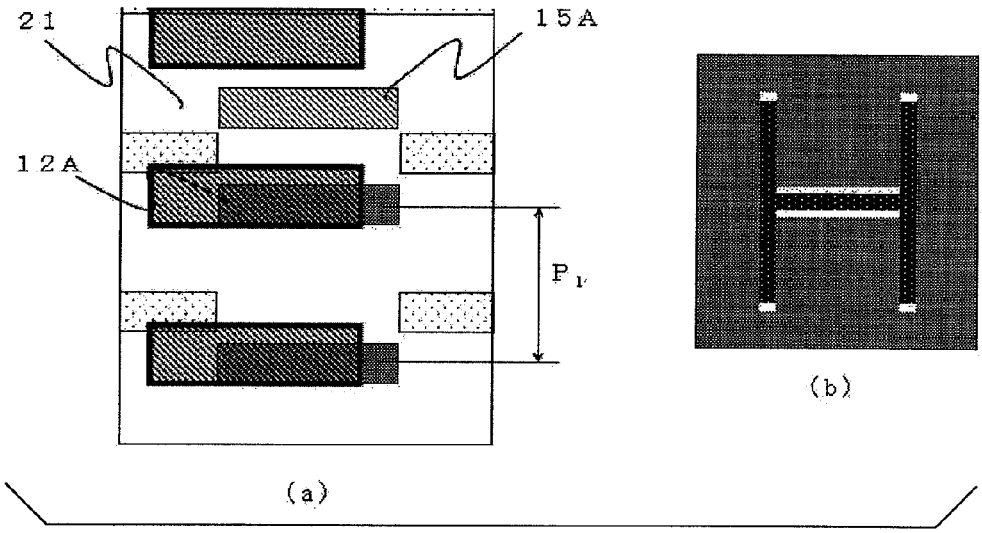
FIG. 52 shows views of a twelfth arrangement and a latent image upon observation from an oblique direction.

In the 12th arrangement, the second element (21) overlaps at least part of the observation portion (V) of the latent image element (12A) and at least part of the observation portion (V) of the background element (13A) but not the observation portion (V) of the latent image adjacent outline element (15A). In this case, the elements are arranged such that the area ratio of the second element (21) overlapping the observation portion (V) of the latent image element (12A) is different from that of the second element (21) overlapping the observation portion (V) of the background element (13A). FIG. 52(*a*) shows an example of this arrangement.

FIG. 52(*a*) illustrates a state in which the second element (21) overlaps the entire latent image element (12A) and part of the observation portion (V) of the background element (13A) but not the latent image adjacent outline element (15A). FIG. 52(*a*) also illustrates a state in which the area ratio of the second element (21) overlapping the observation portion (V) of the background element (13A) is smaller than that of the second element (21) overlapping the observation portion (V) of the latent image element (12A).

The latent image pattern formed body (2) of the 12th arrangement shown in FIG. 52(*a*) is observed from the oblique direction. Since the second element (21) overlaps the observation portion (V) of the latent image element (12A) and the observation portion (V) of the background element (13A), the latent image portion (12) and the background portion (13) are observed in the color of the second element (21). At this time, since the area ratio of the second element (21) overlapping the observation portion (V) of the background element (13A) is smaller than that of the second element (21) overlapping the observation portion (V) of the latent image element (12A), the background portion (13) is observed at a density lower than that of the latent image portion (12). As a result, the motif of the latent image is observed, as shown in FIG. 52(*b*), and the outlines on the upper and lower sides of the motif of the latent image are observed as hollow.

Figure 53:
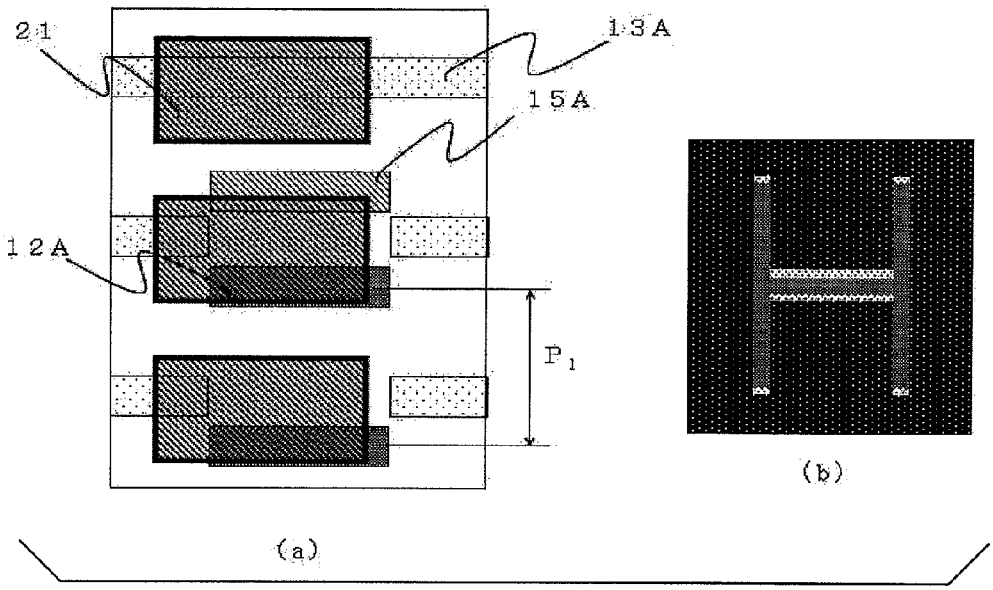
FIG. 53 shows views of a thirteenth arrangement and a latent image upon observation from an oblique direction.

In the 13th arrangement, the second element (21) overlaps at least part of the observation portion (V) of the latent image element (12A), at least part of the observation portion (V) of the background element (13A), and at least part of the observation portion (V) of the latent image adjacent outline element (15A). In this case, the elements are arranged such that the second element (21) has different overlap area ratios for the observation portions (V) of the respective elements. FIG. 53(*a*) shows an example of this arrangement.

FIG. 53(*a*) illustrates a state in which the second element (21) overlaps part of the observation portion (V) and the entire non-observation portion (V') of the latent image element (12A), the entire background element (13A), and part of the observation portion (V) of the latent image adjacent outline element (15A). FIG. 53(*a*) also illustrates a state in which the area ratio of the second element (21) overlapping the observation portion (V) of the latent image element (12A) is smaller than that of the second element (21) overlapping the observation portion (V) of the background element (13A), and the area ratio of the second element (21) overlapping the observation portion (V) of the latent image adjacent outline element (15A) is smaller than that of the second element (21) overlapping the observation portion (V) of the latent image element (12A).

The latent image pattern formed body (2) of the 13th arrangement shown in FIG. 53(*a*) is observed from the oblique direction. Since the second element (21) overlaps the observation portion (V) of the latent image element (12A), the observation portion (V) of the background element (13A), and the observation portion (V) of the latent image adjacent outline element (15A), the latent image portion (13), the background portion (13), and the outline portion (14) are observed in the color of the second element (21). At this time, since the area ratio of the second element (21) overlapping the observation portion (V) of the latent image element (12A) is smaller than that of the second element (21) overlapping the observation portion (V) of the background element (13A), the latent image portion (12) is observed at a density lower than that of the background portion (13). In addition, since the area ratio of the second element (21) overlapping the observation portion (V) of the latent image adjacent outline element (15A) is smaller than that of the second element (21) overlapping the observation portion (V) of the latent image element (12A), the outline portion (14) is observed at a density lower than that of the latent image portion (12). As a result, the motif of the latent image and the outlines on the upper and lower sides of the motif of the latent image are observed as shown in FIG. 53(*b*).

The arrangements in which the second pattern (20) overlaps the first pattern (10) having the second structure of the outline portion (14) according to the third embodiment will be described next. First, an arrangement in which the second pattern (20) overlaps the first pattern (10) having the structure of the outline portion (14) shown in FIG. 44(*a*) will be explained. Note that the above-described 10th to 13th arrangements are adopted to observe the latent image adjacent outline element (15A). In the second structure of the outline portion (14), the background adjacent outline element (15B) is added to the first structure of the outline portion (14). An outline different from the first structure of the outline portion (14) can be observed by the arrangement of the background adjacent outline element (15B) and the second element (21). Hence, the arrangement of the background adjacent outline element (15B) and the second element (21) will be described based on the 10th to 13th arrangements.

Figure 54:
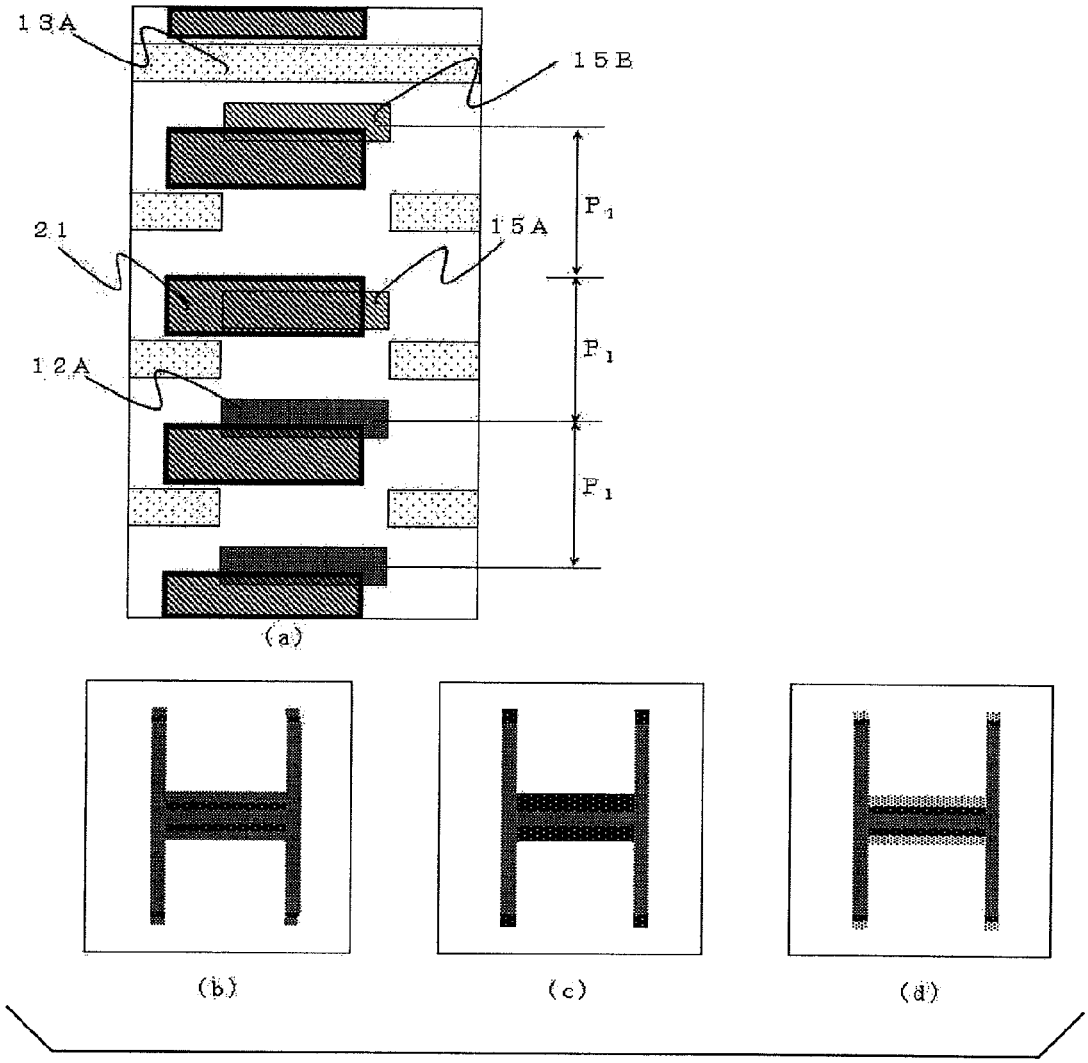
FIG. 54 shows views of a fourteenth arrangement and a latent image upon observation from an oblique direction.

In the 14th arrangement, the second element (21) also overlaps at least part of the observation portion (V) of the background adjacent outline element (15B) in the 10th arrangement. FIG. 54(*a*) shows an example of this arrangement.

FIG. 54(*a*) illustrates a state in which the background adjacent outline element (15B) is arranged at a distance twice the first pitch ($P_1$) from the outermost line of the latent image element (12A). FIG. 54(*a*) additionally illustrates a state in which the second element (21) overlaps part of the observation portion (V) of the latent image element (12A), the entire latent image adjacent outline element (15A), and part of the observation portion (V) of the background adjacent outline element (15B) but not the background element (13A). FIG. 54(*a*) also illustrates a state in which the area ratio of the second element (21) overlapping the observation portion (V) of the latent image adjacent outline element (15A) is larger than those of the second element (21) overlapping the observation portion (V) of the latent image element (12A) and the second element (21) overlapping the observation portion (V) of the background adjacent outline element (15B). Note that since the background adjacent outline element (15B) is arranged at a distance twice the first pitch ($P_1$) from the outermost line of the latent image element (12A), the area ratio of the second element (21) overlapping the observation portion (V) of the background adjacent outline element (15B) equals that of the second element (21) overlapping the observation portion (V) of the latent image element (12A).

The latent image pattern formed body (2) of the 14th arrangement shown in FIG. 54(*a*) is observed from the oblique direction. In this case, the portions where the latent image adjacent outline element (15A), the background adjacent outline element (15B), and the latent image element (12A) are formed are observed in the color of the second element (21). At this time, the latent image adjacent outline element (15A) is visually recognized in a color darker than those of the latent image element (12A) and the background adjacent outline element (15B) because the overlap area ratio of the second element (21) is larger. In addition, since the area ratio of the second element (21) overlapping the observation portion (V) of the latent image element (12A) equals that of the second element (21) overlapping the observation portion (V) of the background adjacent outline element (15B), the latent image element (12A) and the background adjacent outline element (15B) are visually recognized in the same color. As a result, the latent image element (12A) and the background adjacent outline element (15B) are observed in the same color while the latent image adjacent outline element (15A) is observed in a different color between them so that a latent image having double outlines is observed, as shown in FIG. 54(*b*).

Note that when the background adjacent outline element (15B) is arranged at a distance corresponding to the first pitch ($P_1$) from the latent image adjacent outline element (15A) (not shown) in the 14th arrangement shown in FIG. 54(*a*), the area ratio of the second element (21) overlapping the observation portion (V) of the latent image adjacent outline element (15A) equals that of the second element (21) overlapping the observation portion (V) of the background adjacent outline element (15B). For this reason, the portions where the latent image adjacent outline element (15A) and the background adjacent outline element (15B) are formed are connected and visually recognized in the same color, and a latent image having wide outlines is observed, as shown in FIG. 54(*c*). When the background adjacent outline element (15B) is arranged at a position other than those described above (not shown), the elements can be arranged such that the area ratio of the second element (21) overlapping the observation portion (V) of the background adjacent outline element (15B) is different from those of the second element (21) overlapping the observation portion (V) of the latent image element (12A) and the second element (21) overlapping the observation portion (V) of the latent image adjacent outline element (15A). In this case, the background adjacent outline element (15B) is observed as an outline in a color different from those of the latent image element (12A) and the latent image adjacent outline element (15A). FIG. 54(*d*) shows an example of the arrangement.

As described above, in the 14th arrangement, if the area ratio of the second element (21) overlapping the observation portion (V) of the background adjacent outline element (15B) equals that of the second element (21) overlapping the observation portion (V) of the latent image element (12A), the outline portion (14) is observed as double outlines. If the area ratio of the second element (21) overlapping the observation portion (V) of the background adjacent outline element (15B) equals that of the second element (21) overlapping the observation portion (V) of the latent image adjacent outline element (15A), a wide outline is observed. If the area ratio of the second element (21) overlapping the observation portion (V) of the background adjacent outline element (15B) is different from that of the second element (21) overlapping the observation portion (V) of the latent image adjacent outline element (15A), outlines in different colors are observed.

In the 15th arrangement, the second element (21) does not overlap the observation portion (V) of the background adjacent outline element (15B) in the 11th to 13th arrangements. The 15th arrangement will be described sequentially based on the 11th to 13th arrangements.

Figure 55:
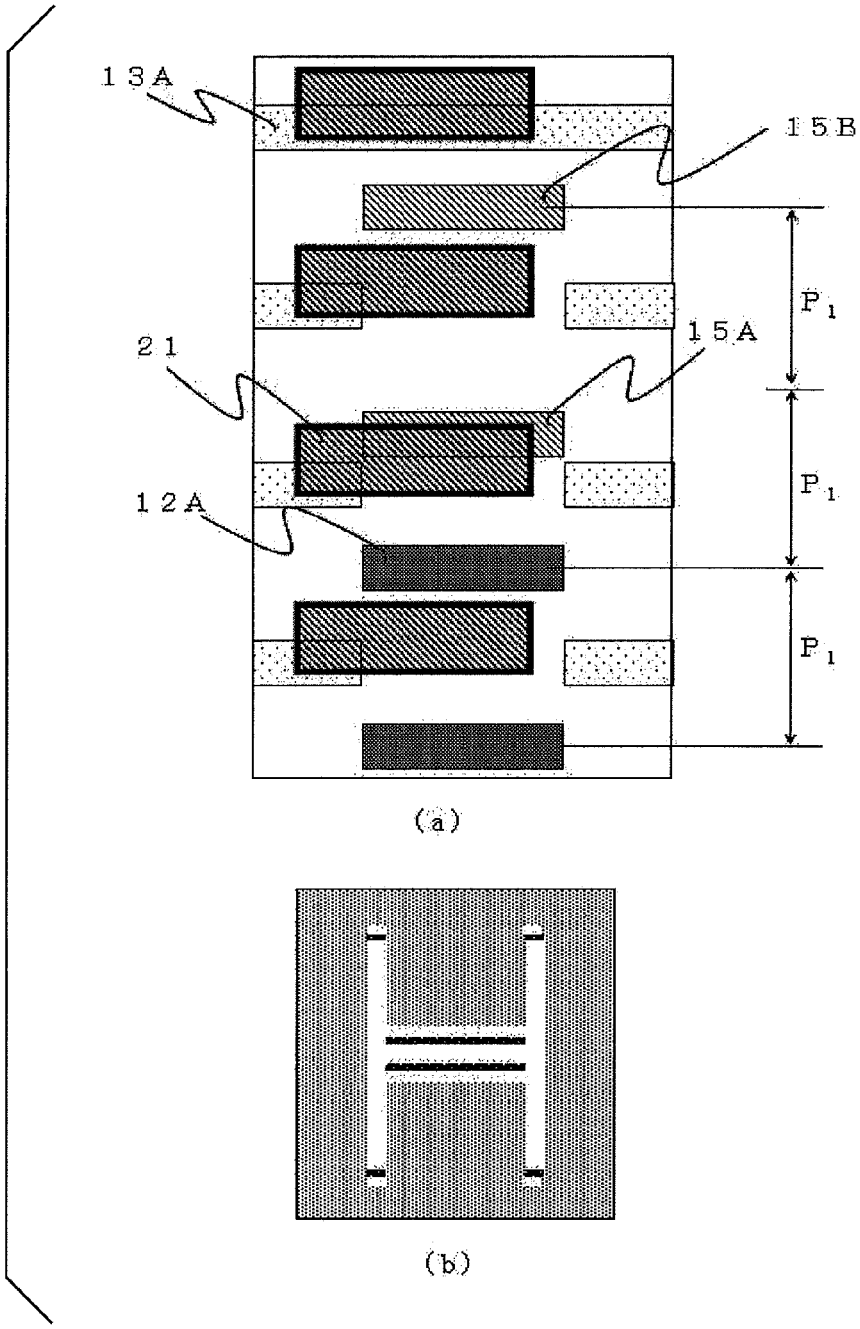
FIG. 55 shows views of a fifteenth arrangement and a latent image upon observation from an oblique direction.

The 15th arrangement in which the second element does not overlap the observation portion (V) of the background adjacent outline element (15B) in the 11th arrangement will be explained first. FIG. 55(*a*) shows an example of this arrangement.

FIG. 55(*a*) illustrates a state in which the background adjacent outline element (15B) is arranged at a distance twice the first pitch ($P_1$) from the outermost line of the latent image element (12A), and the second element (21) does not overlap the observation portion (V) of the background adjacent outline element (15B) in the 11th arrangement. FIG. 55(*a*) also illustrates a state in which the area ratio of the second element (21) overlapping the observation portion (V) of the background element (13A) is smaller than that of the second element (21) overlapping the observation portion (V) of the latent image adjacent outline element (15A).

The latent image pattern formed body (2) of the arrangement shown in FIG. 55(*a*) is observed from the oblique direction. In this case, the portions where the latent image adjacent outline element (15A) and the background element (13A) are formed are observed in the color of the second element (21), and the portions where the latent image element (12A) and the background adjacent outline element (15B) are formed are observed in the color of the substrate (1). At this time, the latent image adjacent outline element (15A) is visually recognized in a color darker than that of the background element (13A) because the overlap area ratio of the second element (21) is larger. As a result, a latent image having double hollow outlines is observed, as shown in FIG. 55(*b*).

Figure 56:
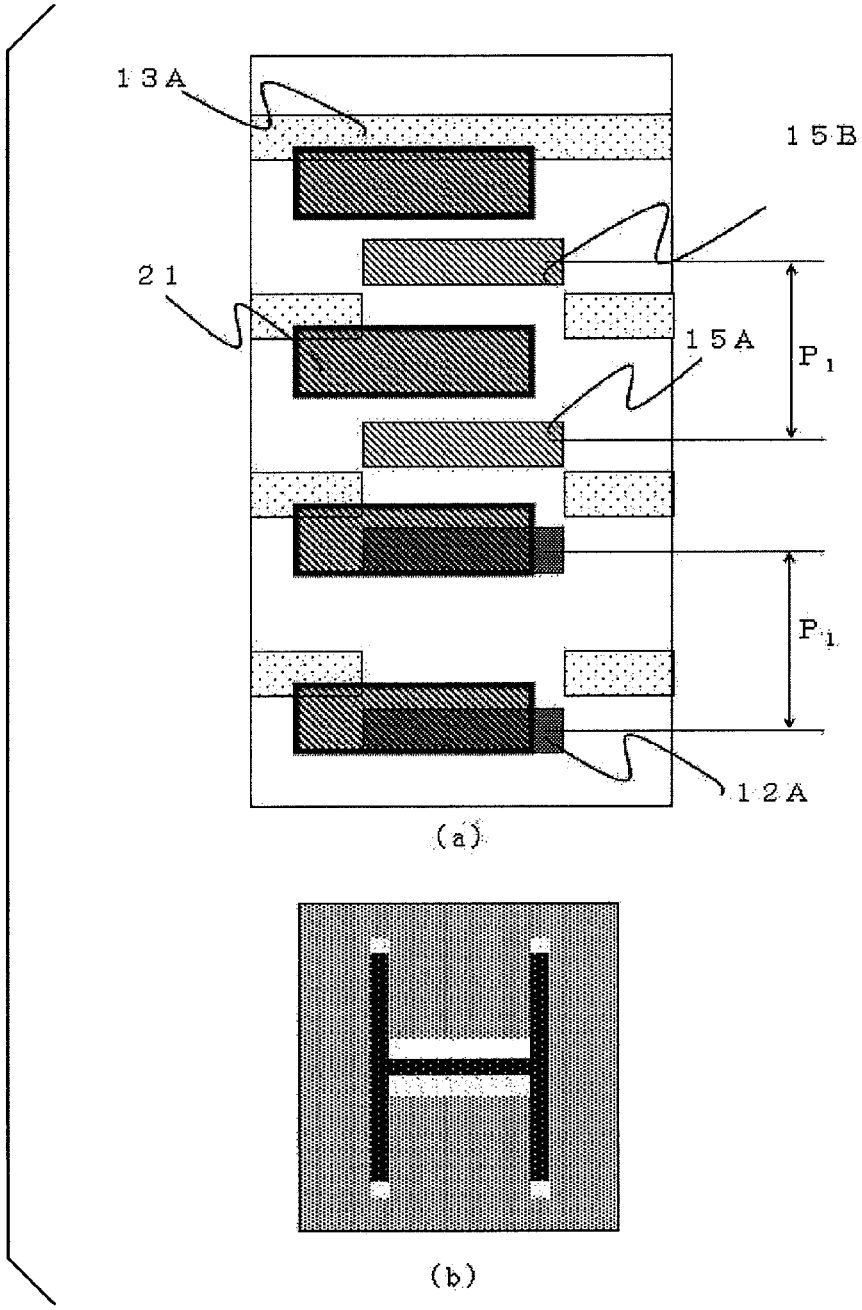
FIG. 56 shows views of a fifteenth arrangement and a latent image upon observation from an oblique direction.

The 15th arrangement in which the second element does not overlap the observation portion (V) of the background adjacent outline element (15B) in the 12th arrangement will be explained next. FIG. 56(*a*) shows an example of this arrangement.

FIG. 56(*a*) illustrates a state in which the background adjacent outline element (15B) is arranged at a distance corresponding to the first pitch ($P_1$) from the latent image adjacent outline element (15A), and the second element (21) does not overlap the observation portion (V) of the background adjacent outline element (15B) in the 12th arrangement. FIG. 56(*a*) also illustrates a state in which the area ratio of the second element (21) overlapping the observation portion (V) of the background element (13A) is smaller than that of the second element (21) overlapping the observation portion (V) of the latent image element (12A).

The latent image pattern formed body (2) of the arrangement shown in FIG. 56(*a*) is observed from the oblique direction. In this case, the portions where the latent image element (12A) and the background element (13A) are formed are observed in the color of the second element (21), and the portions where the latent image adjacent outline element (15A) and the background adjacent outline element (15B) are formed are observed in the color of the substrate (1). As a result, the latent image adjacent outline element (15A) and the background adjacent outline element (15B) are observed as a connected hollow portion, and a latent image having wide outlines is observed, as shown in FIG. 56(*b*).

Figure 57:
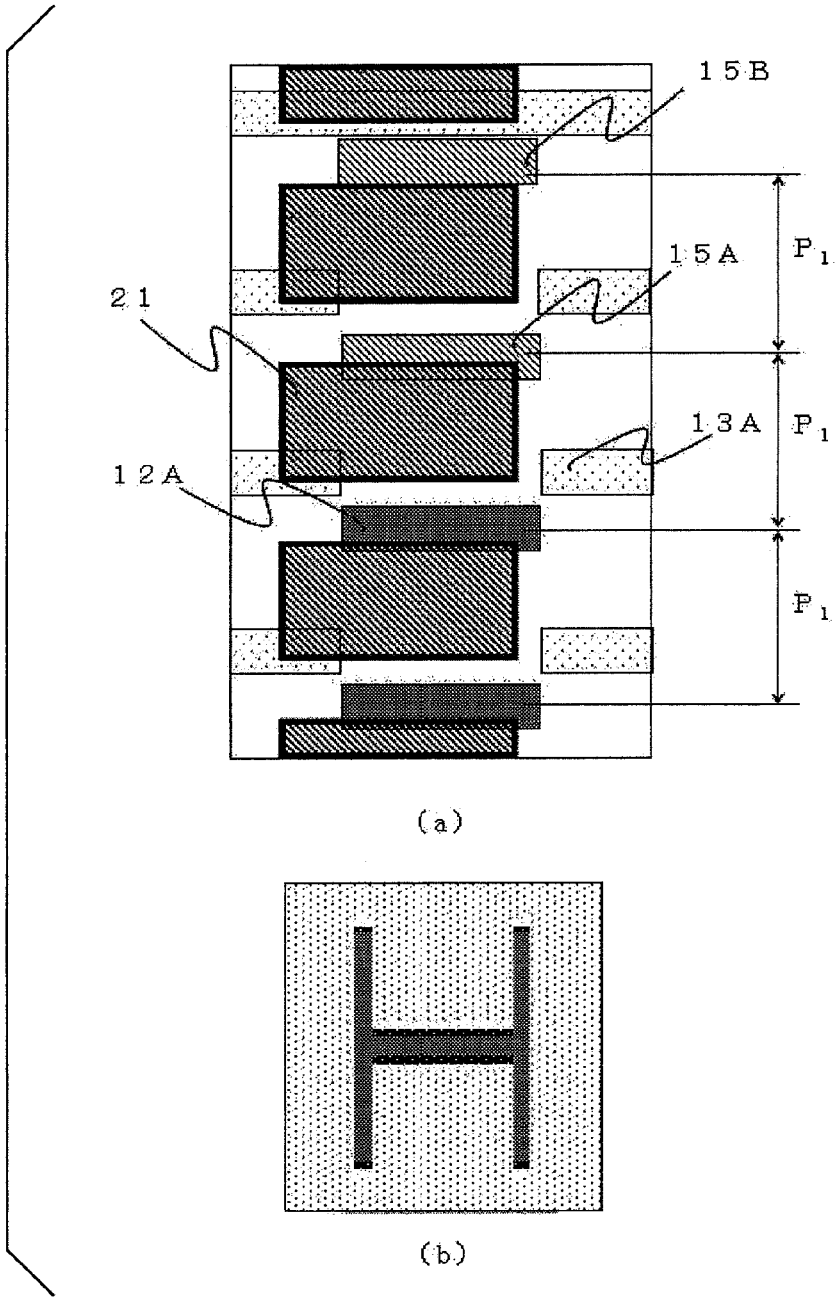
FIG. 57 shows views of a fifteenth arrangement and a latent image upon observation from an oblique direction.

The 15th arrangement in which the second element does not overlap the observation portion (V) of the background adjacent outline element (15B) in the 13th arrangement will be explained next. FIG. 57(*a*) shows an example of this arrangement.

FIG. 57(*a*) illustrates a state in which the latent image adjacent outline element (15A) is arranged on the lower side of the position at a distance corresponding to the first pitch ($P_1$) from the outermost line of the latent image element (12A), the background adjacent outline element (15B) is arranged on the upper side of the position at a distance twice the first pitch ($P_1$) from the outermost line of the latent image element (12A), and the second element (21) does not overlap the observation portion (V) of the background adjacent outline element (15B) in the 13th arrangement. FIG. 57(*a*) also illustrates a state in which the overlap area ratio of the second element (21) for the observation portion (V) of each element becomes smaller in the order of the latent image adjacent outline element (15A), the latent image element (12A), and the background element (13A).

The latent image pattern formed body (2) of the arrangement shown in FIG. 57(*a*) is observed from the oblique direction. In this case, the portions where the latent image adjacent outline element (15A), the latent image element (12A), and the background element (13A) are formed are observed in the color of the second element (21), and the portion where the background adjacent outline element (15B) is formed is observed in the color of the substrate (1). At this time, since the overlap area ratio of the second element (21) becomes smaller in the order of the latent image adjacent outline element (15A), the latent image element (12A), and the background element (13A), the elements are visually recognized at a lower density in the order of the latent image adjacent outline element (15A), the latent image element (12A), and the background element (13A). As a result, the latent image having hollow outlines and outlines in a color different from those of the latent image portion (12) and the background portion (13) is observed, as shown in FIG. 57(*b*).

In the 16th arrangement, the second element (21) also overlaps at least part of the observation portion (V) of the background adjacent outline element (15B) in the 11th to 13th arrangements. In this case, the elements are arranged such that the area ratio of the second element (21) overlapping the observation portion (V) of the background adjacent outline element (15B) is different from that of the second element (21) overlapping the observation portion (V) of the background element (13A). The reason is as follows. In the 11th to 13th arrangements, the second element (21) overlaps the observation portion (V) of the background element (15B). To observe the background adjacent outline element (15B) as an outline, the area ratio of the second element (21) overlapping the observation portion (V) of the background adjacent outline element (15B) needs to be different from that of the second element (21) overlapping the observation portion (V) of the background element (13A). The 16th arrangement will be described sequentially based on the 11th to 13th arrangements.

Figure 58:
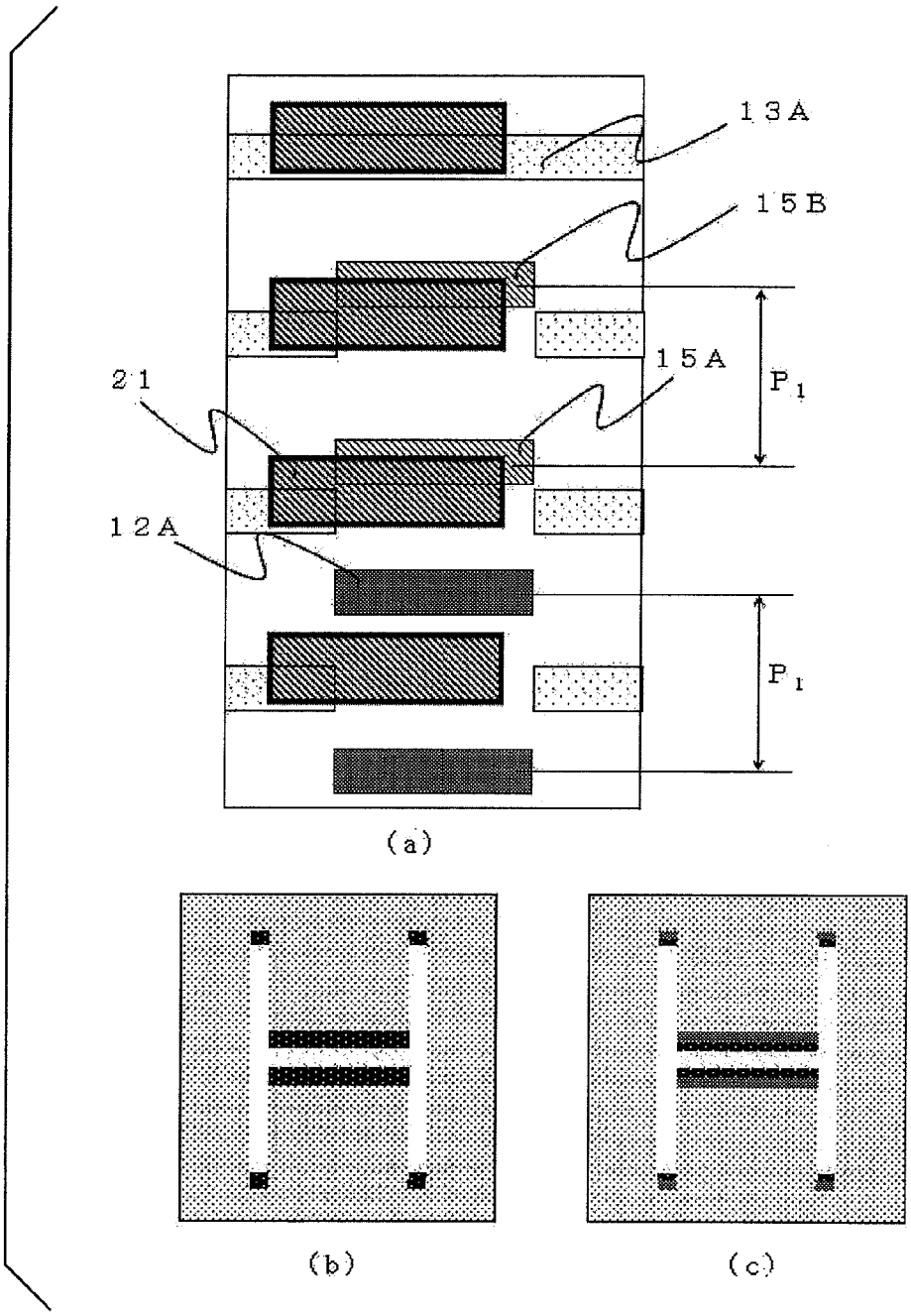
FIG. 58 shows views of a sixteenth arrangement and a latent image upon observation from an oblique direction.

The 16th arrangement in which the second element overlaps at least part of the observation portion (V) of the background adjacent outline element (15B) in the 11th arrangement will be explained first. FIG. 58(*a*) shows an example of this arrangement.

FIG. 58(*a*) illustrates a state in which the background adjacent outline element (15B) is arranged at a distance corresponding to the first pitch ($P_1$) from the latent image adjacent outline element (15A), and the second element (21) also overlaps the entire observation portion (V) of the background adjacent outline element (15B) in the 11th arrangement. Note that since the background adjacent outline element (15B) is arranged at a distance corresponding to the first pitch ($P_1$) from the latent image adjacent outline element (15A), the area ratio of the second element (21) overlapping the observation portion (V) of the background adjacent outline element (15B) equals that of the second element (21) overlapping the observation portion (V) of the latent image adjacent outline element (15A). FIG. 58(*a*) also illustrates a state in which the area ratio of the second element (21) overlapping the observation portion (V) of the latent image adjacent outline element (15A) and that of the second element (21) overlapping the observation portion (V) of the background adjacent outline element (15B) are larger than that of the second element (21) overlapping the observation portion (V) of the background element (13A).

The latent image pattern formed body (2) of the arrangement shown in FIG. 58(*a*) is observed from the oblique direction. In this case, the portions where the latent image adjacent outline element (15A), the background adjacent outline element (15B), and the background element (13A) are formed are observed in the color of the second element (21). At this time, the latent image adjacent outline element (15A) and the background adjacent outline element (15B) are visually recognized in a color darker than that of the background element (13A) because the overlap area ratios of the second element (21) are larger. In addition, since the area ratio of the second element (21) overlapping the observation portion (V) of the latent image adjacent outline element (15A) equals that of the second element (21) overlapping the observation portion (V) of the background adjacent outline element (15B), the latent image adjacent outline element (15A) and the background adjacent outline element (15B) are visually recognized in the same color. As a result, the latent image adjacent outline element (15A) and the background adjacent outline element (15B) are observed as connected in the same color, and a latent image having wide outlines is observed, as shown in FIG. 58(*b*).

Note that if the area ratio of the second element (21) overlapping the observation portion (V) of the background adjacent outline element (15B) is different from that of the second element (21) overlapping the observation portion (V) of the latent image adjacent outline element (15A) in the arrangement shown in FIG. 58(*a*), the background adjacent outline element (15B) is observed as an outline in a color different from those of the latent image element (12A), the background element (13A), and the latent image adjacent outline element (15A). FIG. 58(*c*) shows an example of the arrangement.

Figure 59:
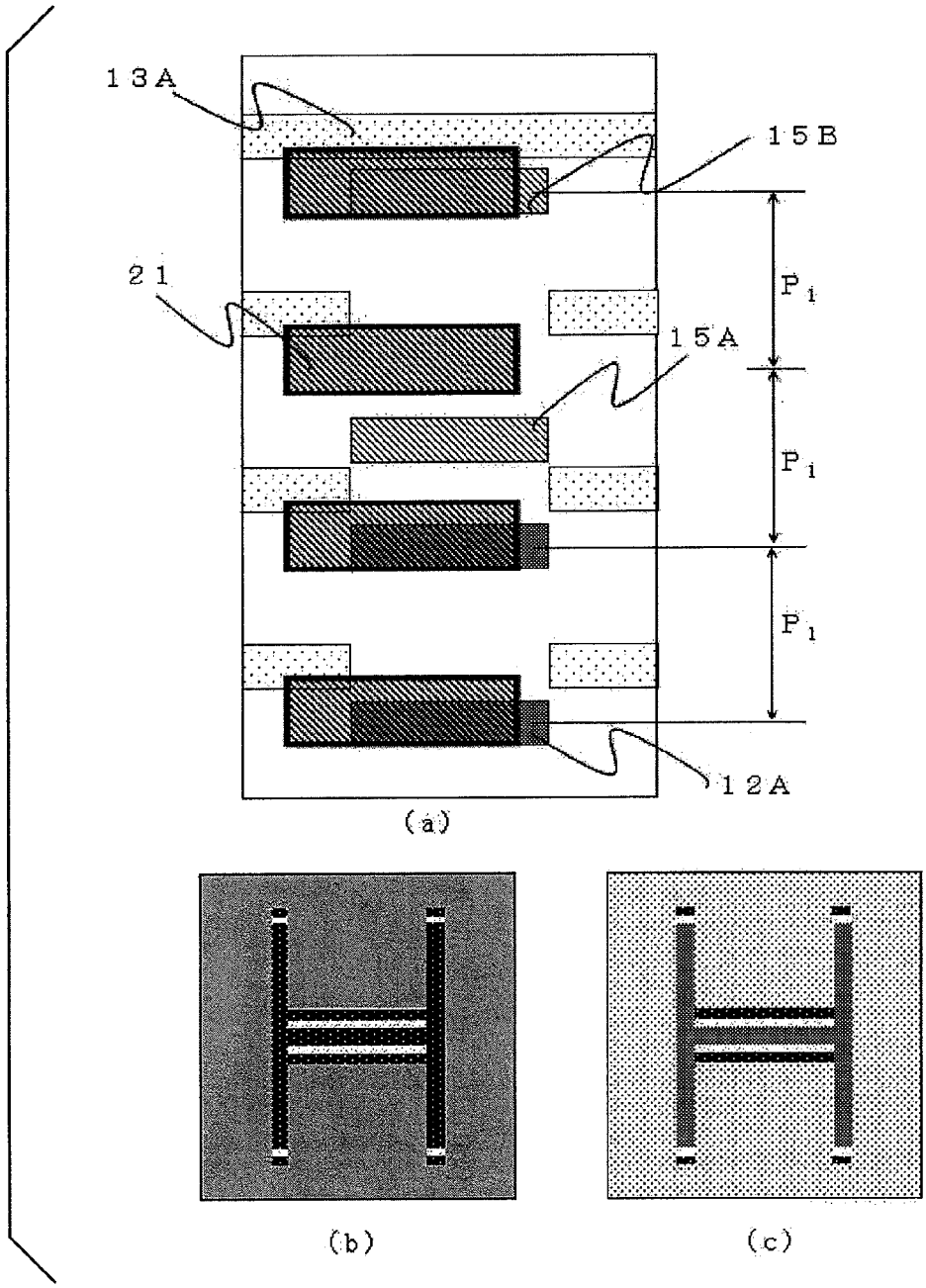
FIG. 59 shows views of a sixteenth arrangement and a latent image upon observation from an oblique direction.

The 16th arrangement in which the second element overlaps at least part of the observation portion (V) of the background adjacent outline element (15B) in the 12th arrangement will be explained next. FIG. 59(*a*) shows an example of this arrangement.

FIG. 59(*a*) illustrates a state in which the background adjacent outline element (15B) is arranged at a distance twice the first pitch ($P_1$) from the outermost line of the latent image element (12A), and the second element (21) also overlaps the entire background adjacent outline element (15B) in the 12th arrangement. Note that since the background adjacent outline element (15B) is arranged at a distance twice the first pitch ($P_1$) from the outermost line of the latent image element (12A), the area ratio of the second element (21) overlapping the observation portion (V) of the background adjacent outline element (15B) equals that of the second element (21) overlapping the observation portion (V) of the latent image element (12A). FIG. 59(*a*) also illustrates a state in which the area ratio of the second element (21) overlapping the observation portion (V) of the latent image element (12A) and that of the second element (21) overlapping the observation portion (V) of the background adjacent outline element (15B) are larger than that of the second element (21) overlapping the observation portion (V) of the background element (13A).

The latent image pattern formed body (2) of the arrangement shown in FIG. 59(*a*) is observed from the oblique direction. In this case, the portions where the background adjacent outline element (15B), the latent image element (12A), and the background element (13A) are formed are observed in the color of the second element (21). At this time, the latent image element (12A) and the background adjacent outline element (15B) are visually recognized in a color darker than that of the background element (13A) because the overlap area ratios of the second element (21) are larger. In addition, since the area ratio of the second element (21) overlapping the observation portion (V) of the latent image element (12A) equals that of the second element (21) overlapping the observation portion (V) of the background adjacent outline element (15B), the latent image element (12A) and the background adjacent outline element (15B) are visually recognized in the same color. As a result, the outline by the background adjacent outline element (15B) is observed away from the latent image portion (12) while placing, between them, the portion where the latent image adjacent outline element (15A) is formed, and a latent image having double outlines is observed, as shown in FIG. 59(*b*).

Note that if the area ratio of the second element (21) overlapping the observation portion (V) of the background adjacent outline element (15B) is different from that of the second element (21) overlapping the observation portion (V) of the latent image element (12A) in the arrangement shown in FIG. 59(*a*), the background adjacent outline element (15B) is observed as double outlines in a color different from those of the latent image element (12A), the background element (13A), and the latent image adjacent outline element (15A). FIG. 59(*c*) shows an example of the arrangement.

Figure 60:
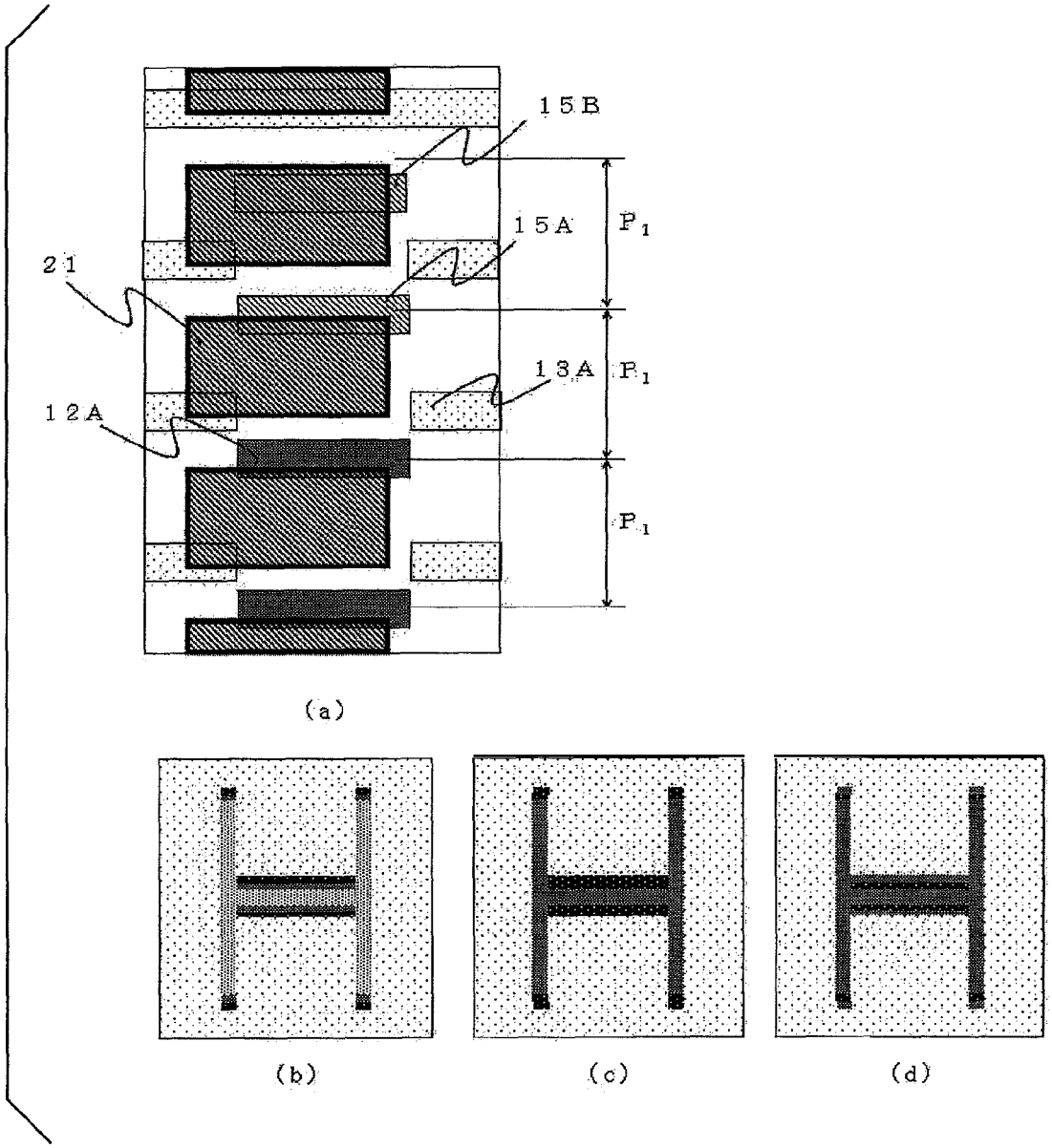
FIG. 60 shows views of a sixteenth arrangement and a latent image upon observation from an oblique direction.

The 16th arrangement in which the second element overlaps at least part of the observation portion (V) of the background adjacent outline element (15B) in the 13th arrangement will be explained next. FIG. 60(*a*) shows an example of this arrangement.

FIG. 60(*a*) illustrates a state in which the latent image adjacent outline element (15A) is arranged on the lower side of the position at a distance corresponding to the first pitch ($P_1$) from the outermost line of the latent image element (12A), the background adjacent outline element (15B) is arranged on the lower side of the position at a distance twice the first pitch ($P_1$) from the outermost line of the latent image element (12A), and the second element (21) also overlaps the entire background adjacent outline element (15B) in the 13th arrangement. FIG. 60(*a*) also illustrates a state in which the area ratio of the second element (21) overlapping the observation portion (V) of each element becomes smaller in the order of the background adjacent outline element (15B), the latent image adjacent outline element (15A), the latent image element (12A), and the background element (13A).

The latent image pattern formed body (2) of the arrangement shown in FIG. 60(*a*) is observed from the oblique direction. In this case, the portions where the latent image adjacent outline element (15A), the background adjacent outline element (15B), the latent image element (12A), and the background element (13A) are formed are observed in the color of the second element (21). At this time, the elements are observed at a lower density in the order of the background adjacent outline element (15B), the latent image adjacent outline element (15A), the latent image element (12A), and the background element (13A). As a result, a latent image for which two different outlines in different colors appear is observed, as shown in FIG. 60(*b*).

Note that if the area ratio of the second element (21) overlapping the observation portion (V) of the background adjacent outline element (15B) equals that of the second element (21) overlapping the observation portion (V) of the latent image adjacent outline element (15A) in the arrangement shown in FIG. 60(*a*), the latent image adjacent outline element (15A) and the background adjacent outline element (15B) are observed as connected in the same color, and a latent image having wide outlines is observed, as shown in FIG. 60(*c*). In addition, when the area ratio of the second element (21) overlapping the observation portion (V) of the background adjacent outline element (15B) equals that of the second element (21) overlapping the observation portion (V) of the latent image element (12A), the latent image element (12A) and the background adjacent outline element (15B) are observed in the same color while the latent image adjacent outline element (15A) is observed in a different color between them so that a latent image having double outlines is observed, as shown in FIG. 60(*d*).

The arrangements in which the second element (21) overlaps the first pattern (10) having the structure of the outline portion (14) shown in FIG. 44(*a*) have been described above. An arrangement in which the second element (21) overlaps the first pattern (10) having the structure of the outline portion (14) shown in FIG. 44(*b*) will be explained next.

Figure 61:
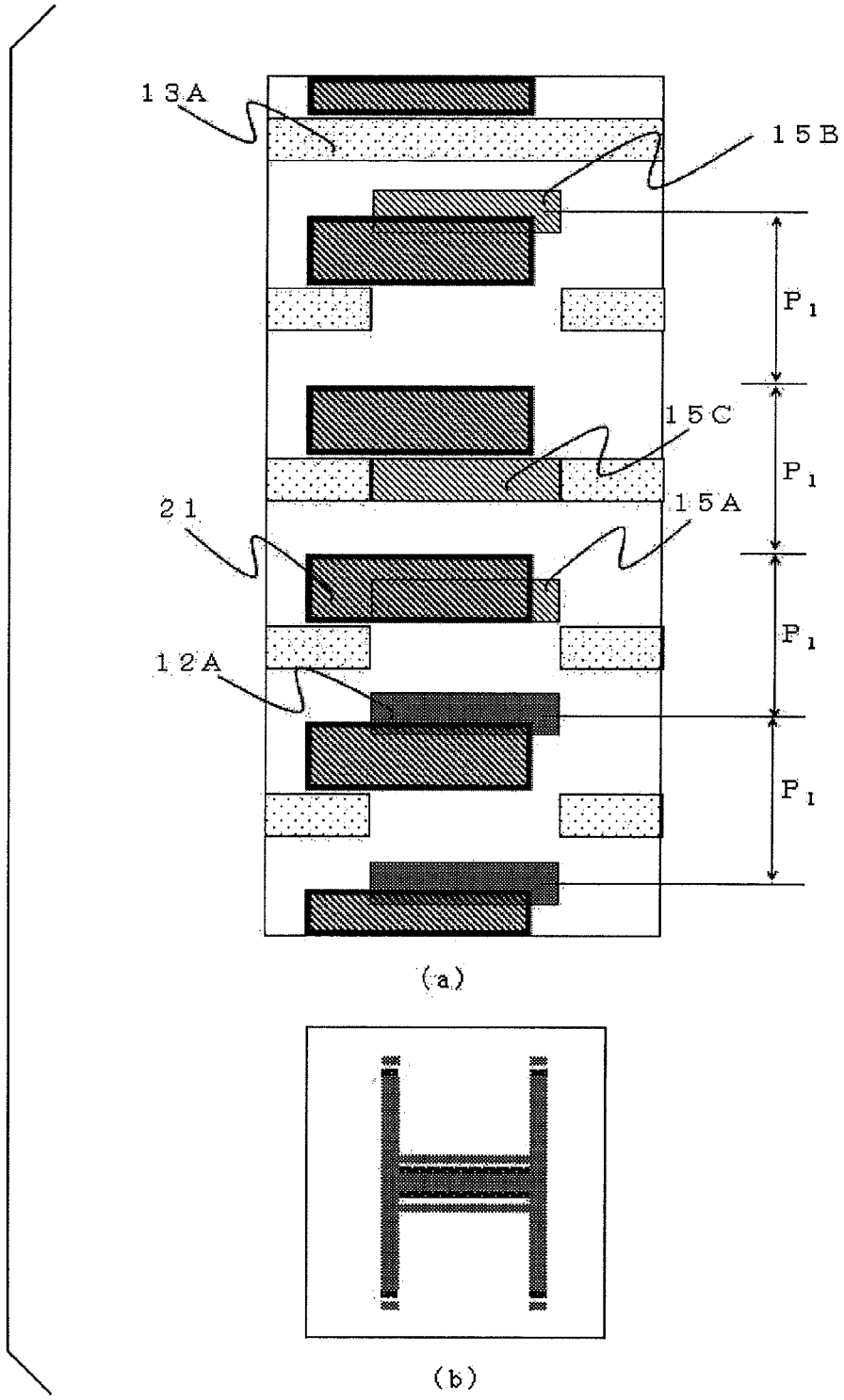
FIG. 61 shows views of a seventeenth arrangement and a latent image upon observation from an oblique direction.

In the 17th arrangement, the second element (21) does not overlap the observation portion (V) of the outline element (15C) in the 14th arrangement. FIG. 61(*a*) shows an example of this arrangement.

FIG. 61(*a*) illustrates a state in which the background adjacent outline element (15B) is arranged at a distance three times the first pitch ($P_1$) from the outermost line of the latent image element (12A), the outline element (15C) is arranged between the latent image adjacent outline element (15A) and the background adjacent outline element (15B), and the second element (21) does not overlap the observation portion (V) of the outline element (15C) in the 10th arrangement. The phase of the outline element (15C) is not different from that of the background element (13A). For this reason, in the 10th arrangement in which the second element (21) does not overlap the observation portion (V) of the background element (13A), the second element (21) does not overlap the observation portion (V) of the outline element (15C), either. FIG. 61(*a*) also illustrates a state in which the area ratio of the second element (21) overlapping the observation portion (V) of the latent image element (12A) equals that of the second element (21) overlapping the observation portion (V) of the background adjacent outline element (15B), and the area ratio of the second element (21) overlapping the observation portion (V) of the latent image adjacent outline element (15A) is larger than those of the second element (21) overlapping the observation portion (V) of the latent image element (12A) and the second element (21) overlapping the observation portion (V) of the background adjacent outline element (15B).

The latent image pattern formed body (2) of the arrangement shown in FIG. 61(*a*) is observed from the oblique direction. In this case, the portions where the latent image adjacent outline element (15A), the background adjacent outline element (15B), and the latent image element (12A) are formed are observed in the color of the second element (21), and the portions where the background element (13A) and the outline element (15C) are formed are observed in the color of the substrate (1). At this time, the latent image adjacent outline element (15A) is visually recognized in a color darker than those of the latent image element (12A) and the background adjacent outline element (15B) because the overlap area ratio of the second element (21) is larger. In addition, since the area ratio of the second element (21) overlapping the observation portion (V) of the latent image element (12A) equals that of the second element (21) overlapping the observation portion (V) of the background adjacent outline element (15B), the latent image element (12A) and the background adjacent outline element (15B) are visually recognized in the same color. As a result, the outline by the background adjacent outline element (15B) is observed away from the latent image adjacent outline element (15A) while placing, between them, the portion where the outline element (15C) is formed, as shown in FIG. 61(*b*). Note that as for the outline observed in the 17th arrangement, even when the area ratio of the second element (21) overlapping the observation portion (V) of the background adjacent outline element (15B) equals that of the second element (21) overlapping the observation portion (V) of the latent image adjacent outline element (15A), or the area ratio of the second element (21) overlapping the observation portion (V) of the background adjacent outline element (15B) is different from those of the second element (21) overlapping the observation portion (V) of the latent image element (12A) and the second element (21) overlapping the observation portion (V) of the latent image adjacent outline element (15A), the outline by the background adjacent outline element (15B) is observed away from the latent image adjacent outline element (15A) while placing, between them, the portion where the outline element (15C) is formed (not shown).

In the 18th arrangement, the second element (21) also overlaps at least part of the observation portion (V) of the outline element (15C) in the 15th and 16th arrangements. Note that even in the 18th arrangement, the background adjacent outline element (15B) is observed as the outline of the latent image away from the latent image adjacent outline element (15A) while placing the outline element (15C) between them. Hence, a description will be made based on the example of the 16th arrangement shown in FIG. 58(*a*), and a description of other arrangements and latent images to be observed will be omitted.

Figure 62:
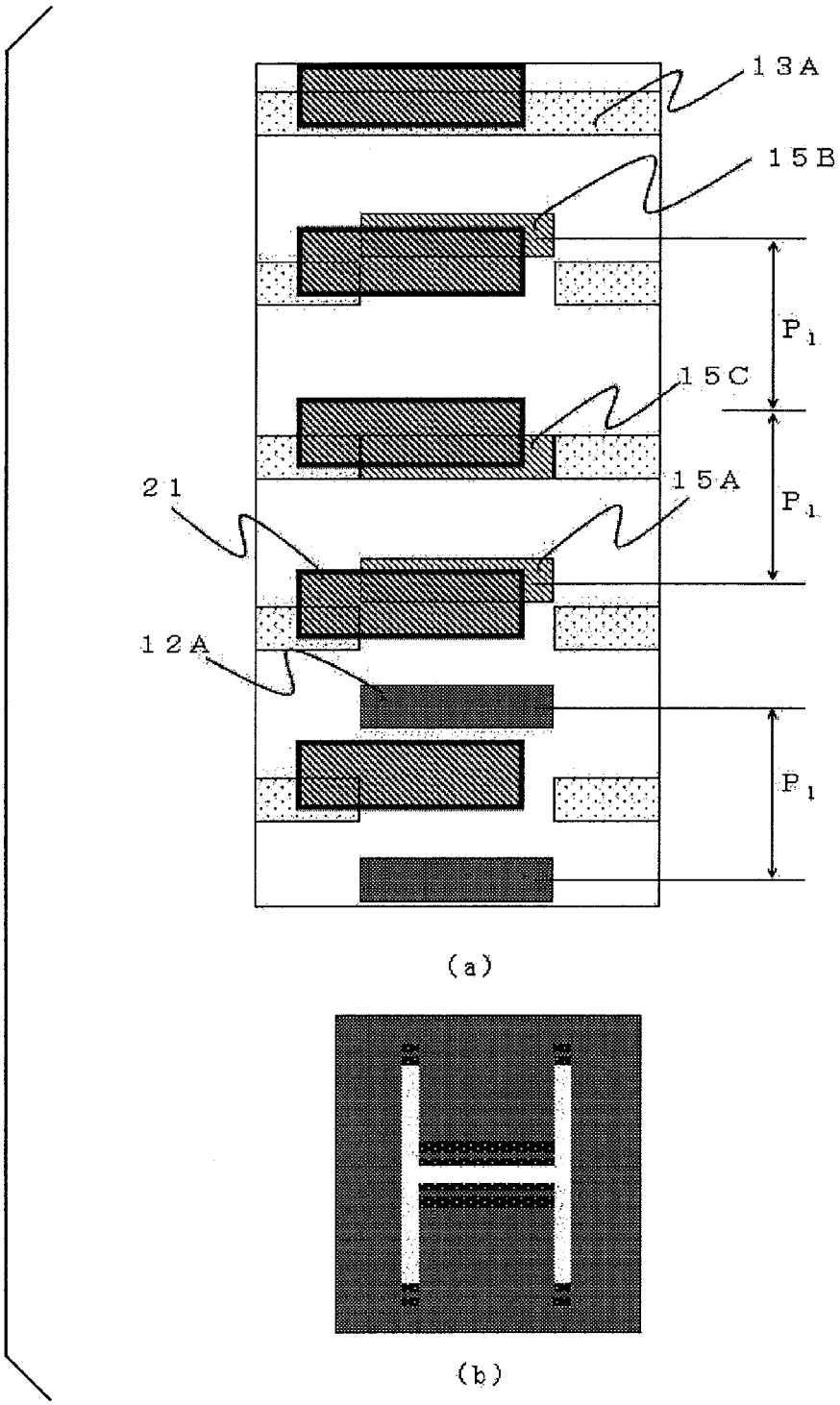
FIG. 62 shows views of an eighteenth arrangement and a latent image upon observation from an oblique direction.

FIG. 62(*a*) is a view showing an example of the 18th arrangement. FIG. 62(*a*) illustrates a state in which the background adjacent outline element (15B) is arranged at a distance twice the first pitch ($P_1$) from the latent image adjacent outline element (15A), the outline element (15C) is arranged between the latent image adjacent outline element (15A) and the background adjacent outline element (15B), and the second element (21) also overlaps part of the observation portion (V) of the outline element (15C) in the 15th arrangement. Note that since the background adjacent outline element (15B) is arranged at the distance twice the first pitch ($P_1$) from the latent image adjacent outline element (15A), the area ratio of the second element (21) overlapping the observation portion (V) of the background adjacent outline element (15B) equals that of the second element (21) overlapping the observation portion (V) of the latent image adjacent outline element (15A). FIG. 62(*a*) also illustrates a state in which the area ratios of the second element (21) overlapping the observation portion (V) of the latent image adjacent outline element (15A) and the second element (21) overlapping the observation portion (V) of the background adjacent outline element (15B) are larger than those of the second element (21) overlapping the observation portion (V) of the background element (13A) and the second element (21) overlapping the observation portion (V) of the outline element (15C).

The latent image pattern formed body (2) of the arrangement shown in FIG. 62(*a*) is observed from the oblique direction. In this case, the portions where the latent image adjacent outline element (15A), the background adjacent outline element (15B), the outline element (15C), and the background element (13A) are formed are observed in the color of the second element (21), and the portion where the latent image element (12A) is formed is observed in the color of the substrate (1). At this time, the latent image adjacent outline element (15A) and the background adjacent outline element (15B) are visually recognized in a color darker than those of the background element (13A) and the outline element (15C) because the overlap area ratios of the second element (21) are larger. In addition, since the area ratio of the second element (21) overlapping the observation portion (V) of the latent image adjacent outline element (15A) equals that of the second element (21) overlapping the observation portion (V) of the background adjacent outline element (15B), the latent image adjacent outline element (15A) and the background adjacent outline element (15B) are visually recognized in the same color. Since the area ratio of the second element (21) overlapping the observation portion (V) of the background element (13A) equals that of the second element (21) overlapping the observation portion (V) of the outline element (15C), the background element (13A) and the outline element (15C) are visually recognized in the same color. As a result, the outline by the background adjacent outline element (15B) is observed away from the latent image adjacent outline element (15A) while placing, between them, the portion where the outline element (15C) is formed, as shown in FIG. 62(*b*).

The arrangements in which the second element (21) overlaps the first pattern (10) having the structure of the outline portion (14) shown in FIG. 44(*b*) have been described above. An arrangement of the second pattern (20) and the first pattern (10) formed from the outline portion (13) including a plurality of background adjacent outline elements (15B) and a latent image to be observed will be explained next. The arrangement of the second pattern (20) and the first pattern (10) formed from the outline portion (14) in which a plurality of background adjacent outline elements (15B) are arranged continuously from the latent image adjacent outline element (15A), as shown in FIG. 46(*a*), and a latent image to be observed will be described first. Note that in the latent image to be observed when a plurality of background adjacent outline elements (15B) are arranged, the outline by the second background adjacent outline element (15$B_2$) is further observed in the 14th to 16th arrangements. Hence, a description will be made based on the example of the 14th arrangement shown in FIG. 54(*a*), and a description of other arrangements and latent images to be observed will be omitted.

Figure 63:
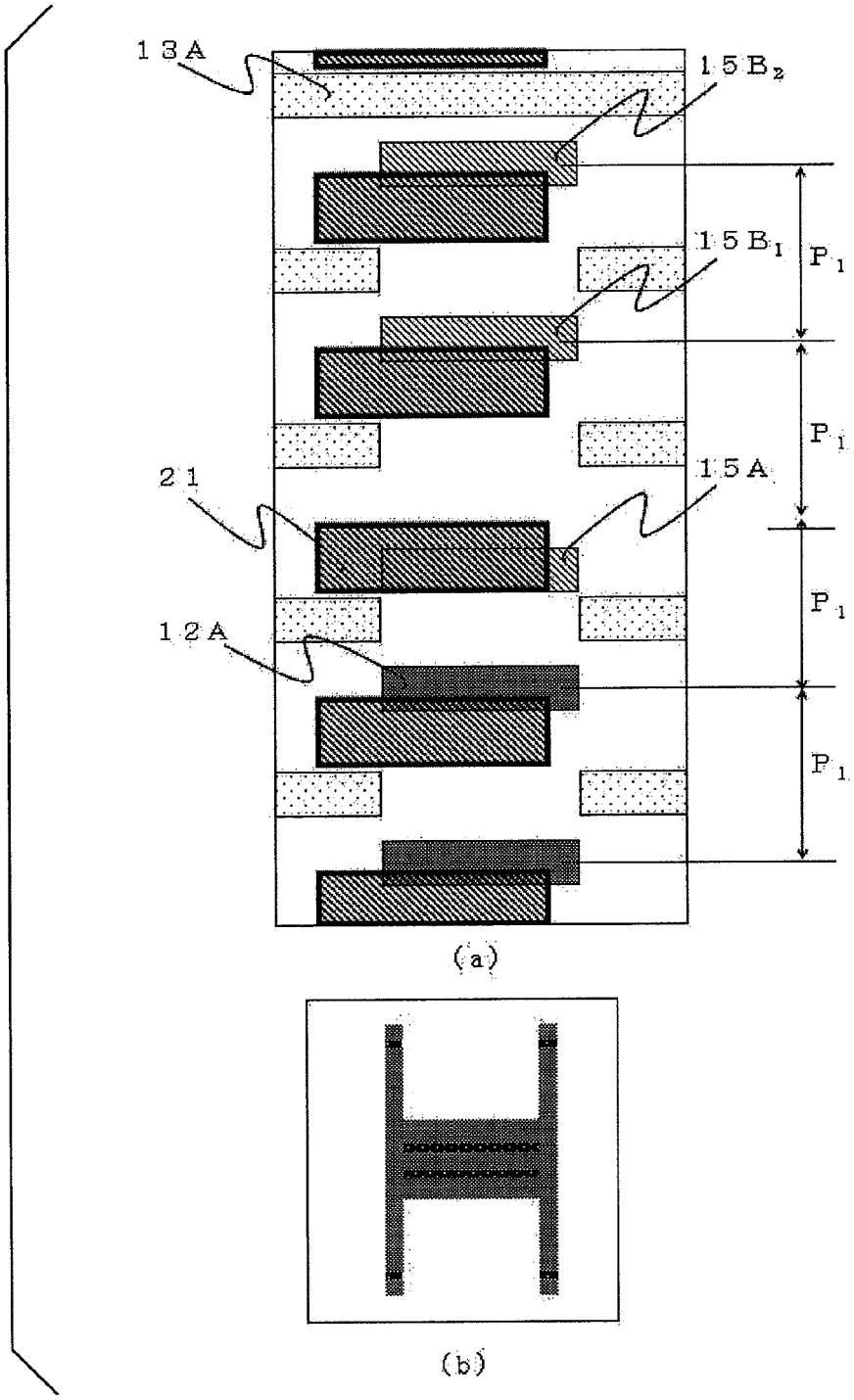
FIG. 63 shows views of the arrangement of the first pattern and the second pattern formed by arranging a plurality of background adjacent outline elements and a latent image observed upon observation from an oblique direction.

FIG. 63(*a*) illustrates a state in which the first and second first elements (11) adjacent to the latent image adjacent outline element (15A) partially change the phase to form the background adjacent outline element (15$B_1$) and the background adjacent outline element (15$B_2$). FIG. 63(*a*) illustrates a state in which the background adjacent outline element (15$B_1$) is arranged at a distance twice the first pitch ($P_1$) from the outermost line of the latent image element (12A), and the background adjacent outline element (15$B_2$) is arranged at a distance three times the first pitch ($P_1$) from the outermost line of the latent image element (12A). In the 14th arrangement, the second element (21) overlaps the observation portion (V) of the background adjacent outline element (15B). In the arrangement shown in FIG. 63(*a*), each of the background adjacent outline element (15$B_1$) and the background adjacent outline element (15$B_2$) is arranged at a distance corresponding to an integer multiple of the first pitch ($P_1$) from the outermost line of the latent image element (12A). For this reason, the area ratio of the second element (21) overlapping the observation portion (V) of the background adjacent outline element (15$B_1$) and that of the second element (21) overlapping the observation portion (V) of the background adjacent outline element (15$B_2$) equal that of the second element (21) overlapping the observation portion (V) of the latent image element (12A). FIG. 63(*a*) also illustrates a state in which the area ratio of the second element (21) overlapping the latent image adjacent outline element (15A) is larger than those of the second element (21) overlapping the observation portion (V) of the background adjacent outline element (15$B_1$), the second element (21) overlapping the observation portion (V) of the background adjacent outline element (15$B_2$), and the second element (21) overlapping the observation portion (V) of the latent image element (12A).

The latent image pattern formed body (2) of the arrangement shown in FIG. 63(*a*) is observed from the oblique direction. In this case, the portions where the background adjacent outline element (15$B_1$), the background adjacent outline element (15$B_2$), the latent image adjacent outline element (15A), and the latent image element (12A) are formed are observed in the color of the second element (21). At this time, the latent image adjacent outline element (15A) is visually recognized in a color darker than those of the background adjacent outline element (15$B_1$), the background adjacent outline element (15$B_2$), and the latent image element (12A) because the overlap area ratio of the second element (21) is larger. In addition, since the area ratio of the second element (21) overlapping the observation portion (V) of the latent image element (12A), that of the second element (21) overlapping the background adjacent outline element (15$B_1$), and that of the second element (21) overlapping the background adjacent outline element (15$B_2$) equal, the background adjacent outline element (15$B_1$), the background adjacent outline element (15$B_2$), and the latent image element (12A) are observed in the same color. As a result, as shown in FIG. 63(*b*), the background adjacent outline element (15$B_1$) and the background adjacent outline element (15$B_2$) are connected, and a latent image having outlines wider than in the latent image shown in FIG. 54(*b*) is observed.

The arrangement of the second pattern (20) and the first pattern (10) formed from the outline portion (13) in which the background adjacent outline element (15$B_1$) and the background adjacent outline element (15$B_2$) are arranged at an interval, as shown in FIG. 46(*b*), and a latent image to be observed will be described next. Note that in the latent image to be observed when the background adjacent outline element (15$B_1$) and the background adjacent outline element (15$B_2$) are arranged at an interval, the outline by the second background adjacent outline element (15$B_2$) is observed away from the background adjacent outline element (15$B_1$) while placing the outline element (15C) between them in the 14th to 16th arrangements. Hence, a description will be made based on the example of the 14th arrangement shown in FIG. 54(*a*), and a description of other arrangements and latent images to be observed will be omitted.

Figure 64:
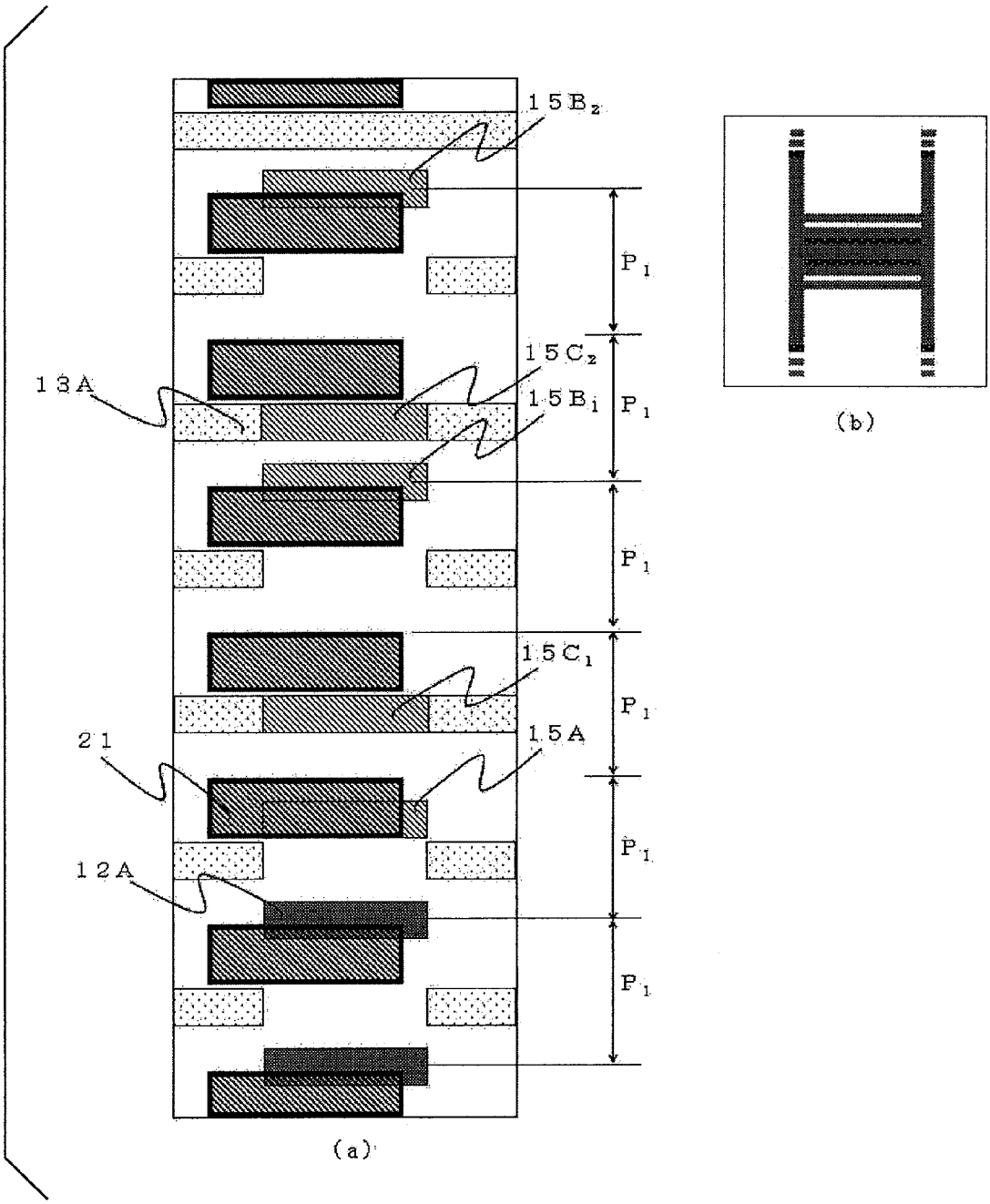
FIG. 64 shows views of the arrangement of the first pattern and the second pattern formed by arranging a plurality of background adjacent outline elements and a latent image observed upon observation from an oblique direction.

FIG. 64(*a*) illustrates a state in which the second and fourth first elements (11) adjacent to the latent image adjacent outline element (15A) partially change the phase to form the background adjacent outline element (15$B_1$) and the background adjacent outline element (15$B_2$). FIG. 64(*a*) illustrates a state in which the background adjacent outline element (15$B_1$) is arranged at a distance three times the first pitch ($P_1$) from the outermost line of the latent image element (12A), and the background adjacent outline element (15$B_2$) is arranged at a distance five times the first pitch ($P_1$) from the outermost line of the latent image element (12A). In the 14th arrangement, the second element (21) overlaps the observation portion (V) of the background adjacent outline element (15B). In the arrangement shown in FIG. 64(*a*), each of the background adjacent outline element (15$B_1$) and the background adjacent outline element (15$B_2$) is arranged at a distance corresponding to an integer multiple of the first pitch ($P_1$) from the outermost line of the latent image element (12A). For this reason, the area ratio of the second element (21) overlapping the observation portion (V) of the background adjacent outline element (15$B_1$) and that of the second element (21) overlapping the observation portion (V) of the background adjacent outline element (15$B_2$) equal that of the second element (21) overlapping the observation portion (V) of the latent image element (12A). FIG. 64(*a*) also illustrates a state in which the area ratio of the second element (21) overlapping the latent image adjacent outline element (15A) is larger than those of the second element (21) overlapping the observation portion (V) of the background adjacent outline element (15$B_1$), the second element (21) overlapping the observation portion (V) of the background adjacent outline element (15$B_2$), and the second element (21) overlapping the observation portion (V) of the latent image element (12A).

The latent image pattern formed body (2) of the arrangement shown in FIG. 64(*a*) is observed from the oblique direction. In this case, the portions where the background adjacent outline element (15$B_1$), the background adjacent outline element (15$B_2$), the latent image adjacent outline element (15A), and the latent image element (12A) are formed are observed in the color of the second element (21). At this time, the latent image adjacent outline element (15A) is visually recognized in a color darker than those of the background adjacent outline element (15$B_1$), the background adjacent outline element (15$B_2$), and the latent image element (12A) because the overlap area ratio of the second element (21) is larger. In addition, since the area ratio of the second element (21) overlapping the observation portion (V) of the latent image element (12A), that of the second element (21) overlapping the background adjacent outline element (15$B_1$), and that of the second element (21) overlapping the background adjacent outline element (15$B_2$) equal, the latent image element (12A), the background adjacent outline element (15$B_1$), and the background adjacent outline element (15$B_2$) are observed in the same color. As a result, as shown in FIG. 64(*b*), the background adjacent outline element (15$B_2$) is observed away from the background adjacent outline element (15$B_1$) while placing the outline element (15$C_2$) between them in the latent image shown in FIG. 54(*b*).

As described above, in the second structure of the outline portion (14), arranging the background adjacent outline element (15B) makes it possible to observe a latent image having outlines in a color different from that of the latent image adjacent outline element (15A), double outlines, or wider outlines.

An arrangement in which the second pattern (20) overlaps the first pattern (10) having the third structure of the outline portion (14) according to the third embodiment will be explained next. There are five different arrangements in which the second pattern (20) overlaps the third structure of the outline portion (14). The arrangements will be described as the 19th to 23rd arrangements.

Figure 65:
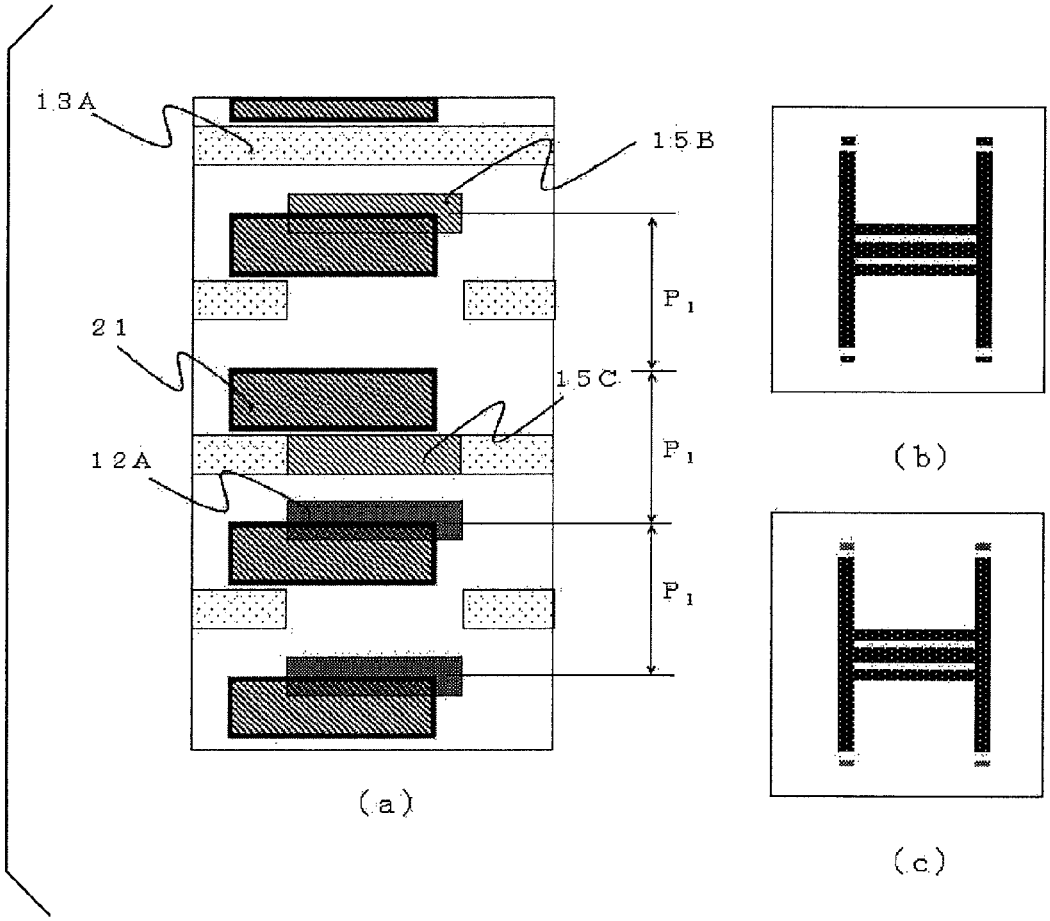
FIG. 65 shows views of a nineteenth arrangement and a latent image upon observation from an oblique direction.

In the 19th arrangement, the second element (21) overlaps at least part of the observation portion (V) of the latent image element (12A) and at least part of the observation portion (V) of the background adjacent outline element (15B) but not the observation portion (V) of the background element (13A) and the observation portion (V) of the outline element (15C). In this case, the area ratio of the second element (21) overlapping the observation portion (V) of the background adjacent outline element (15B) may be equal to or different from that of the second element (21) overlapping the observation portion (V) of the latent image element (12A). FIG. 65(*a*) shows an example of this arrangement.

FIG. 65(*a*) illustrates a state in which the background adjacent outline element (15B) is arranged at a distance twice the first pitch ($P_1$) from the outermost line of the latent image element (12A), the second element (21) overlaps the entire observation portion (V) of the latent image element (12A) and the entire observation portion (V) of the background adjacent outline element (15B) but not the background element (13A) and the outline element (15C). Note that since the background adjacent outline element (15B) is arranged at a distance twice the first pitch ($P_1$) from the outermost line of the latent image element (12A), the area ratio of the second element (21) overlapping the observation portion (V) of the background adjacent outline element (15B) equals that of the second element (21) overlapping the observation portion (V) of the latent image element (12A).

The latent image pattern formed body (2) of the 19th arrangement shown in FIG. 65(*a*) is observed from the oblique direction. In this case, the portions where the background adjacent outline element (15B) and the latent image element (12A) are formed are observed in the color of the second element (21). At this time, since the area ratio of the second element (21) overlapping the observation portion (V) of the latent image element (12A) equals that of the second element (21) overlapping the observation portion (V) of the background adjacent outline element (15B), the latent image element (12A) and the background adjacent outline element (15B) are visually recognized in the same color. As a result, the background adjacent outline element (15B) is observed away from the outermost line of the latent image element (12A) while placing the outline element (15C) between them, and a latent image having double outlines is observed, as shown in FIG. 65(*b*).

Note that when the area ratio of the second element (21) overlapping the observation portion (V) of the background adjacent outline element (15B) is different from that of the second element (21) overlapping the observation portion (V) of the latent image element (12A) in the 19th arrangement shown in FIG. 65(*a*), the double outlines are observed in a color different from that of the latent image portion (12), as shown in FIG. 65(*c*).

Figure 66:
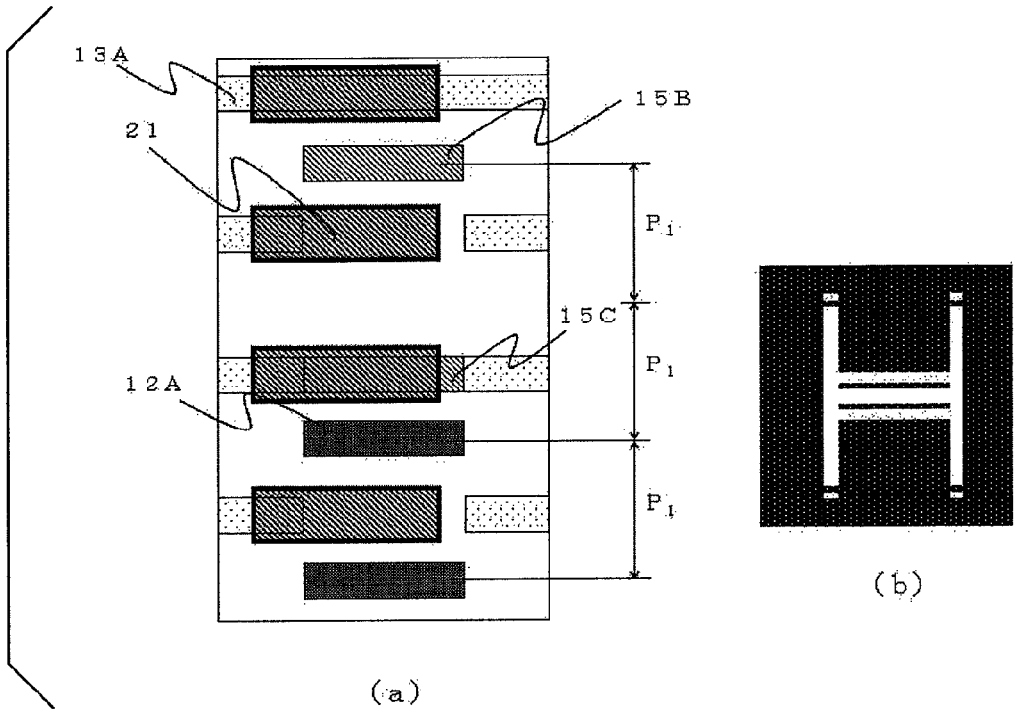
FIG. 66 shows views of a twentieth arrangement and a latent image upon observation from an oblique direction.

In the 20th arrangement, the second element (21) overlaps at least part of the observation portion (V) of the background element (13A) and at least part of the observation portion (V) of the outline element (15C) but not the observation portion (V) of the latent image element (12A) and the observation portion (V) of the background adjacent outline element (15B). FIG. 66(*a*) shows an example of this arrangement.

FIG. 66(*a*) illustrates a state in which the background adjacent outline element (15B) is arranged at a distance twice the first pitch ($P_1$) from the outermost line of the latent image element (12A), the second element (21) overlaps the entire background element (13A) and the entire outline element (15C) but not the latent image element (12A) and the background adjacent outline element (15B). Note that since the phase of the outline element (15C) is not different from that of the background element (13A), the area ratio of the second element (21) overlapping the observation portion (V) of the background element (13A) equals that of the second element (21) overlapping the observation portion (V) of the outline element (15C).

The latent image pattern formed body (2) of the 20th arrangement shown in FIG. 66(*a*) is observed from the oblique direction. In this case, the portions where the background element (13A) and the outline element (15C) are formed are observed in the color of the second element (21). At this time, since the area ratio of the second element (21) overlapping the observation portion (V) of the background element (13A) equals that of the second element (21) overlapping the observation portion (V) of the outline element (15C), the background element (13A) and the outline element (15C) are visually recognized in the same color. As a result, a hollow latent image having double outlines is observed, as shown in FIG. 66(*b*).

Figure 67:
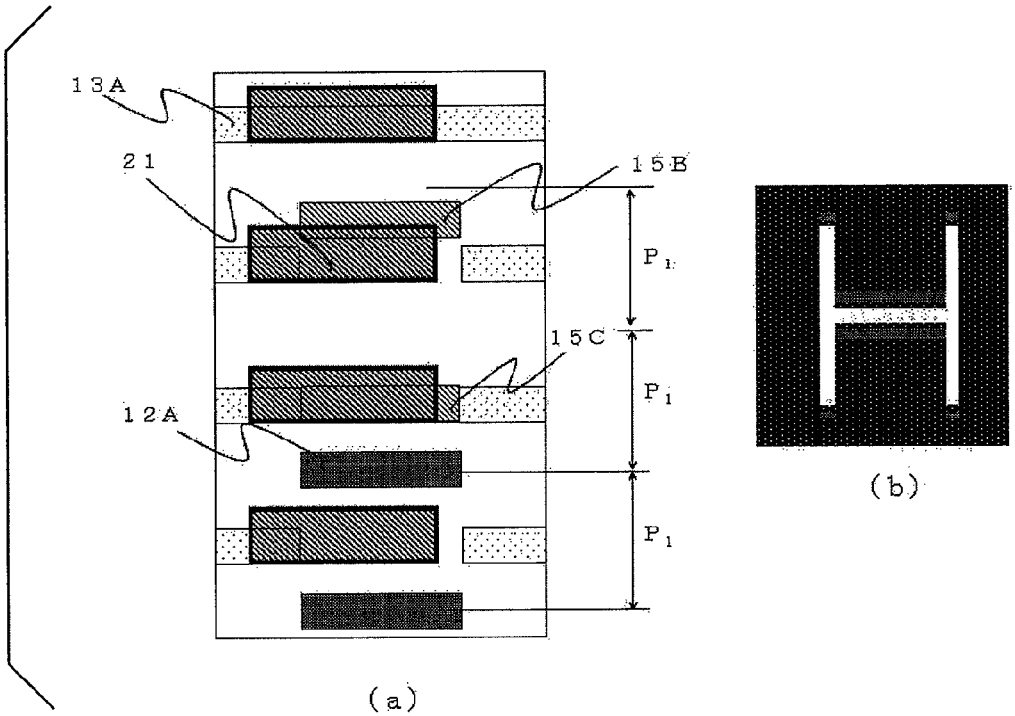
FIG. 67 shows views of a twenty-first arrangement and a latent image upon observation from an oblique direction.

In the 21st arrangement, the second element (21) also overlaps at least part of the observation portion (V) of the background adjacent outline element (15B) in the 20th arrangement. In this case, the elements are arranged such that the area ratio of the second element (21) overlapping the observation portion (V) of the background adjacent outline element (15B) is different from those of the second element (21) overlapping the observation portion (V) of the background element (13A) and the second element (21) overlapping the observation portion (V) of the outline element (15C). FIG. 67(*a*) shows an example of this arrangement.

FIG. 67(*a*) illustrates a state in which the background adjacent outline element (15B) is arranged on the lower side of the position at a distance twice the first pitch ($P_1$) from the outermost line of the latent image element (12A), and the second element (21) overlaps the entire background element (13A), the entire outline element (15C), and part of the observation portion (V) of the background adjacent outline element (15B) but not the latent image element (12A). FIG. 67(*a*) also illustrates a state in which the area ratio of the second element (21) overlapping the observation portion (V) of the background element (13A) equals that of the second element (21) overlapping the observation portion (V) of the outline element (15C), and the area ratio of the second element (21) overlapping the observation portion (V) of the background element (13A) and that of the second element (21) overlapping the observation portion (V) of the outline element (15C) are larger than that of the second element (21) overlapping the observation portion (V) of the background adjacent outline element (15B).

The latent image pattern formed body (2) of the 21st arrangement shown in FIG. 67(*a*) is observed from the oblique direction. In this case, the portions where the background element (13A), the background adjacent outline element (15B), and the outline element (15C) are formed are observed in the color of the second element (21). At this time, since the overlap area ratio of the second element (21) is smaller for the background adjacent outline element (15B) than for the background element (13A) and the outline element (15C), the background adjacent outline element (15B) is observed at a density lower than those of the background element (13A) and the outline element (15C). As a result, a latent image having double outlines is observed based on the background adjacent outline element (15B) observed in a color different from those of the latent image element (12A), background element (13A), and the outline element (15C), as shown in FIG. 67(*b*).

Figure 68:
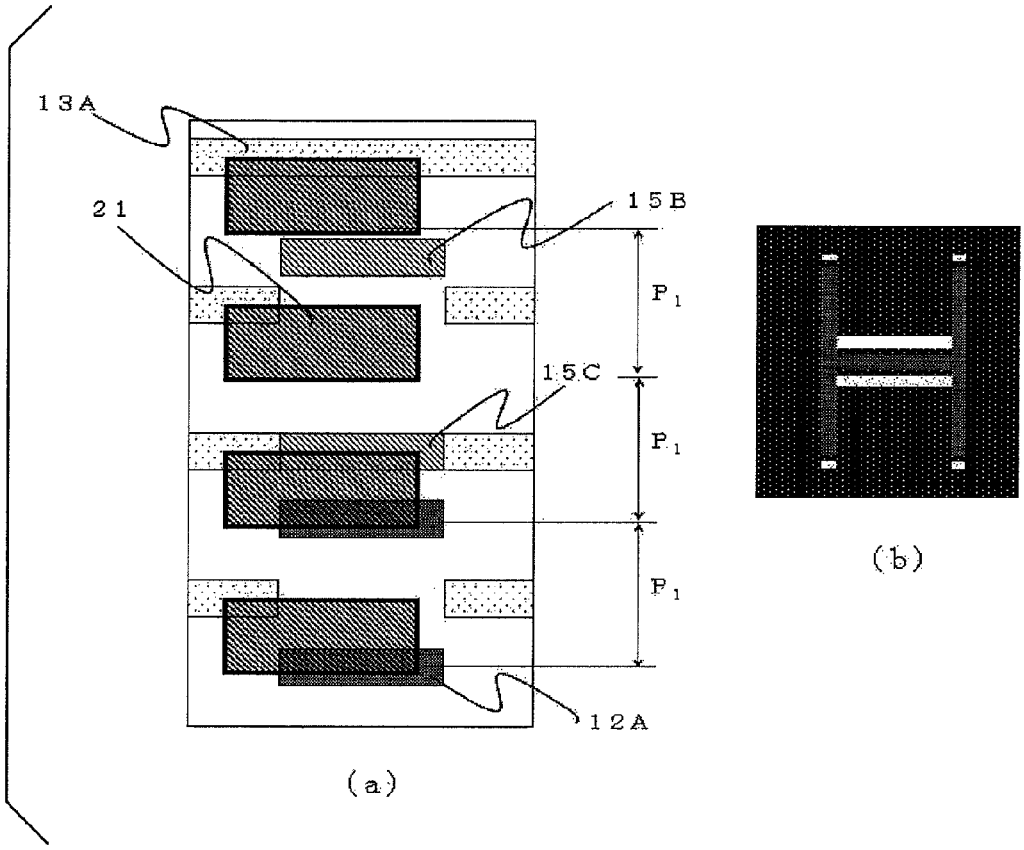
FIG. 68 shows views of a twenty-second arrangement and a latent image upon observation from an oblique direction.

In the 22nd arrangement, the second element (21) also overlaps at least part of the observation portion (V) of the latent image element (12A) in the 20th arrangement. In this case, the elements are arranged such that the area ratio of the second element (21) overlapping latent image element (12A) is different from those of the second element (21) overlapping the observation portion (V) of the background element (13A) and the second element (21) overlapping the observation portion (V) of the outline element (15C). FIG. 68(*a*) shows an example of this arrangement.

FIG. 68(*a*) illustrates a state in which the background adjacent outline element (15B) is arranged on the lower side of the position at a distance twice the first pitch ($P_1$) from the outermost line of the latent image element (12A), and the second element (21) overlaps the entire observation portion (V) of the background element (13A), the entire observation portion (V) of the outline element (15C), and part of the observation portion (V) and the entire non-observation portion (V') of the latent image element (12A) but not the background adjacent outline element (15B). FIG. 68(*a*) also illustrates a state in which the area ratio of the second element (21) overlapping the observation portion (V) of the background element (13A) and that of the second element (21) overlapping the observation portion (V) of the outline element (15C) are larger than that of the second element (21) overlapping the observation portion (V) of the latent image element (12A).

The latent image pattern formed body (2) of the 22nd arrangement shown in FIG. 68(*a*) is observed from the oblique direction. In this case, the portions where the latent image element (12A), the background element (13A), and the outline element (15C) are formed are observed in the color of the second element (21), and the portion where the background adjacent outline element (15B) is formed is observed in the color of the substrate (1). At this time, since the overlap area ratio of the second element (21) is smaller for the latent image element (12A) than for the background element (13A) and the outline element (15C), the latent image element (12A) is observed at a density lower than those of the background element (13A) and the outline element (15C). As a result, a latent image having double outlines is observed based on the background adjacent outline element (15B) observed as hollow, as shown in FIG. 68(*b*).

Figure 69:
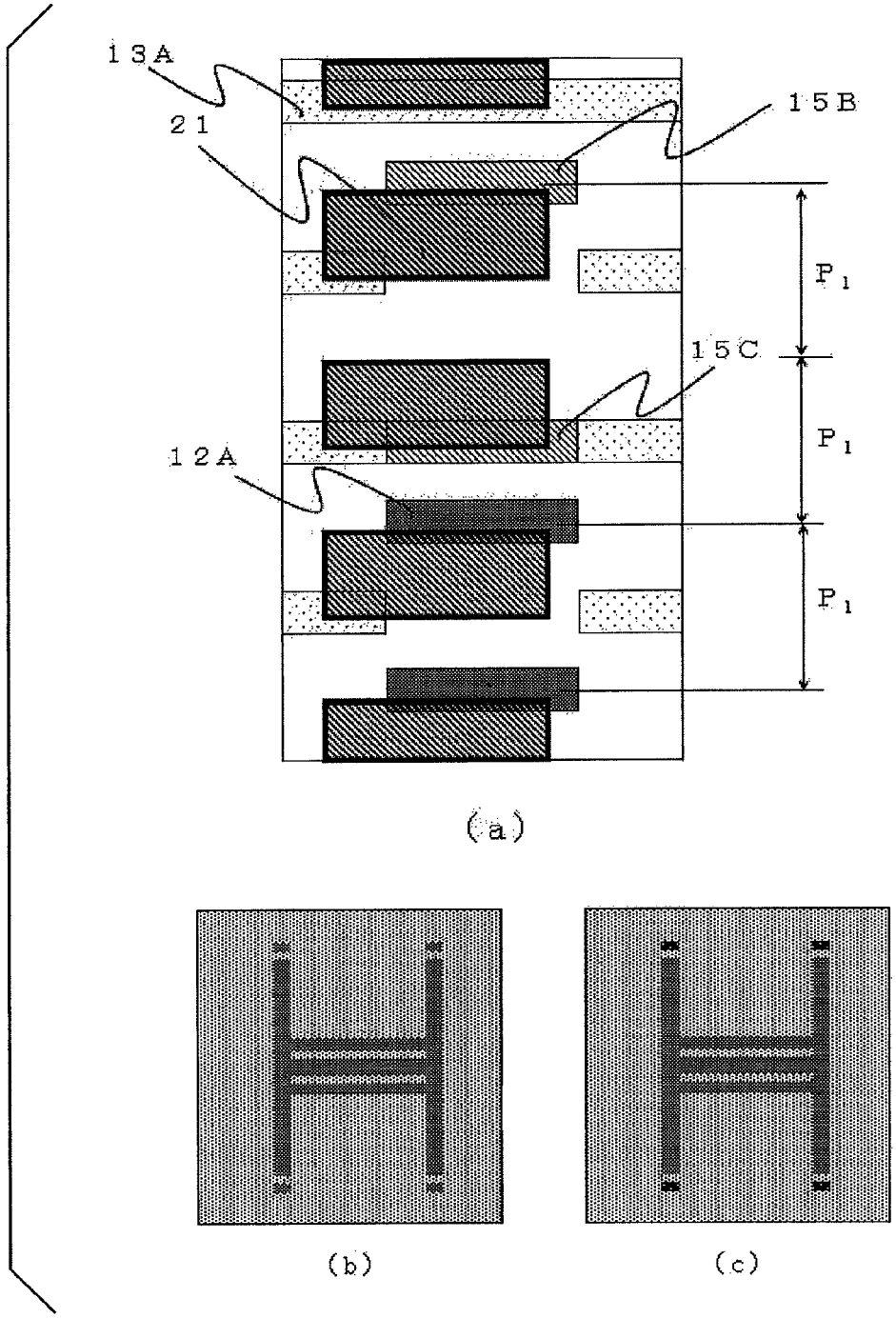
FIG. 69 shows views of a twenty-third arrangement and a latent image upon observation from an oblique direction.

In the 23rd arrangement, the second element (21) also overlaps at least part of the observation portion (V) of the background adjacent outline element (15B) in the 22nd arrangement. In this case, the elements are arranged such that the area ratio of the second element (21) overlapping the observation portion (V) of the background adjacent outline element (15B) is different from those of the second element (21) overlapping the observation portion (V) of the background element (13A) and the second element (21) overlapping the observation portion (V) of the outline element (15C). FIG. 69(*a*) shows an example of this arrangement.

FIG. 69(*a*) illustrates a state in which the background adjacent outline element (15B) is arranged at a distance twice the first pitch ($P_1$) from the outermost line of the latent image element (12A), and the second element (21) overlaps part of the observation portion (V) of the latent image element (12A), part of the observation portion (V) and the entire non-observation portion (V') of the background element (13A), part of the observation portion (V) and the entire non-observation portion (V') of the outline element (15C), and part of the observation portion (V) of the background adjacent outline element (15B). Note that since the background adjacent outline element (15B) is arranged at a distance twice the first pitch ($P_1$) from the outermost line of the latent image element (12A), the area ratio of the second element (21) overlapping the observation portion (V) of the latent image element (12A) equals that of the second element (21) overlapping the observation portion (V) of the background adjacent outline element (15B). FIG. 69(*a*) also illustrates a state in which the area ratios of the second element (21) overlapping the observation portion (V) of the latent image element (12A) and the second element (21) overlapping the observation portion (V) of the background adjacent outline element (15B) are larger than those of the second element (21) overlapping the observation portion (V) of the background element (13A) and the second element (21) overlapping the observation portion (V) of the outline element (15C).

The latent image pattern formed body (2) of the 23rd arrangement shown in FIG. 69(*a*) is observed from the oblique direction. In this case, the portions where the latent image element (12A), the background element (13A), the background adjacent outline element (15B), and the outline element (15C) are formed are observed in the color of the second element (21). At this time, the latent image element (12A) and the background adjacent outline element (15B) are visually recognized in colors darker than those of the background element (13A) and the outline element (15C) because the overlap area ratios of the second element (21) are larger. In addition, since the area ratio of the second element (21) overlapping the observation portion (V) of the background element (13A) equals that of the second element (21) overlapping the observation portion (V) of the outline element (15C), the background element (13A) and the outline element (15C) are visually recognized in the same color. As a result, the background element (13A) and the outline element (15C) are observed in the same color while the latent image element (12A) and the background adjacent outline element (15B) are observed in different colors so that a latent image having double outlines is observed, as shown in FIG. 69(*b*).

Note that when the background adjacent outline element (15B) is arranged at a position other than at a distance twice the first pitch ($P_1$) from the outermost line of the latent image element (12A) (not shown) in the 23rd arrangement shown in FIG. 69(*a*), the elements can be arranged such that the area ratio of the second element (21) overlapping the observation portion (V) of the background adjacent outline element (15B) is different from those of the second element (21) overlapping the observation portion (V) of the latent image element (12A), the second element (21) overlapping the observation portion (V) of the background element (13A), and the second element (21) overlapping the observation portion (V) of the outline element (15C). In this case, the background adjacent outline element (15B) is observed as an outline in a color different from those of the latent image element (12A), the background element (13A), and the outline element (15C). FIG. 69(*c*) shows an example of the arrangement.

As described above, when one background adjacent outline element (15B) is arranged in the third structure of the outline portion (14), double outlines having the same color as that of the latent image portion (12) or a different color are observed in the outline portions (13) on the upper and lower sides of the motif of the latent image. Note that a plurality of background adjacent outline elements (15B) may be arranged in the outline portion (14) of the third structure as well. In this case, the arrangement of the background adjacent outline elements (15B) and the second element (21) and the outline of the latent image to be observed are the same as those described concerning the second structure of the outline portion (14), and a description thereof will be omitted.

An embodiment to observe the motif and outline of a latent image in the latent image pattern formed body (2) whose latent image motif is formed using the unevenness of the substrate (1) has been described above.

Figure 70:
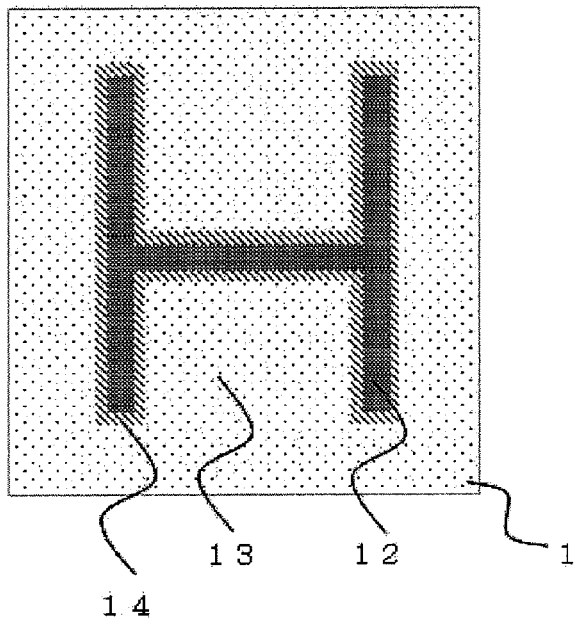
FIG. 70 is a view showing the latent image portion, the background portion, and the outline portion of the first pattern when the outline portions of the first to third embodiments are formed compositely.

The first to third embodiments to form the outline portion (14) can be used not solely for the latent image pattern but also compositely for each outline of the latent image pattern. For example, in the first pattern (10) separated into the latent image portion (12), the background portion (13), and the outline portion (14) as shown in FIG. 70, the outline portions (14) of the first embodiment and the outline portions (14) of the second embodiment may be formed on the left and right sides of the motif of the latent image, and the outline portions (14) of the third embodiment may be formed on the upper and lower sides of the motif of the latent image.

Figure 71:
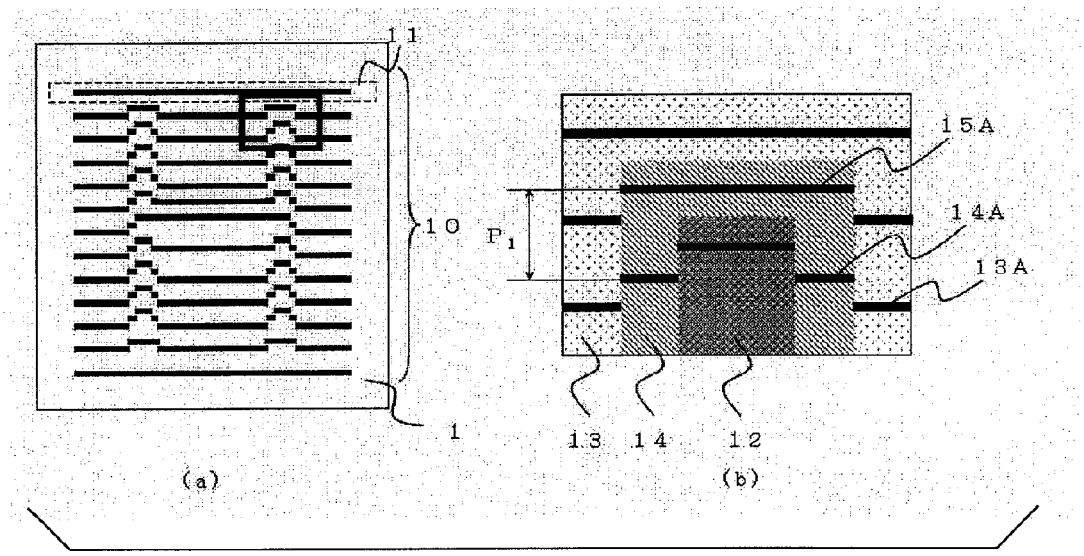
FIG. 71 shows views of the first pattern when the outline portions of the first to third embodiments are formed compositely.

When the outline portions of the first and third embodiments are compositely formed, the outline element (14A) of the first embodiment and the outline element (15A) of the third embodiment are arranged at the first pitch ($P_1$), as shown in FIG. 71(*b*). This allows to observe the outlines on the left and right sides of the latent image pattern and those on the upper and lower sides of the latent image pattern in the same color.

When arranging a plurality of latent image patterns on a single substrate, latent images having different outlines can be observed by forming the outline portions (14) of different embodiments for the respective latent image patterns. Alternatively, when the phases of the first elements (11) that form the latent image portion (12), the background portion (13), and the outline portion (14) are changed for each of the plurality of latent image patterns, a latent image in which the colors of the latent image portion (12), the background portion (13), and the outline portion (14) change between the latent image patterns can be observed.

It is also possible to add a third pattern (30) whose hue is different from those of the substrate (1) and the second pattern (20), by the same formation method as that of the second pattern (20), to the latent image pattern formed body according to one of the first, second, and third embodiments or a composite thereof to change the color of the latent image. The third pattern (30) will be described below.

(Third Pattern)

Figure 72:
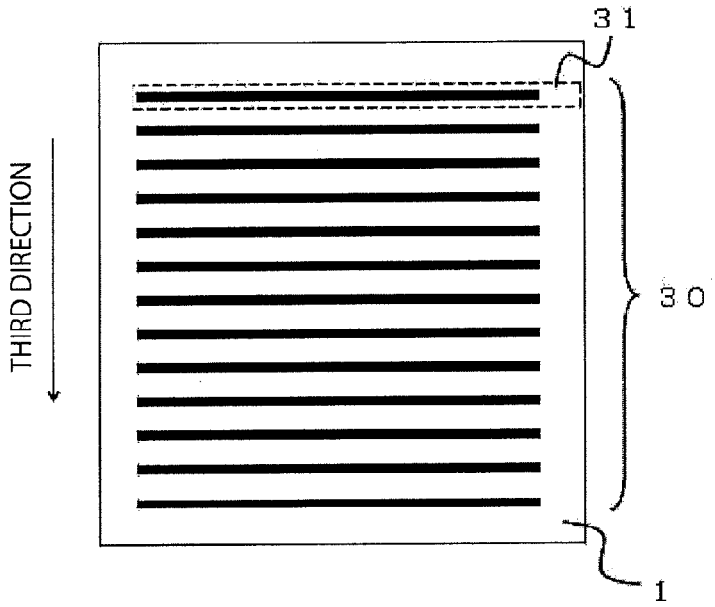
FIG. 72 is a view showing the third pattern.

As shown in FIG. 72, the third pattern (31) is formed by arranging a plurality of third elements (31) on the substrate (1) in the third direction. The third direction can be the same as or different from the first direction. The remaining structures are the same as those of the second pattern (20).

When the third pattern (30) is formed, the first pattern (10), the second pattern (20), and the third pattern (30) can have two different arrangements to be described below.

In the first arrangement including the third pattern (30), for the first pattern (10) according to one of the first to third embodiments or a composite thereof, the second element (21) of the second pattern (20) overlaps at least part of the observation portion (V) of one first element (11) out of the first element (11) that forms the latent image portion (12) of the first pattern (10), the first element (11) that forms the background portion (13), and the first element (11) that forms the outline portion (14). In addition, the third element (31) of the third pattern (30) overlaps at least part of the observation portion (V) of one first element (11) the second element (21) does not overlap out of the first element (11) that forms the latent image portion (12), the first element (11) that forms the background portion (13), and the first element (11) that forms the outline portion (14).

The reason for this arrangement is as follows. As described above, in the arrangement including the first pattern (10) and the second pattern (20), when the second element (21) overlaps two first elements (11) arranged in different phases out of the first element (11) that forms the latent image portion (12), the first element (11) that forms the background portion (13), and the first element (11) that forms the outline portion (14), the area ratios of the second element (21) overlapping the observation portions (V) need to be different to observe the portions the second element (21) overlaps in different colors. However, when the third pattern (30) is formed, the latent image portion (12), the background portion (13), and the outline portion (14) can be observed in different colors by arranging the elements such that the second element (21) overlaps one of the two elements of the first element (11) that forms the latent image portion (12), the first element (11) that forms the background portion (13), and the first element (11) that forms the outline portion (14), and the third element (31) overlaps the other element.

Examples of this arrangement are as follows. In the first embodiment, the second element (21) overlaps at least part of the observation portion (V) of the latent image element (12A), and the third element (31) overlaps at least part of the observation portion (V) of the outline element (14A). In the second embodiment, the second element (21) overlaps at least part of the observation portion (V) of each of the outline element (14A) and the latent image element (12A) arranged in the same phase as that of the outline element (14A), and the third element (31) overlaps at least part of the observation portion (V) of the outline auxiliary element (14B). In the first pattern (10) with the first structure according to the third embodiment, the second element (21) overlaps at least part of the observation portion (V) of the latent image element (12A), and the third element (31) overlaps at least part of the observation portion (V) of the latent image adjacent outline element (15A). Note that the first arrangement including the third pattern (30) is not limited to that described above. It is necessary only to make the second element (21) of the second pattern (20) overlap at least part of the observation portion (V) of one first element (11) out of the first element (11) that forms the latent image portion (12) of the first pattern (10), the first element (11) that forms the background portion (13), and the first element (11) that forms the outline portion (14) and make the third element (31) of the third pattern (30) overlap at least part of the observation portion (V) of one first element (11) the second element (21) does not overlap out of the first element (11) that forms the latent image portion (12), the first element (11) that forms the background portion (13), and the first element (11) that forms the outline portion (14). The second arrangement including the third pattern (30) will be described next.

In the second arrangement including the third pattern (30), for the first pattern (10) according to one of the first to third embodiments or a composite thereof, the second element (21) of the second pattern (20) overlaps at least part of each of the observation portions (V) of two first elements (11) arranged in different phases out of the first element (11) that forms the latent image portion (12) of the first pattern (10), the first element (11) that forms the background portion (13), and the first element (11) that forms the outline portion (14). In addition, the third element (31) of the third pattern (30) overlaps at least part of the observation portion (V) of the first element (11) the second element (21) does not overlap out of the first element (11) that forms the latent image portion (12), the first element (11) that forms the background portion (13), and the first element (11) that forms the outline portion (14). As described above, this arrangement directly uses the fact that when the first pattern (10) and the second pattern (20) are formed, the second element (21) is made to overlap, with different area ratios, the observation portions (V) of two first elements (11) arranged in different phases out of the first element (11) that forms the latent image portion (12), the first element (11) that forms the background portion (13), and the first element (11) that forms the outline portion (14) so as to observe a latent image whose outline portion (14) is observed. The third element (31) overlaps at least part of the observation portion (V) of the first element (11) the second element (21) does not overlap so that the portion the second element (21) does not overlap is also observed in the color of the third element (31), which is different from that of the substrate (1).

Examples of this arrangement are as follows. In the first embodiment, the second element (21) overlaps, with different area ratios, the observation portion (V) of the latent image element (12A) and the observation portion (V) of the background element (13A), and the third element (31) overlaps at least part of the observation portion (V) of the outline element (14A). In the second embodiment, the second element (21) overlaps, with different area ratios, the observation portion (V) of the background element (13A) arranged in a phase different from that of the outline element (14A) and the observation portion (V) of the outline auxiliary element (14B), and the third element (31) overlaps at least part of the observation portion (V) of the outline element (14A) and at least part of the observation portion (V) of the latent image portion (12) arranged in the same phase as that of the outline element (14). In the first pattern (10) with the first structure according to the third embodiment, the second element (21) overlaps, with different area ratios, the observation portion (V) of the latent image element (12A) and the observation portion (V) of the latent image adjacent outline element (15A), and the third element (31) overlaps at least part of the observation portion (V) of the background element (13A). Note that the second arrangement including the third pattern (30) is not limited to that described above. It is necessary only to make the second element (21) of the second pattern (20) overlap at least part of each of the observation portions (V) of two first elements (11) arranged in different phases out of the first element (11) that forms the latent image portion (12) of the first pattern (10), the first element (11) that forms the background portion (13), and the first element (11) that forms the outline portion (14) and make the third element (31) of the third pattern (30) overlap at least part of the observation portion (V) of the first element (11) the second element (21) does not overlap out of the first element (11) that forms the latent image portion (12), the first element (11) that forms the background portion (13), and the first element (11) that forms the outline portion (14).

As described above, the third pattern (30) is added such that the third element (31) overlaps the observation portion (V) of any one of the elements the second element (21) does not overlap out of the first elements (11) that form the latent image portion (12), the background portion (13), and the outline portion (14). This allows to additionally visually recognize the color of the third pattern (30) in the latent image observed from the oblique direction and improve the authenticity discrimination and design properties of the latent image pattern.

In a similar manner, an nth (n is an integer of four or more) pattern having a color different from those of the substrate (1), the second pattern (20), and the third pattern (30) is formed into the same structure as those of the second pattern (20) and the third pattern (30), and the second elements (21) to the nth elements are arranged not to overlap each other, thereby improving the authenticity discrimination and design properties of the latent image pattern. However, to observe the colors of the second pattern (20) to the nth pattern from the oblique direction, the elements that form the second pattern (20) to the nth pattern need to be arranged in the observation portions (V) of the first elements (11) that form the latent image portion (12), the background portion (13), and the outline portion (14). Hence, the second pattern (20) to the nth pattern are formed such that the number of patterns does not exceeds the number of phases of the first elements (11) that form the latent image portion (12), the background portion (13), and the outline portion (14), that is, the number of phases in the corresponding first elements (11). Note that in the above-described valuable printed matter, the image line width ($W_1$) of the first element (11) is preferably larger than ⅕ the first pitch ($P_1$). For example, in the first embodiment, the observation portions (V) of a total of ten elements, that is, the latent image element (12A), the background element (13A), and eight outline elements (14A) can be arranged in different phases in the first pitch ($P_2$). Hence, the second to 11th patterns can be formed.

The present invention will be described below in more detail using examples. The contents of the present invention are not limited to the scope of these examples.

EXAMPLE 1

In Example 1, a latent image pattern formed body (2) was created so as to have the structure of the first embodiment. The latent image pattern formed body (2) of Example 1 will be described using the drawings described in the first embodiment.

As shown in FIG. 2, the latent image pattern formed body (2) of Example 1 was obtained by forming a first pattern (10) and a second pattern (20) on a substrate (1).

The substrate (1) was formed from white paper. The thickness of the substrate (1) was 100 μm.

A first element (11) shown in FIG. 3 was formed as a straight line having an image line width ($W_1$) of 200 μm. A plurality of first elements (11) were periodically arranged in the first direction at a first pitch ($P_1$) of 600 μm to form the first pattern (10). As shown in FIG. 8(*a*), the phases of the plurality of first elements (11) periodically arranged were partially changed to form the first pattern (10) including a latent image portion (12), a background portion (13), and an outline portion (14). Note that the first elements had a concave shape having a depth (h) of 45 μm and were formed as a watermark using a cylinder mold at the stage of wet web in the paper machine. An outline element (14A) was formed in a phase shifted by ⅓ the first pitch ($P_1$) with respect to a background element (13A). A latent image element (12A) was formed in a phase shifted by ⅔ the first pitch ($P_1$) with respect to the background element (13A). The outline element (14A) was formed so as to be connected to the latent image element (12A) and the background element (13A).

A second element (21) shown in FIG. 13 was formed as a straight line having an image line width ($W_2$) of 250 μm. A plurality of second elements (21) were periodically arranged in the second direction that was the same as the first direction at a second pitch ($P_2$) of 600 μM to form the second pattern (20). Note that the second pattern (2) was formed by offset printing using cyan ink (TK Hy-Unity NEO available from Toyo Ink).

The first pattern (10) and second pattern (20) having the above-described structures were formed in the first arrangement shown in FIG. 20 to manufacture the latent image pattern formed body (2).

When the thus manufactured latent image pattern formed body (2) was observed from the oblique direction, a latent image having an outline could be observed.

EXAMPLE 2

Example 2 will be described only concerning points different from Example 1. In a latent image pattern formed body (2) of Example 2, first elements (11) having a convex shape were formed by printing intaglio ink, and second elements (21) were formed from pixels.

The second element (5A) of Example 2 was formed from pixels using a character shown in FIG. 7(*a*). Note that the second element (21) was formed by setting a pixel width ($X_2$) to 250 μm, a pixel height ($W_2$) to 250 μm, and a predetermined pixel pitch ($p_2$) to 300 μm. A plurality of second elements (5A) were periodically arranged at a second pitch ($P_2$) of 600 μm to form a second pattern (5).

When the thus manufactured latent image pattern formed body (2) of Example 2 was observed from a direction perpendicular to the surface on which the second pattern (5) was formed, the second pattern (5) was observed. At this time, the second pattern (20) was observed like the pattern by the second elements (21) each formed from a straight line because the second element (5A) had the pixel width ($X_2$) of 250 μm and the pixel pitch ($p_2$) of 300 μm so that the pixel interval was as small as 50 μm. When the second pattern (20) was observed through a magnifying lens, the pixels each formed from a character were observed. When the thus manufactured latent image pattern formed body (2) of Example 2 was observed from the oblique direction, a latent image having an outline could be observed.

As described above, it is possible not only to improve the authenticity discrimination and design properties of the latent image when observed from the oblique direction but also to make the latent image pattern formed body (2) have the anti-counterfeit effect by forming the second elements (21) from small pixels.

EXAMPLE 3

Example 3 will be described only concerning points different from Example 1. In Example 3, first elements (11) having a concave shape were formed by laser machining, an outline portion (14) of a first pattern (10) was formed by arranging two outline elements including an outline element (14$A_1$) and an outline element (14$A_2$), and a third pattern (30) was also formed.

Figure 75:
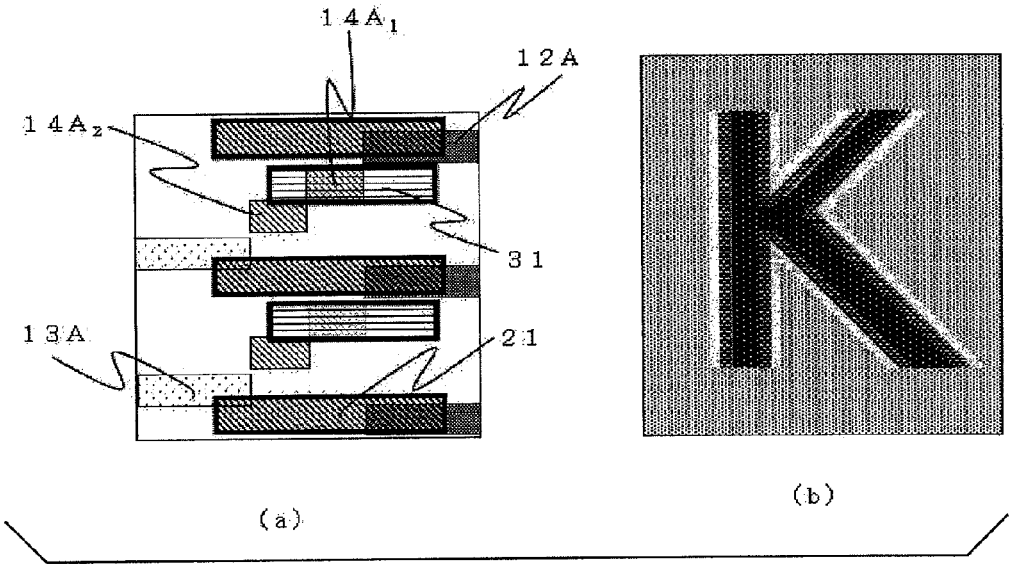
FIG. 75 shows views of the arrangement of the first element, the second element, and the third element and a latent image observed upon observation from the oblique direction in Example 3.

In the first pattern (10) of Example 3, an image line width ($W_1$) was set to 100 μm. As shown in FIG. 75(*a*), the two outline elements (14$A_1$, 14$A_2$) were arranged in phases between a background element (13A) and a latent image element (12A) such that the phases of the two elements were shifted equally. Note that the first elements (11) were formed by removing part of a substrate (1) using a laser beam machine (laser marker MD-V available from Keyence).

Unlike Example 1, an image line width ($W_2$) of a second element (21) was set to 100 μm to form a second pattern (20).

The third pattern (30) shown in FIG. 72 was formed to have the same structure as that of the second pattern (20). Note that the third pattern (30) was formed by offset printing using magenta ink (TK Hy-Unity NEO available from Toyo Ink).

The first pattern (10) and second pattern (20) having the above-described structures were arranged as shown in FIG. 75(*a*) to manufacture a latent image pattern formed body (2). FIG. 75(*a*) shows a state in which a third element (31) overlaps the outline element (14$A_1$) in the arrangement of the first pattern (10) and the second pattern (20) of Example 1.

The thus manufactured latent image pattern formed body (2) was observed from the oblique direction. The portions where the latent image element (12A) and the background element (13A) were formed were visually recognized in the color of the second pattern (20). The portion where the outline element (14$A_1$) was formed was visually recognized in the color of the third pattern (30). The portion where the outline element (14$A_2$) was formed was observed as hollow. Hence, a latent image shown in FIG. 75(*b*) could be observed.

EXAMPLE 4

Example 4 will be described only concerning points different from Example 1. In a latent image pattern formed body (2) of Example 4, a first pattern (10) having the structure of the second embodiment was formed, and first elements (11) having a concave shape were formed by embossing.

The first element (11) shown in FIG. 27 was formed as a straight line having an image line width ($W_1$) of 200 μm. A plurality of first elements (11) were periodically arranged in the first direction at a first pitch ($P_1$) of 600 μm to form the first pattern (10). As shown in the enlarged view of FIG. 27, the phases of the plurality of first elements (11) periodically arranged were partially changed to form the first pattern (10) including a latent image portion (12), a background portion (13), and an outline portion (14). An outline auxiliary element (14B) was formed in a phase shifted by ⅓ the first pitch ($P_1$) with respect to the first element (11) that forms the background portion (13). A latent image element (12A) and an outline element (14A) were formed in a phase shifted by ⅔ the first pitch ($P_1$) with respect to the background element (13A). Note that the first elements (11) were formed by pressing a plate having a convex shape for the first elements (11) of the first pattern (10) using a press machine.

The first pattern (10) having the above-described structure and a second pattern (20) were formed in the fifth arrangement shown in FIG. 34 to manufacture the latent image pattern formed body (2).

When the thus manufactured latent image pattern formed body (2) was observed from the oblique direction, a latent image having double outlines could be observed.

EXAMPLE 5

Example 5 will be described only concerning points different from Example 1. In a latent image pattern formed body (2) of Example 5, a first pattern (10) having the structure of the third embodiment was formed.

An outline portion (14) of the first pattern (10) of Example 5 was formed to have the structure of the outline portion (14) shown in FIG. 42. Note that a latent image adjacent outline element (15A) was formed in a phase shifted by ¼ a first pitch ($P_1$) with respect to a background element (13A). A latent image element (12A) was formed in a phase shifted by ½ the first pitch ($P_1$) with respect to the background element (13A).

The first pattern (10) having the above-described structure and a second pattern (20) were formed in the arrangement shown in FIG. 50(*a*) to manufacture the latent image pattern formed body (2).

When the thus manufactured latent image pattern formed body (2) was observed from the oblique direction, a latent image having outlines on the upper and lower sides of the latent image could be observed.

EXAMPLE 6

Example 6 will be described only concerning points different from Example 1. In a latent image pattern formed body (2) of Example 6, a first pattern (10) was formed by compositing the outline portions of Examples 1 and 5.

The first pattern (10) of Example 6 was formed to have the structure shown in FIG. 71. Note that an outline element (14A) was formed in a phase shifted by ⅓ a first pitch ($P_1$) with respect to a background element (13A). A latent image element (12A) was formed in a phase shifted by ⅔ the first pitch ($P_1$) with respect to the background element (13A). A latent image adjacent outline element (15A) was formed in a phase shifted by ⅓ the first pitch ($P_1$) with respect to the background element (13A).

Figure 76:
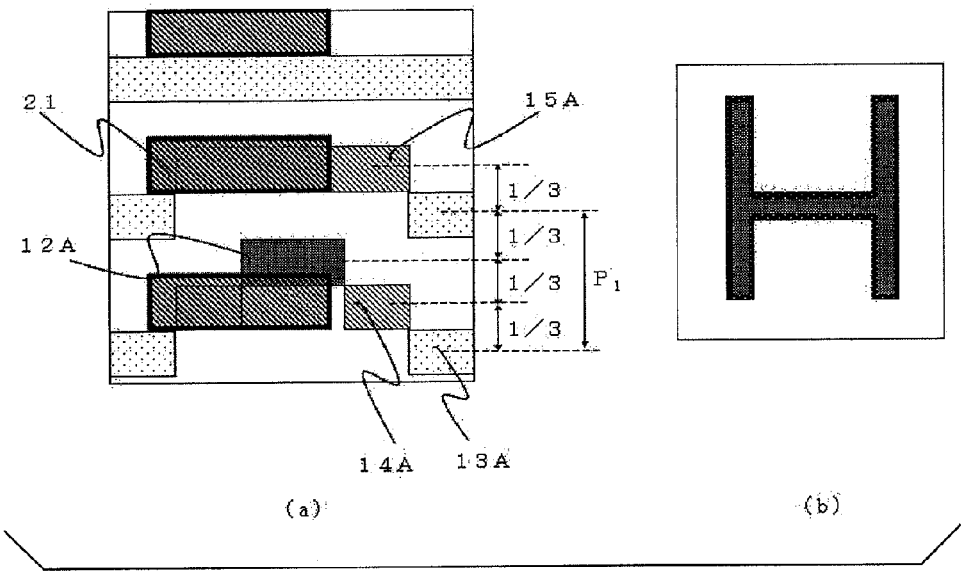
FIG. 76 shows views of the arrangement of the first element and the second element and a latent image upon observation from the oblique direction in Example 6.

The first pattern (10) having the above-described structure and a second pattern (20) were formed in the arrangement shown in FIG. 76(*a*) to manufacture the latent image pattern formed body (2). FIG. 76(*a*) illustrates a state in which a second element (21) overlaps part of an observation portion (V) of the latent image element (12A), the entire outline element (14A), and the entire latent image adjacent outline element (15A).

When the thus manufactured latent image pattern formed body (2) was observed from the oblique direction, a latent image pattern could be observed which had outlines with a tone different from those of the latent image portion and the background portion on the upper and lower sides and the left and right sides of the latent image.

EXAMPLE 7

Example 7 will be described only concerning points different from Example 6. In a latent image pattern formed body (2) of Example 7, a third pattern (30) was also formed in Example 6.

The third pattern (30) shown in FIG. 72 was formed to have the same structure as that of a second pattern (20). An image line width ($W_2$) of second elements (21) and an image line width ($W_3$) of third elements (31) were 200 μm. Note that the third pattern (30) was formed by offset printing using magenta ink (TK Hy-Unity NEO available from Toyo Ink).

Figure 73:
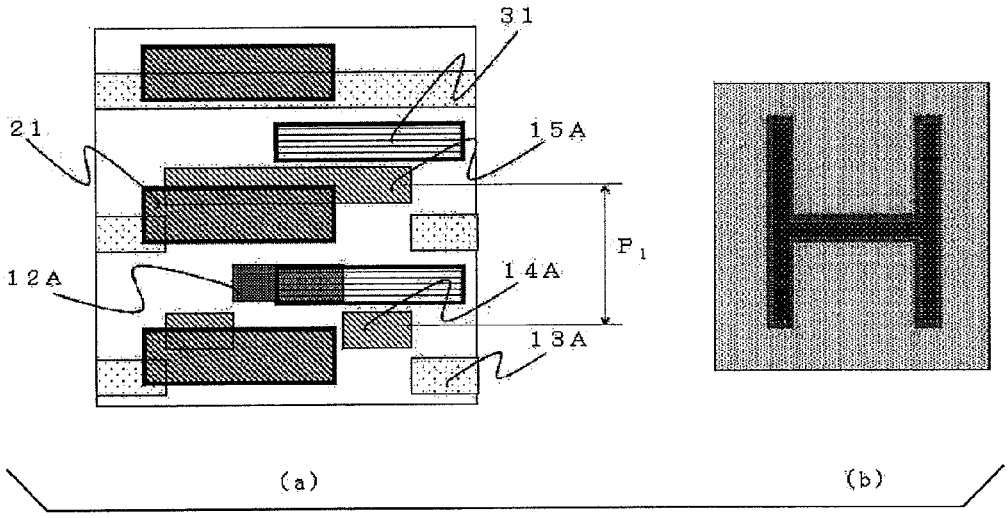
FIG. 73 shows views of the arrangement of the first pattern, the second pattern, and the third pattern and a latent image observed upon observation from the oblique direction.
Figure 74:
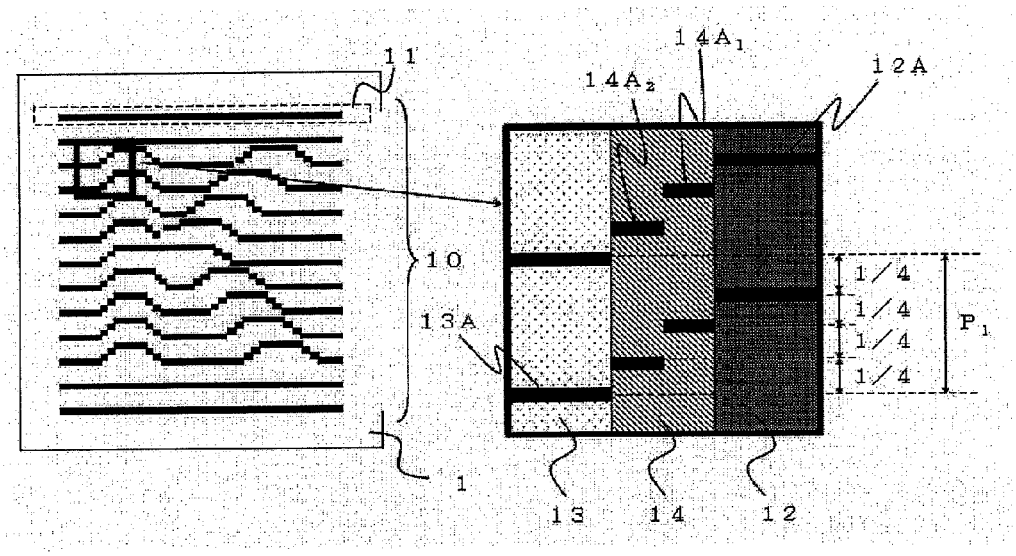
FIG. 74 is a view showing the first pattern of the Example 3.

A first pattern (10), the second pattern (20), and the third pattern (30) were formed in the arrangement shown in FIG. 73(*a*) to manufacture the latent image pattern formed body (2).

When the thus manufactured latent image pattern formed body (2) was observed from the oblique direction. A latent image portion (12) was visually recognized in the color of the third pattern (30). A background portion (13) and an outline portion (14) were visually recognized in the color of the second pattern (20). Hence, a latent image shown in FIG. 73(*b*) could be observed.

EXAMPLE 8

Example 8 will be described only concerning points different from Example 4. A latent image pattern formed body (2) of Example 8 was formed by compositing the second and third embodiments.

Figure 77:
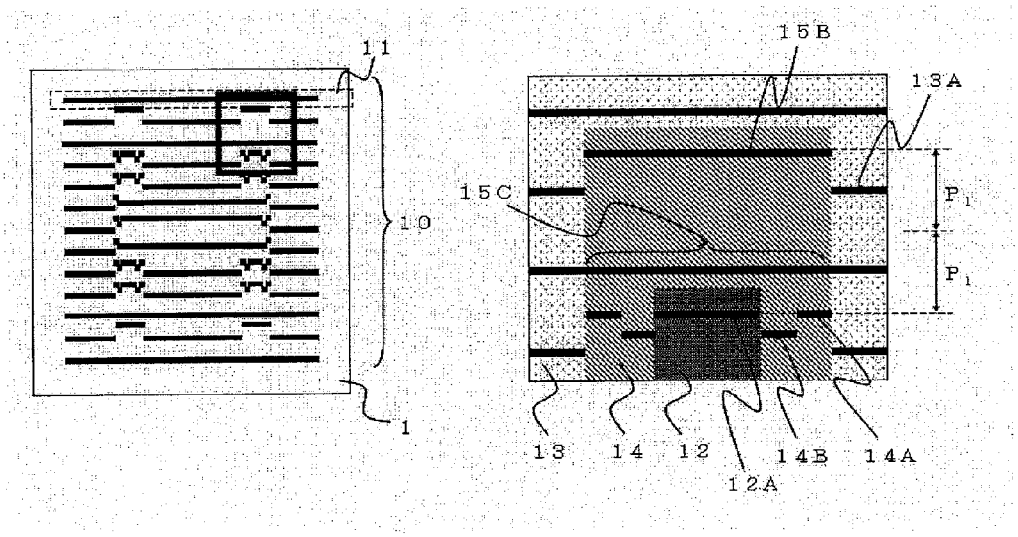
FIG. 77 is a view showing the first pattern of the Example 8.

A first pattern (10) of Example 8 was formed to have the structure shown in FIG. 77. An outline portion (14) having the structure of the second embodiment is the same as in Example 4. An outline portion (14) having the structure of the third embodiment was formed to have the structure shown in FIG. 44(*a*). Note that a background adjacent outline element (15B) was arranged at a distance twice a first pitch ($P_1$) from the outermost line of a latent image element (12A).

Figure 78:
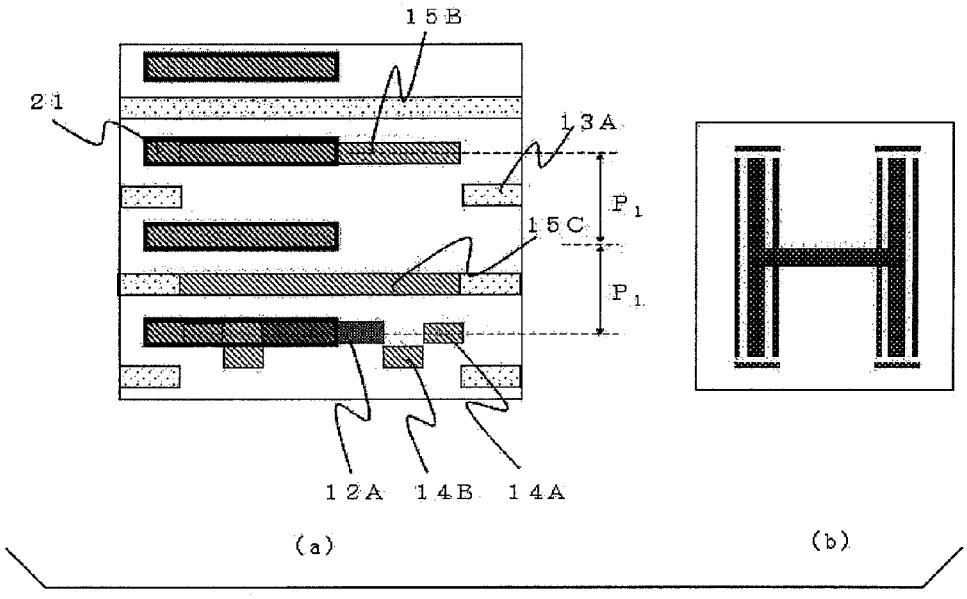
FIG. 78 shows views of the arrangement of the first element and the second element and a latent image observed upon observation from the oblique direction in Example 8.

The first pattern (10) and a second pattern (20) were arranged such that a second element (21) overlapped an outline element (14A), the latent image element (12A), and the background adjacent outline element (15B) but not a background element (13A), an outline auxiliary element (14B), and an outline element (15C), as shown in FIG. 78(*a*).

When the thus manufactured latent image pattern formed body (2) was observed from the oblique direction, a latent image could be observed which had double outlines on the upper and lower sides and the left and right sides of the latent image, as shown in FIG. 78(*b*).

EXAMPLE 9

Example 9 will be described only concerning points different from Example 6. In Example 9, a second pattern (20) was arranged so as to tilt by 1° with respect to a first pattern (10) in Example 6.

Since the second pattern (20) tilted with respect to the first pattern (10), the overlap area ratio of a second element (21) partially changed even changes even between identical latent image elements (12A), between identical background elements (13A), and between identical outline elements (14A).

When a thus manufactured latent image pattern formed body (2) was observed from the oblique direction, a latent image portion (12), a background portion (13), and an outline portion (14) were observed as a gradation pattern that smoothly changed the tone.

EXAMPLE 10

In Example 10, a plurality of latent image patterns of Example 6 were formed on a single substrate, and the phase of an outline portion (14) with respect to a background element (13A) and the phase of a latent image element (12A) with respect to the background element (13A) were changed between the latent image patterns.

Figure 79:
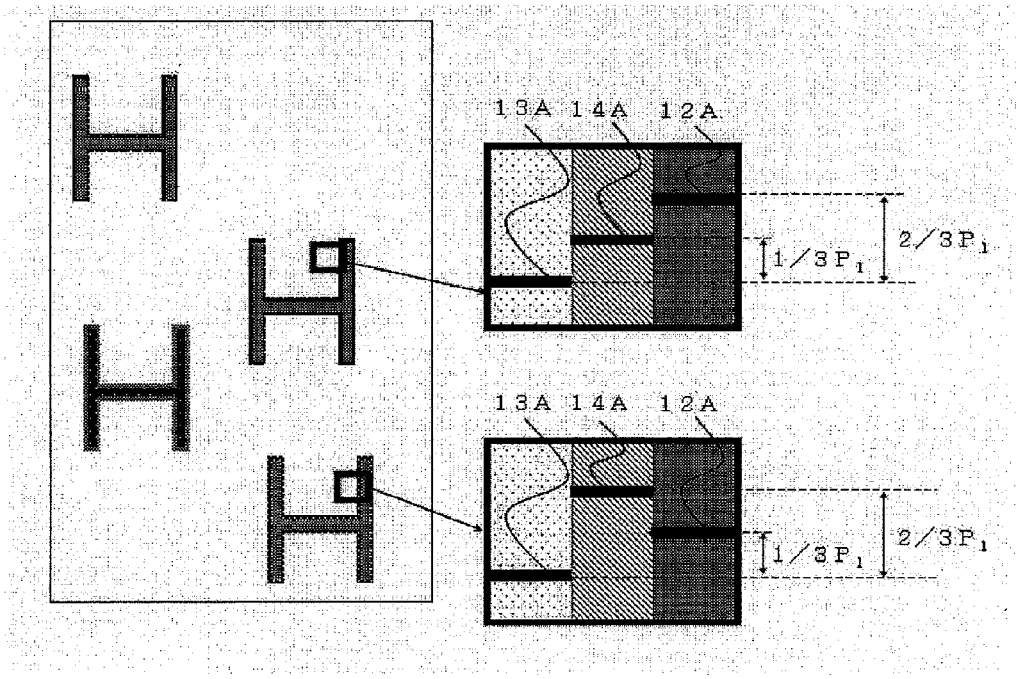
FIG. 79 is a view showing the first pattern of the Example 10.

In Example 10, as shown in FIG. 79, the phase of the outline portion (14) with respect to the background element (13A) and the phase of the latent image element (12A) with respect to the background element (13A) were changed between the latent image patterns.

In a thus manufactured latent image pattern formed body (2), the manner a first element (11) and a second element (21) overlap changes between the latent image patterns. As for the whole first pattern (10), the latent image could be observed in which the colors of a latent image portion (12), a background portion (13), and an outline portion (14) changed between the latent image patterns.

EXAMPLE 11

Example 11 is an example of a card (5) manufactured by forming a latent image pattern of the present invention on a paper substrate and bonding the substrates to the upper and lower surfaces of a plastic substrate.

Figure 80:
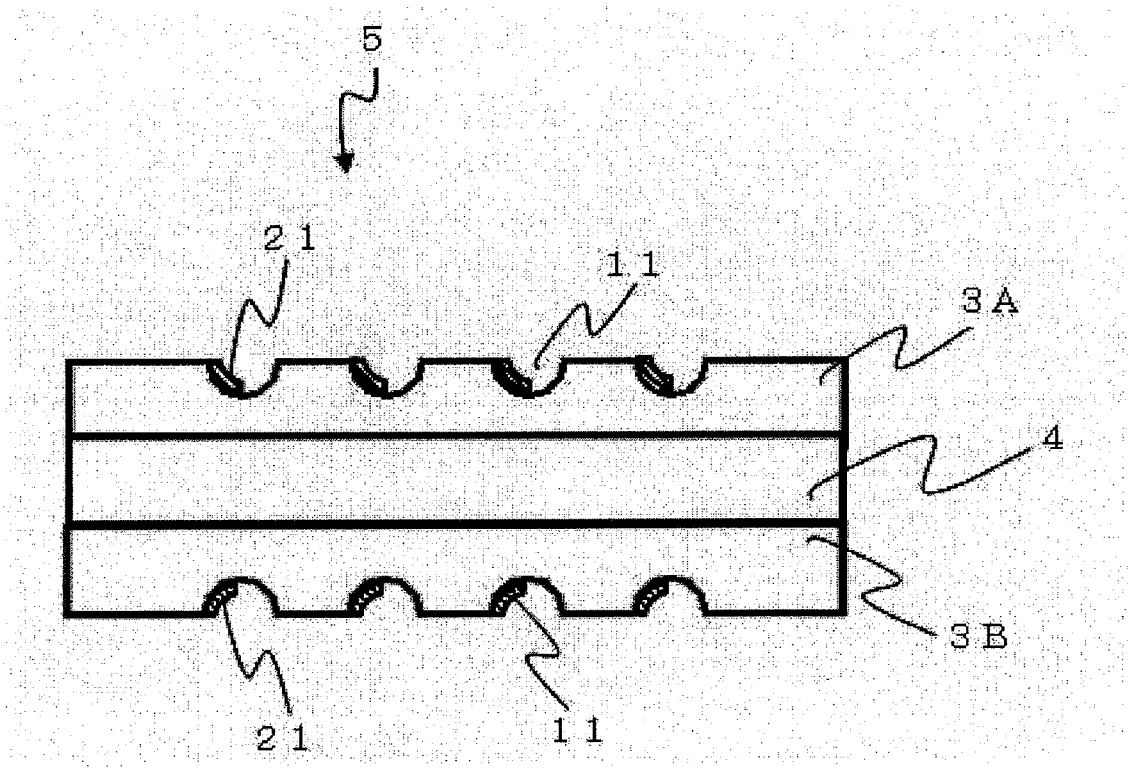
FIG. 80 is a view showing an example of a card on which a latent image pattern formed body of Example 11 is formed.

The card (5) of Example 11 was manufactured by bonding an upper sheet (3A) to the upper surface of a plastic substrate (4) shown in FIG. 80 and a lower sheet (3B) to the lower surface. As the plastic substrate (4), a white PET substrate having a thickness of 700 μm was used. Note that the latent image pattern formed body of Example 6 was formed in advance on the upper sheet (3A), and the latent image pattern formed body of Example 8 was formed in advance on the lower sheet (3B). The upper sheet (3A) and the lower sheet (3B) were bonded to the plastic substrate (4) using an adhesive in such directions that the latent image patterns formed on the sheets were observable, as shown in FIG. 80.

When forming first elements (11) having a concave shape or a convex shape in the plastic substrate (4) and printing a second pattern (20), the fabrication method is limited. However, when forming the latent image patterns on the upper sheet (3A) and the lower sheet (3B) each formed from a paper substrate, as in Example 11, the fabrication method is not limited. For this reason, the card (5) with the latent image pattern formed body (2) can easily be manufactured. In addition, forming different latent image patterns on the upper and lower surfaces of the card (5) makes it difficult to forge the card (5).

DESCRIPTION OF THE REFERENCE NUMERALS

1 substrate
2 patent image pattern formed body
3A upper sheet
3B lower sheet
4 plastic substrate
5 card
10 first pattern
11 first element
12 latent image portion
12A latent image element
13 background portion
13A background element
14 outline portion
14A outline element (first embodiment, second embodiment)
14B outline auxiliary element (second embodiment)
15A latent image adjacent outline element (third embodiment)
15B background adjacent outline element (third embodiment)
15C outline element (third embodiment)
20 second pattern
21 second element
30 third pattern
31 third element
$W_1$ image line width, pixel height (first element)
$P_1$ first pitch
$X_1$ pixel width
$p_1$ pixel pitch
$W_2$ image line width, pixel height (second element)
$P_2$ second pitch
$X_3$ width of pixel
$p_1$ pitch of pixel
$W_3$ image line width, pixel height (third element)
$P_3$ third pitch
$X_3$ pixel width
$p_3$ pixel pitch
α tilt angle between first direction and second direction
V observation portion
V' non-observation portion
$V_1$ near-side surface of a convex shape when observed from an oblique direction
$V_2$ upper surface of a convex shape
$V_3$ far-side surface of a concave shape when observed from an oblique direction
$V_4$ flat portion of a substrate
$V_5$ bottom surface of a concave shape
Q vertex of a convex shape
R bottom point of a concave shape

The invention claimed is:

1. A latent image pattern formed body comprising, in at least part of one surface of a substrate:

a plurality of first elements having a concave shape or a convex shape, the elements being arranged into a latent image region, an outline region arranged on an outline of at least part of said latent image region, and a background region arranged on a background of said latent image region and said outline region, wherein in said latent image region, the plurality of first elements are arranged at a first pitch in a first direction, in said background region, the plurality of first elements are arranged at the first pitch in the first direction in a phase different from that of the first elements in said latent image region, in said outline region, the plurality of first elements are arranged at the first pitch in the first direction in a phase different from that of the first elements in said latent image region or a phase of said background region, said outline region being formed between said latent region and said background region, said outline region being formed between said latent region and said background region, and in said latent image region, said background region, and said outline region, a plurality of second elements having a color different from that of the substrate are arranged at a second pitch in a second direction.

2. A latent image pattern formed body according to claim 1, wherein the first elements arranged in said outline region are arranged substantially parallel to the first elements arranged in each of said latent image region and said background region, each first element is divided into at least one region and another region at a line that connects bottom points of the concave shape or vertices of the convex shape in a full range of the first element along a longitudinal direction, so as to define said one region as an observation portion and said other region as a non-observation portion, the second element is formed according to one of the following arrangements to form a latent image pattern:

i) the second element overlaps at least part of the observation portion of the first element arranged in said latent image region and at least part of the observation portion of the first element arranged in said background region, but does not overlap the observation portion of the first element arranged in said outline region, and an area ratio of the second element overlapping the observation portion of the first element arranged in said latent image region is different from the area ratio of the second element overlapping the observation portion of the first element arranged in said background region, ii) the second element overlaps at least part of the observation portion of the first element arranged in said latent image region and at least part of the observation portion of the first element arranged in said outline region, but does not overlap the observation portion of the first element arranged in said background region, and the area ratio of the second element overlapping the observation portion of the first element arranged in said latent image region is different from the area ratio of the second element overlapping the observation portion of the first element arranged in said outline region, iii) the second element overlaps at least part of the observation portion of the first element arranged in said background region and at least part of the observation portion of the first element arranged in said outline region, but does not overlap the observation portion of the first element arranged in said latent image region, and the area ratio of the second element overlapping the observation portion of the first element arranged in said background region is different from the area ratio of the second element overlapping the observation portion of the first element arranged in said outline region, iv) the second element overlaps at least part of the observation portion of the first element arranged in said latent image region, at least part of the observation portion of the first element arranged in said background region, and at least part of the observation portion of the first element arranged in said outline region, and the area ratio of the second element overlapping the observation portion of the first element arranged in said latent image region and the area ratio of the second element overlapping the observation portion of the first element arranged in said background region are different from the area ratio of the second element overlapping the observation portion of the first element arranged in said outline region.

3. A latent image pattern formed body according to claim 1, wherein the first element arranged in said outline region includes an outline element and an outline auxiliary element in the phases shifted from each other, at least part of the outline element is arranged in the same phase as that of the first element arranged in said latent image region or the first element arranged in said background region, and the outline auxiliary element is arranged in a phase different from that of the outline element between the outline element and the first element arranged in said latent image region in the same phase as that of said at least part of the outline element, or the outline auxiliary element is arranged between the outline element and the first element arranged in said background region in the same phase as that of said at least part of the outline element.

4. A latent image pattern formed body according to claim 3, wherein each first element, the outline element, or the outline auxiliary element is divided into at least one region and another region at a line that connects bottom points of the concave shape or vertices of the convex shape in a full range of the first element, the outline element, or the outline auxiliary element along a longitudinal direction, so as to define said one region as an observation portion and said other region as a non-observation portion, the second element is formed according to one of the following arrangements to form a latent image pattern:

i) the second element does not overlap the observation portion of the first element arranged in said background region in the phase different from that of the outline element and the observation portion of the outline auxiliary element, but does overlap at least part of the observation portion of the outline element and at least part of the observation portion of the first element arranged in said latent image region in the same phase as that of the outline element, or the second element does not overlap the observation portion of the first element arranged in said latent image region in the phase different from that of the outline element and the observation portion of the outline auxiliary element, but does overlap at least part of the observation portion of the outline element and at least part of the observation portion of the first element arranged in said background region in the same phase as that of the outline element, ii) the second element does not overlap the observation portion of the first element arranged in said background region in the same phase as that of the outline element and the observation portion of the outline element, but does overlap at least part of the observation portion of the outline auxiliary element and at least part of the observation portion of the first element arranged in said latent image region in the phase different from that of the outline element, or the second element does not overlap the observation portion of the first element arranged in said latent image region in the same phase as that of the outline element and the observation portion of the outline element, but does overlap at least part of the observation portion of the outline auxiliary element and at least part of the observation portion of the first element arranged in said background region in the phase different from as that of the outline element, iii) the second element does not overlap the observation portion of the first element arranged in said background region in the phase different from that of the outline element, but does overlap at least part of the observation portion of the outline element, at least part of the observation portion of the outline auxiliary element, and at least part of the observation portion of the first element arranged in said latent image region in the same phase as that of the outline element, and area ratios of the second element overlapping the observation portion of the outline element and the observation portion of the first element arranged in said latent image region in the same phase as that of the outline element are different from the area ratio of the second element overlapping the observation portion of the outline auxiliary element, or the second element does not overlap the observation portion of the first element arranged in said latent image region in the phase different from that of the outline element, but does overlap at least part of the observation portion of the outline element, at least part of the observation portion of the outline auxiliary element, and at least part of the observation portion of the first element arranged in said background region in the same phase as that of the outline element, and the area ratios of the second element overlapping the observation portion of the outline element and the observation portion of the first element arranged in said background region in the same phase as that of the outline element are different from the area ratio of the second element overlapping the observation portion of the outline auxiliary element, iv) the second element does not overlap the observation portion of the outline auxiliary element, but does overlap at least part of the observation portion of the outline element, at least part of the observation portion of the first element arranged in said latent image region, and the area ratios of the second element overlapping the observation portion of the outline element and the observation portion of the first element arranged in said latent image region or said background region in the same phase as that of the outline element are different from the area ratio of the second element overlapping the observation portion of the first element arranged in said latent image region or said background region in the phase different from that of the outline element, or v) the second element overlaps at least part of the observation portion of the outline element, at least part of the observation portion of the outline auxiliary element, at least part of the observation portion of the first element arranged in said latent image region, and at least part of the observation portion of the first element arranged in said background region, and the area ratios of the second element overlapping the observation portion of the outline element and the observation portion of the first element arranged in said latent image region or said background region in the same phase as that of the outline element are different from the area ratios of the second element overlapping the observation portion of the outline auxiliary element and the observation portion of the first element arranged in said latent image region or said background region in the phase different from that of the outline element.

5. A latent image pattern formed body according to claim 1, wherein said outline region includes a latent image adjacent outline element that is arranged adjacent to an outermost element of the latent image region, The phase of the first elements in the latent image adjacent outline element is partially changed with respect to the outermost line of the latent image element, and the latent image adjacent outline element is arranged at a pitch different from the first pitch of the first elements comprised in the latent image region.

6. A latent image pattern formed body according to claim 5, wherein the second element is formed according to one of the following arrangements to form a latent image pattern:

i) the second element does not overlap the observation portion of the first element arranged in said background region, but does overlap at least part of the observation portion of the first element arranged in said latent image region and at least part of the observation portion of the latent image adjacent outline element, and an area ratio of the second element overlapping the observation portion of the first element arranged in said latent image region is different from the area ratio of the second element overlapping the observation portion of the latent image adjacent outline element, ii) the second element does not overlap the observation portion of the first element arranged in said latent image region, but does overlap at least part of the observation portion of the first element arranged in said background region and at least part of the observation portion of the latent image adjacent outline element, and the area ratio of the second element overlapping the observation portion of the first element arranged in said background region is different from the area ratio of the second element overlapping the observation portion of the latent image adjacent outline element, iii) the second element does not overlap the observation portion of the latent image adjacent outline element, but does overlap at least part of the observation portion of the first element arranged in said latent image region and at least part of the observation portion of the first element arranged in said background region, and the area ratio of the second element overlapping the observation portion of the first element arranged in said latent image region is different from the area ratio of the second element overlapping the observation portion of the first element arranged in said background region, iv) the second element overlaps at least part of the observation portion of the first element arranged in said latent image region, at least part of the observation portion of the first element arranged in said background region, and at least part of the observation portion of the latent image adjacent outline element, and the area ratio of the second element overlapping the observation portion of the first element arranged in said latent image region, the area ratio of the second element overlapping the observation portion of the first element arranged in said background region, and the area ratio of the second element overlapping the observation portion of the latent image adjacent outline element are different.

7. A latent image pattern formed body according to claim 5, wherein said outline region includes a background adjacent outline element that is arranged on a side of the outline region opposite to the first elements arranged in said latent image region with respect to the latent image adjacent outline element and partially changes the phase in at least one of the first elements continuously adjacent to the latent image adjacent outline element, and the second element overlaps at least two of the observation portions of the first element arranged in said background region, the observation portion of the first element arranged in said latent image region, the observation portion of the latent image adjacent outline element, and the observation portion of the background adjacent outline element.

8. A latent image pattern formed body according to claim 7, wherein the background adjacent outline element is arranged on the side of the outline region opposite to the first elements arranged in said latent image region with respect to the latent image adjacent outline element and partially changes the phase in at least second and subsequent first elements continuously adjacent to the latent image adjacent outline element, and the outline element is formed between the latent image adjacent outline element and the background adjacent outline element in the same phase as that of the first element arranged in said background region, and the second element overlaps at least three of the observation portions of the first element arranged in said background region, the observation portion of the first element arranged in said latent image region, the observation portion of the outline element, the observation portion of the latent image adjacent outline element, and the observation portion of the background adjacent outline element.

9. A latent image pattern formed body according to claim 2, wherein said outline region includes a background adjacent outline element that is arranged on a side of the outline region opposite to a side where the first elements are arranged in said latent image region and the background adjacent outline element is formed by partially changing the phase of at least one of the first elements continuously adjacent to the latent image adjacent outline element, the outline element is formed between the background adjacent outline element and latent image adjacent outline element, and the first elements having multiple observation portions and the second element overlaps at least two of the observation portions of the first elements arranged in said background region, the observation portions of the first elements arranged in said latent image region, the observation portion of the outline element, and the observation portion of the background adjacent outline element.

10. A latent image pattern formed body comprising, in at least part of one surface of a substrate:

a plurality of first elements having a concave shape or a convex shape, the elements being arranged into a latent image region, an outline region arranged on an outline of at least part of said latent image region, and a background region arranged on a background of said latent image region and said outline region, wherein in said latent image region, the plurality of first elements are arranged at a first pitch in a first direction, in said background region, the plurality of first elements are arranged at the first pitch in the first direction in a phase different from that of the first elements in said latent image region, in said outline region, the plurality of first elements are arranged at the first pitch in the first direction in a phase different from that of the first elements in said latent image region or a phase of said background region, said outline region being formed between said latent region and said background region, said outline region being formed between said latent region and said background region, in said latent image region, said background region, and said outline region, a plurality of second elements having a color different from that of the substrate are arranged at a second pitch in a second direction, in said latent image region, said background region, and said outline region, a plurality of third elements having a color different from those of the substrate and the second elements are arranged at a third pitch in a third direction, each first element is divided into at least one region and another region at a line that connects bottom points of the concave shape or vertices of the convex shape in a full range of the first element along a longitudinal direction, so as to define said one region as an observation portion and said other region as a non-observation portion, the second element does not overlap the third element, but does overlap at least one of the observation portions of the first element arranged in said latent image region, the observation portion of the first element arranged in said background region, and the observation portion of the first element arranged in said outline region, and the third element does not overlap the second element, but does overlap at least one of the observation portions of the first element arranged in said latent image region, the observation portion of the first element arranged in said background region, and the observation portion of the first element arranged in said outline region, thereby forming a latent image pattern.

11. A latent image pattern formed body according to claim 10, wherein the first elements arranged in said outline region are arranged substantially parallel to the first elements arranged in said latent image region and said background region, the second element is formed according to one of the following arrangements to form the latent image pattern:

i) the second element overlaps at least part of one of the observation portions of the first element arranged in said latent image region, the observation portion of the first element arranged in said background region, and the observation portion of the first element arranged in said outline region, and the third element overlaps at least part of one of the observation portions the second element does not overlap, or ii) the second element overlaps at least part of two of the observation portions of the first element arranged in said latent image region, the observation portion of the first element arranged in said background region, and the observation portion of the first element arranged in said outline region, the third element overlaps at least part of one of the observation portions the second element does not overlap, and when the second element does not overlap the observation portion of the first element arranged in said background region, but overlaps the observation portion of the first element arranged in said latent image region and the observation portion of the first element arranged in said outline region, an area ratio of the second element overlapping the observation portion of the first element arranged in said latent image region is different from the area ratio of the second element overlapping the observation portion of the first element arranged in said outline region, or when the second element does not overlap the observation portion of the first element arranged in said latent image region, but does overlap the observation portion of the first element arranged in said background region and the observation portion of the first element arranged in said outline region, the area ratio of the second element overlapping the observation portion of the first element arranged in said background region is different from the area ratio of the second element overlapping the observation portion of the first element arranged in said outline region.

12. A latent image pattern formed body according to claim 10, wherein the first element arranged in said outline region includes an outline element and an outline auxiliary element in phases shifted from each other, at least part of the outline element is arranged in the same phase as that of the first element arranged in said latent image region or the first element arranged in said background region, the outline auxiliary element is arranged in a phase different from that of the outline element between the outline element and the first element arranged in said latent image region, or the outline auxiliary element is arranged between the outline element and the first element arranged in said background region, the second element overlaps at least one of the observation portions of the first element arranged in said background region, the observation portion of the first element arranged in said latent image region, the observation portion of the outline element, and the observation portion of the outline auxiliary element, and the third element overlaps at least one of the observation portions of the first element arranged in said background region, the observation portion of the first element arranged in said latent image region, the observation portion of the outline element, and the second element does not overlap the observation portion of the outline auxiliary element.

13. A latent image pattern formed body according to claim 10, wherein said outline region includes a latent image adjacent outline element that is arranged adjacent to an outermost element of the latent image region, the phase of the first elements in the latent image adjacent outline element is partially changed with respect to the outermost line of the latent image element, and the latent image adjacent outline element is arranged at a pitch different from the first pitch of the first elements comprised in the latent image region.

14. A latent image pattern formed body according to claim 13, wherein the second element is arranged such that i) the second element overlaps at least part of one of the observation portions of the first element arranged in said latent image region, the observation portion of the first element arranged in said background region, and the observation portion of the latent image adjacent outline element, and the third element overlaps at least part of one of the observation portions of the first element arranged in said latent image region, the observation portion of the first element arranged in said background region, and the second element does not overlap the observation portion of the latent image adjacent outline element, or ii) the second element overlaps, with different area ratios, at least part of two of the observation portions of the first element arranged in said latent image region, the observation portion of the first element arranged in said background region, and the observation portion of the latent image adjacent outline element, and the third element overlaps at least part of one of the observation portions of the first element arranged in said latent image region, the observation portion of the first element arranged in said background region, and the second element does not overlap the observation portion of the latent image adjacent outline element.

15. A latent image pattern formed body according to claim 13, wherein said outline region includes a background adjacent outline element that is arranged on a side of the outline region opposite to the first elements arranged in said latent image region with respect to the latent image adjacent outline element and partially changes the phase in at least one of the first elements continuously adjacent to the latent image adjacent outline element, the second element overlaps at least one of the observation portions of the first element arranged in said background region, the observation portion of the first element arranged in said latent image region, the observation portion of the latent image adjacent outline element, and the observation portion of the background adjacent outline element, and the third element overlaps at least part of one of the observation portions of the first element arranged in said background region, the observation portion of the first element arranged in said latent image region, the observation portion of the latent image adjacent outline element, and the second element does not overlap the observation portion of the background adjacent outline element.

16. A latent image pattern formed body according to claim 14, wherein the background adjacent outline element is arranged on the side of the outline region opposite to the first elements arranged in said latent image region with respect to the latent image adjacent outline element and partially changes the phase in at least second and subsequent first elements continuously adjacent to the latent image adjacent outline element, and the outline element is formed between the latent image adjacent outline element and the background adjacent outline element in the same phase as that of the first element arranged in said background region, and the second element and the third element overlap at least three of the observation portions of the first element arranged in said background region, the observation portion of the first element arranged in said latent image region, the observation portion of the outline element, the observation portion of the latent image adjacent outline element, and the observation portion of the background adjacent outline element, the second element overlaps at least one of the observation portions of the first element arranged in said background region, the observation portion of the first element arranged in said latent image region, the observation portion of the outline element, the observation portion of the latent image adjacent outline element, and the observation portion of the background adjacent outline element, and the third element overlaps at least one of the observation portions of the first element arranged in said background region, the observation portion of the first element arranged in said latent image region, the observation portion of the outline element, the observation portion of the latent image adjacent outline element, and the second element does not overlap the observation portion of the background adjacent outline element.

17. A latent image pattern formed body according to claim 10, wherein said outline region includes a background adjacent outline element that is arranged on a side of the outline region opposite to a side where the first elements are arranged in said latent image region and the background adjacent outline element is formed by partially changing the phase of at least one of the first elements continuously adjacent to the latent image adjacent outline element, the outline element is formed between the background adjacent outline element and latent image adjacent outline element, and the first elements having multiple observation portions and the second element overlaps at least one of the observation portions of the first elements arranged in said background region, the observation portions of the first elements arranged in said latent image region, the observation portion of the outline element, and the observation portion of the background adjacent outline element, and the third element overlaps at least one of the observation portions of the first elements arranged in said background region, the observation portions of the first element arranged in said latent image region, the observation portion of the outline element, and the second element does not overlap the observation portion of the background adjacent outline element.

18. A latent image pattern formed body according to claim 1, wherein the first elements and the second elements are formed such that i) the first direction and the second direction are equal, and the first pitch and the second pitch are equal or different, or ii) the first direction and the second direction are different, and the first pitch and the second pitch are equal or different.

19. A latent image pattern formed body according to claim 10, wherein the first elements, the second elements, and the third elements are formed such that i) the first direction, the second direction, and the third direction are equal, and the first pitch, the second pitch, and the third pitch are equal, or at least one of the first pitch, the second pitch, and the third pitch is different from at least one of the remaining pitches, or ii) at least one of the first direction, the second direction, and the third direction is different from at least one of the remaining directions, and the first pitch, the second pitch, and the third pitch are equal, or at least one of the first pitch, the second pitch, and the third pitch is different from at least one of the remaining pitches.

20. A latent image pattern formed body according to claim 2, wherein the first elements and the second elements are formed based such that i) the first direction and the second direction are equal, and the first pitch and the second pitch are equal or different, or ii) the first direction and the second direction are different, and the first pitch and the second pitch are equal or different.

* * * * *